US006760447B1

(12) United States Patent
Nelson et al.

(10) Patent No.: US 6,760,447 B1
(45) Date of Patent: Jul. 6, 2004

(54) SOUND RECORDING AND REPRODUCTION SYSTEMS

(75) Inventors: Philip Arthur Nelson, Southampton (GB); Ole Kirkeby, Tokyo (JP); Hareo Hamada, Tokyo (JP)

(73) Assignee: Adaptive Audio Limited, Southampton (GB)

( * ) Notice: Subject to any disclaimer, the term of this patent is extended or adjusted under 35 U.S.C. 154(b) by 0 days.

(21) Appl. No.: 09/125,308

(22) PCT Filed: Feb. 14, 1997

(86) PCT No.: PCT/GB97/00415

§ 371 (c)(1),
(2), (4) Date: Jan. 19, 1999

(87) PCT Pub. No.: WO97/30566

PCT Pub. Date: Aug. 21, 1997

(30) Foreign Application Priority Data

Feb. 16, 1996 (GB) ..... 9603236

(51) Int. Cl.[7] ..... H04R 5/00
(52) U.S. Cl. ..... 381/17
(58) Field of Search ..... 381/17, 18, 1, 381/61, 63

(56) References Cited

U.S. PATENT DOCUMENTS 5,333,200 A 7/1994 Cooper et al.

FOREIGN PATENT DOCUMENTS

| | | |
|---|---|---|
| EP | 0 434 691 B1 | 3/1995 |
| GB | 2181626 A | 4/1987 |
| WO | WO 94/01981 | 1/1994 |
| WO | WO 94/27416 | 11/1994 |
| WO | WO 96/06515 | 2/1996 |

*Primary Examiner*—Ping Lee
(74) *Attorney, Agent, or Firm*—Christensen O'Connor Johnson Kindness PLLC

(57) ABSTRACT

A method of recording sound for reproduction by a plurality of loudspeakers, or for processing sound for reproduction by a plurality of loudspeakers, is described in which some of the reproduced sound appears to a listener to emmanate from a virtual source which is spaced from the loudspeakers. A filter means (H) is used either in creating the recording, or in processing the recorded signals for supply to loudspeakers, the filter means (H) being created in a filter design step in which: a) a technique is employed to minimise error between the signals (w) reproduced at the intended position of a listener on playing the recording through the loudspeakers, and desired signals (d) at the intended position, wherein: b) said desired signals (d) to be produced at the listener are defined by signals (or an estimate of the signals) that would be produced at the ears of (or in the region of) the listener in said intended position by a source at the desired position of the virtual source. A least squares technique may be employed to minimise the time averaged error between signal reproduced at the intended position of a listener and the desired signal, or it may be applied to the frequency domain.

22 Claims, 45 Drawing Sheets

SOUND RECORDING AND REPRODUCTION SYSTEMS

This is a United States national application corresponding to copending International Application No. PCT/GB97/00415, filed Feb. 14, 1997, which designates the United States, and claims the benefit of the filing date under 35 U.S.C. §120, which in turn claims the benefit of British Application No. 9603236.2, filed Feb. 16, 1996, and claims the benefit of the filing date under 35 U.S.C. §119.

BACKGROUND TO THE INVENTION

This invention relates to sound recording and reproduction systems, and is particularly concerned with stereo sound reproduction systems wherein at least two loudspeakers are employed.

It is possible to give a listener the impression that there is a sound source, referred to as a virtual sound source, at a given position in space provided that the sound pressures that are reproduced at the listener's ears are the same as the sound pressures that would have been produced at the listener's ears by a real source at the desired position of the virtual source. This attempt to deceive the human hearing can be implemented by using either headphones or loudspeakers. Both methods have their advantages and drawbacks.

Using headphones, no processing of the desired signals is necessary irrespective of the acoustic environment in which they are used. However, headphone reproduction of binaural material often suffers from 'in-the-head' localisation of certain sound sources, and poor localisation of frontal and rear sources. It is generally very difficult to give the listener the impression that the virtual sound source is truly external, i.e. 'outside the head'.

Using loudspeakers, it is not difficult to make the virtual sound source appear to be truly external. However, it is necessary to use relatively sophisticated digital signal processing in order to obtain the desired effect, and the perceived quality of the virtual source depends on both the properties (characteristics) of the loudspeakers and to some extent the acoustic environment.

Using two loudspeakers, two desired signals can be reproduced with great accuracy at two points in space. When these two points are chosen to coincide with the positions of the ears of a listener, it is possible to provide very convincing sound images for that listener. This method has been implemented by a number of different systems which have all used widely spaced loudspeaker arrangements spanning typically 60 degrees as seen by the listener. A fundamental problem that one faces when using such a loudspeaker arrangement is that convincing virtual images are only experienced within a very confined spatial region or 'bubble' surrounding the listener's head. If the head moves more than a few centimetres to the side, the illusion created by the virtual source image breaks down completely. Thus, virtual source imaging using two widely spaced loudspeakers is not very robust with respect to head movement.

We have discovered, somewhat surprisingly, that a virtual sound source imaging form of sound reproduction system using two closely spaced loudspeakers can be extremely robust with respect to head movement. The size of the 'bubble' around the listener's head is increased significantly without any noticeable reduction in performance. In addition, the close loudspeaker arrangement also makes it possible to include the two loudspeakers in a single cabinet.

From time to time herein, the present invention is conveniently referred to as a 'stereo dipole', although the sound field it produces is an approximation to the sound field that would be produced by a combination of point monopole and point dipole sources.

SUMMARIES OF THE INVENTION

According to one aspect of the present invention, a sound reproduction system comprises loudspeaker means, and loudspeaker drive means for driving the loudspeaker means in response to signals from at least one sound channel, the loudspeaker means comprising a closely-spaced pair of loudspeakers, defining with the listener an included angle of between 6° and 20°, inclusive, the loudspeaker drive means comprising filter means.

The included angle may be between 8° and 12° inclusive, but is preferably substantially 10°.

The filter means may comprise or incorporate one or more of cross-talk cancellation means, least mean squares approximation, virtual source imaging means, head related transfer means, frequency regularisation means and modelling delay means.

The loudspeaker pair may be contiguous, but preferably the spacing between the centres of the loudspeakers is no more than about 45 cms.

The system is preferably designed such that the optimal position for listening is at a head position between 0.2 meters and 4.0 meters from the loudspeakers, and preferably about 2.0 meters from said loudspeakers. Alternatively, at a head position between 0.2 meters and 1.0 meters from the loudspeakers.

The loudspeaker centres may be disposed substantially parallel to each other, or disposed so that the axes of their centres are inclined to each other, in a convergent manner.

The loudspeakers may be housed in a single cabinet.

The loudspeaker drive means preferably comprise digital filter means.

According to a second aspect of the present invention, a stereo sound reproduction system comprises a closely-spaced pair of loudspeakers, defining with a listener an included angle of between 6° and 20° inclusive, a single cabinet housing the two loudspeakers, loudspeaker drive means in the form of filter means designed using a representation of the HRTF (head related transfer function) of a listener, and means for inputting loudspeaker drive signals to said filter means.

According to a third aspect of the present invention, a stereo sound reproduction system comprises a closely-spaced pair of loudspeakers, defining with the listener an included angle of between 6° and 20° inclusive, and converging at a point between 0.2 meters and 4.0 meters from said loudspeakers, the loudspeakers being disposed within a single cabinet.

In accordance with a fourth aspect, the present invention may also be implemented by creating sound recordings that can be subsequently played through a closely-spaced pair of loudspeakers using 'conventional' stereo amplifiers, filter means being employed in creating the sound recordings, thereby avoiding the need to provide a filter means at the input to the speakers.

The filter means that is used to create the recordings preferably have the same characteristics as the filter means employed in the systems in accordance with the first and second aspects of the invention.

The fourth aspect of the invention enables the production from conventional stereo recordings of further recordings, using said filter means as aforesaid, which further recordings can be used to provide loudspeaker inputs to a pair of closely-spaced loudspeakers, preferably disposed within a single cabinet.

Thus it will be appreciated that the filter means is used in creating the further recordings, and the user may use a substantially conventional amplifier system without needing himself to provide the filter means.

A sixth aspect of the invention is a recording of sound which has been created by subjecting a stereo or multi-channel recording signal to a filter means which is capable of being used in the system in accordance with the first or second aspects of the invention.

BRIEF DESCRIPTION OF THE DRAWINGS

Examples of the various aspects of the present invention will now be described by way of example only, with reference to the accompanying drawings, wherein:

FIG. 1(*c*) in block diagram form, FIGS. 2(*a*), 2(*b*) and 2(*c*) are front views which show how different forms of loudspeakers may be housed in single cabinets, FIG. 11*a* plots are equivalent to those shown in FIG. 10*a*. FIG. 11*b* is as FIG. 11*a* but for a loudspeaker span of 10°. In the case of FIG. 11*b*, the illustrated plots are equivalent to those shown by FIG. 10*c*, FIGS. 12*a*, 12*b* and 12*c* illustrate the time response of the two source input signals (thick line, $v_1(t)$, thin line, $v_2(t)$) required to create a virtual source at the position (1 m,0 m) for the three loudspeaker spans θ of 60° (FIG. 12*a*), 20° (FIG. 12*b*), and 10° (FIG. 12*c*). Note that the effective duration of both $v_1(t)$ and $V_2(t)$ decreases as θ decreases.

DETAILED DESCRIPTIONS OF THE PREFERRED EMBODIMENTS

Figure 1A:
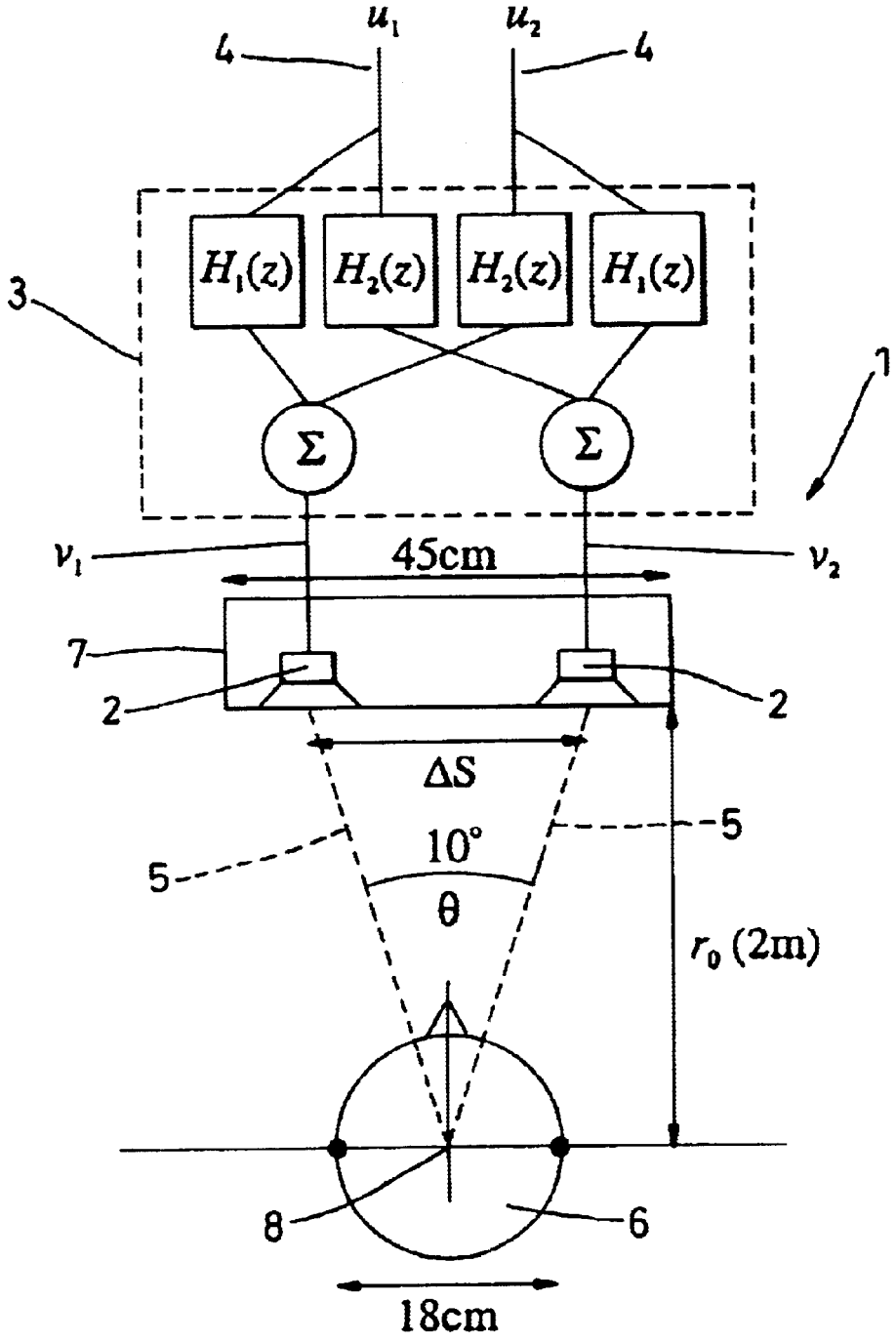
FIG. 1(*a*) is a plan view which illustrates the general principle of the invention, FIG. 1(*b*) shows the loudspeaker position compensation problem in outline.
Figure 1B:
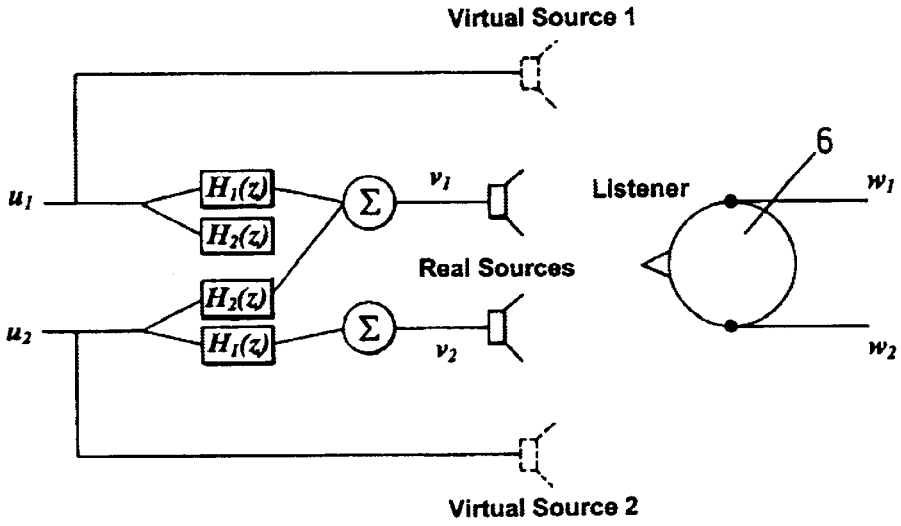
Figure 1C:
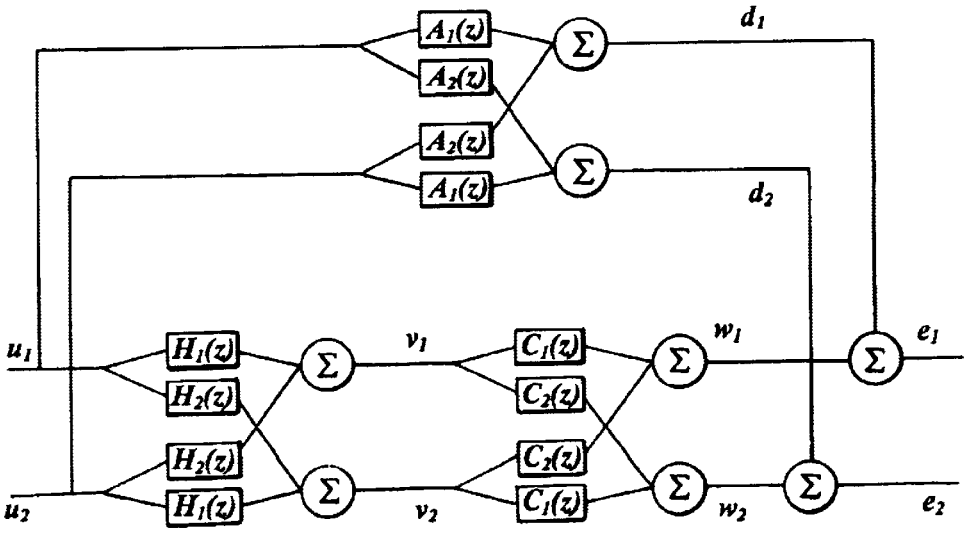

With reference to FIG. 1(*a*), a sound reproduction system 1 which provides virtual source imaging, comprises loudspeaker means in the form of a pair of loudspeakers 2, and loudspeaker drive means 3 for driving the loudspeakers 2 in response to output signals from a plurality of sound channels 4.

The loudspeakers 2 comprise a closely-spaced pair of loudspeakers, the radiated outputs 5 of which are directed towards a listener 6. The loudspeakers 2 are arranged so that they to define, with the listener 6, a convergent included angle θ of between 6° and 20° inclusive.

In this example, the included angle θ is substantially, or about, 10°.

The loudspeakers 2 are disposed side by side in a contiguous manner within a single cabinet 7. The outputs 5 of the loudspeakers 2 converge at a point 8 between 0.2 meters and 4.0 meters (distance $r_0$) from the loudspeaker. In this example, point 8 is about 2.0 meters from the loudspeakers 2.

The distance ΔS (span) between the centres of the two loudspeakers 2 is preferably 45.0 cm or less. Where, as in FIGS. 2(*b*) and 2(*c*), the loudspeaker means comprise several loudspeaker units, this preferred distance applies particularly to loudspeaker units which radiate low-frequency sound.

The loudspeaker drive means 3 comprise two pairs of digital filters with inputs $u_1$ and $u_2$, and outputs $v_1$ and $V_2$. Two different digital filter systems will be described hereinafter with reference to FIGS. 7 and 8.

The loudspeakers 2 illustrated are disposed in a substantially parallel array. However, in an alternative arrangement, the axes of the loudspeaker centres may be inclined to each other, in a convergent manner.

In FIG. 1, the angle θ spanned by the two speakers 2 as seen by the listener 6 is of the order of 10 degrees as opposed to the 60 degrees usually recommended for listening to, and mixing of, conventional stereo recordings. Thus, it is possible to make a single 'box' 7 that contains the two loudspeakers capable of producing convincing spatial sound images for a single listener, by means of two processed signals, $v_1$ and $v_2$, being fed to the speakers 2 within a speaker cabinet 7 placed directly in front of the listener.

Approaches to the design of digital filters which ensure good virtual source imaging have previously been disclosed in European patent no. 0434691, patent specification no. WO94/01981 and patent application no. PCT/GB95/02005.

Figure 3:
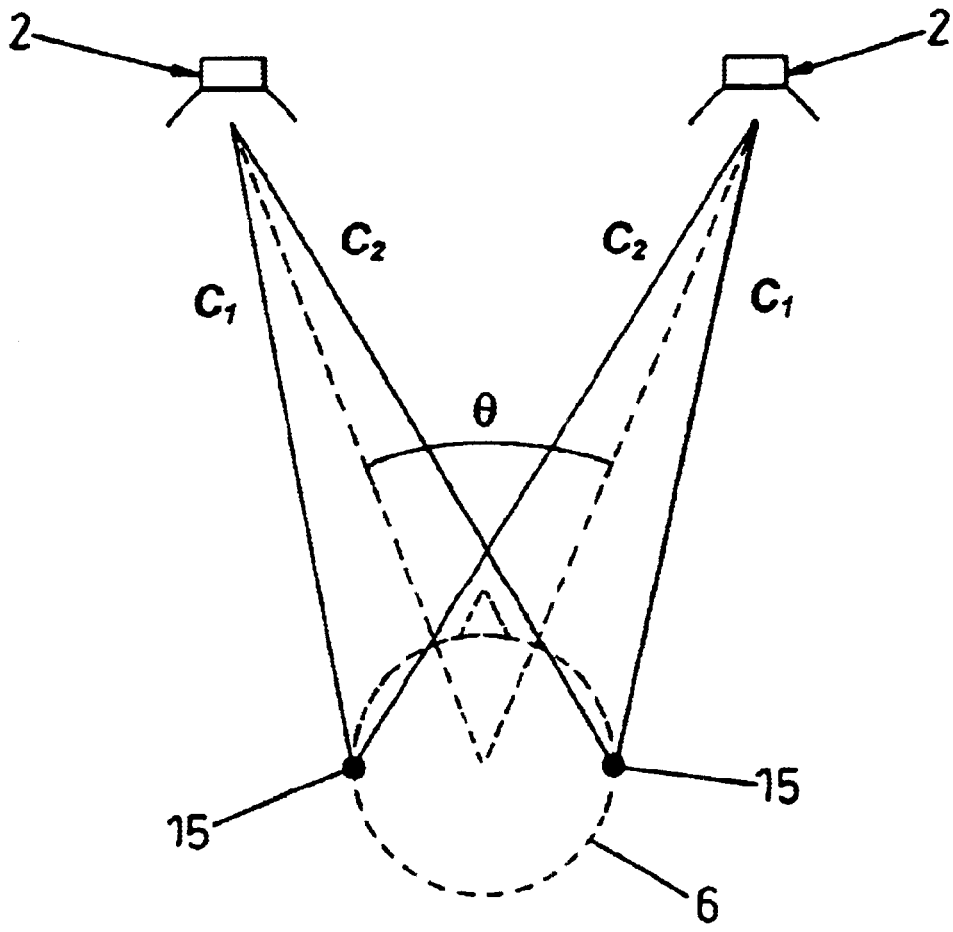
FIG. 3 is a plan view which defines the electro-acoustic transfer functions between a pair of loudspeakers, the listener's ears, and the included angle θ, FIGS. 4(*a*), 4(*b*) 4(*c*) and 4(*d*) illustrate the magnitude of the frequency responses of the filters that implement cross-talk cancellation of the system of FIG. 3 for four different spacings of a loudspeaker pair, FIG. 5 defines the geometry used to illustrate the effectiveness of cross-talk cancellation as the listener's head is moved to one side, FIGS. 6(*a*) to 6(*n*) illustrate amplitude spectra of the reproduced signals at a listener's ears, for different spacings of a loudspeaker pair.
Figure 4A:
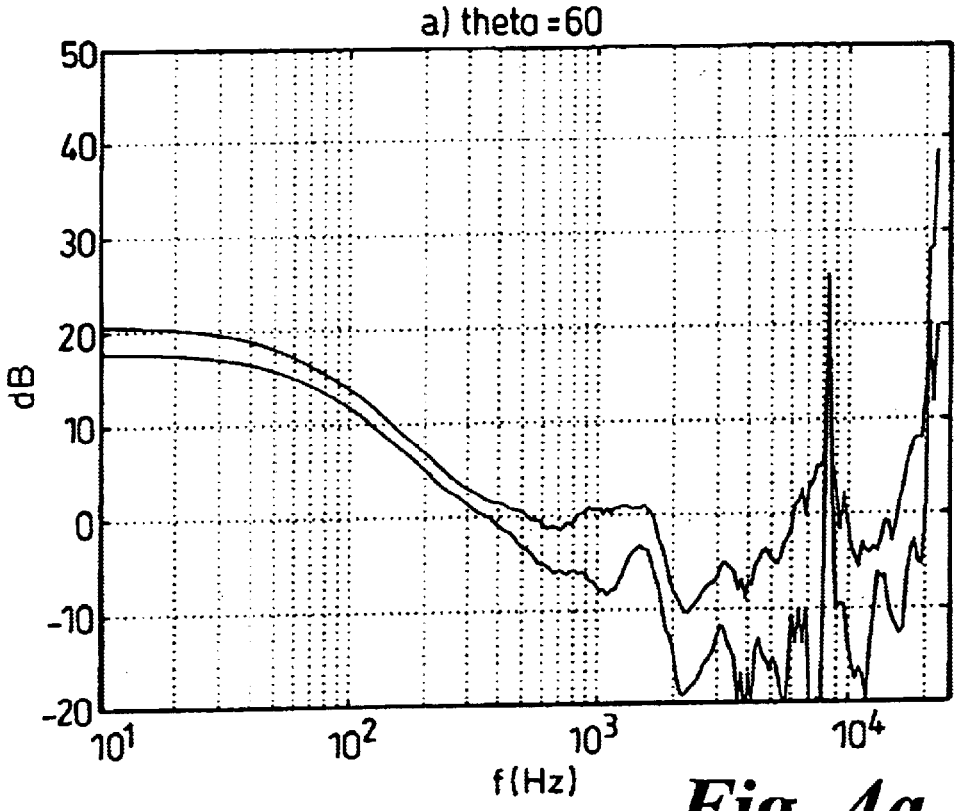
Figure 4B:
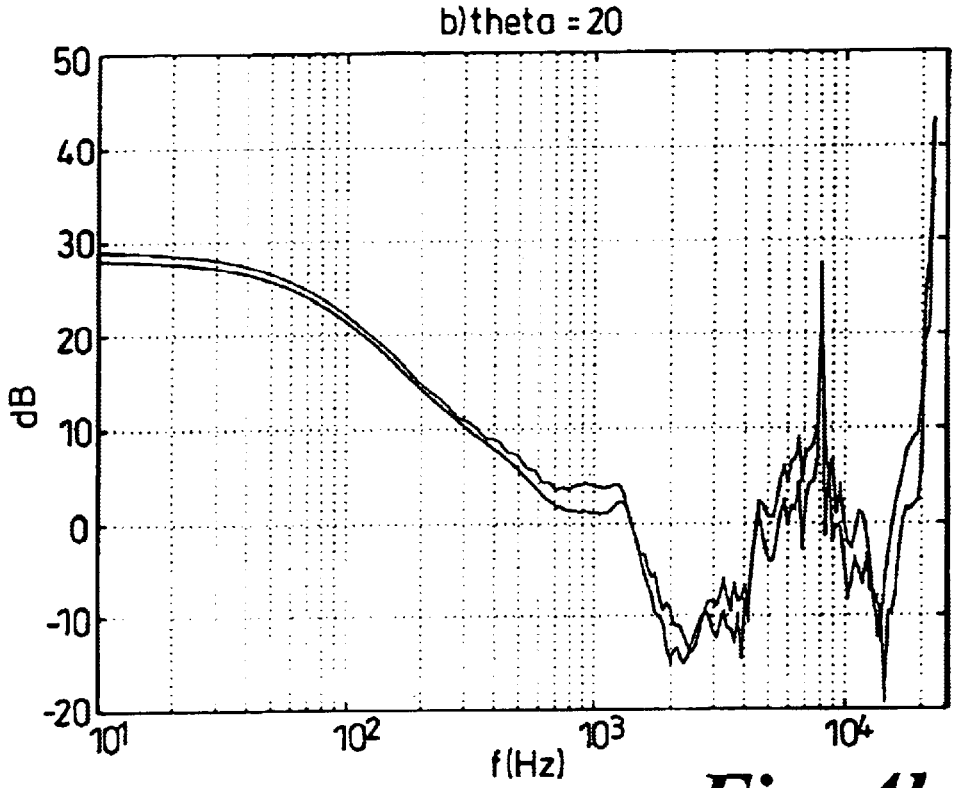
Figure 4C:
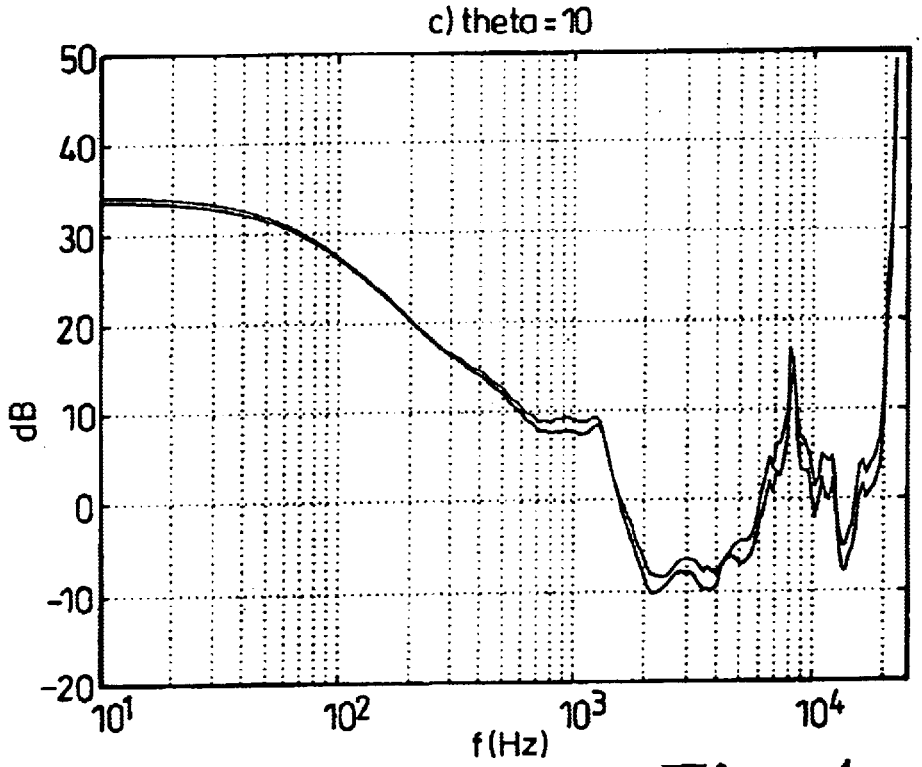
Figure 4D:
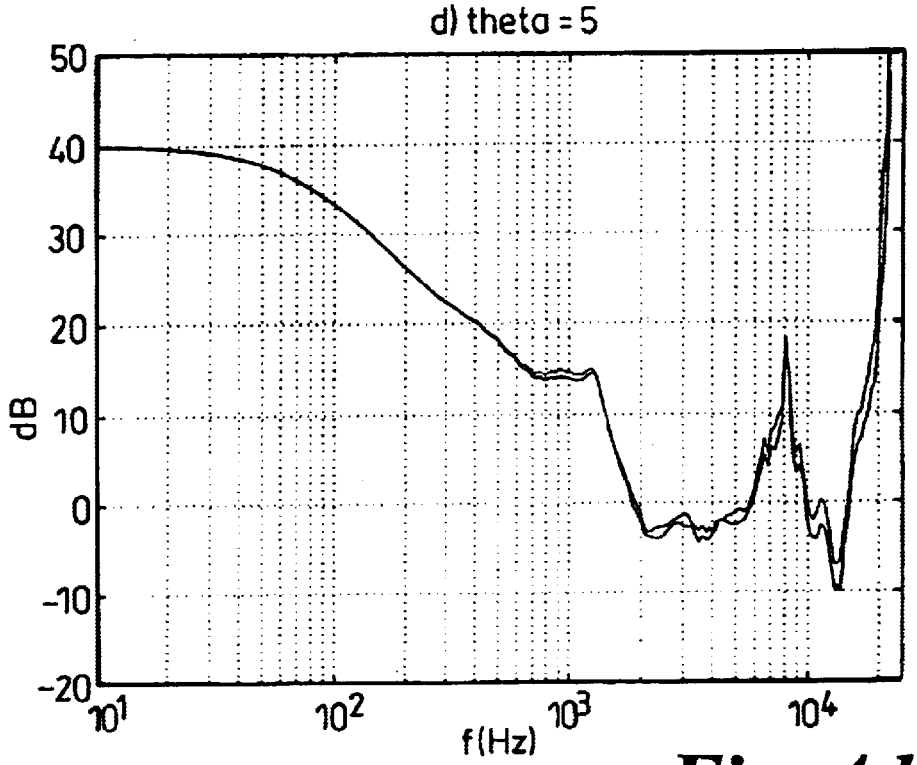

The principles underlying the present invention are also described with reference to FIG. 3 of specification PCT/GB95/02005. These principles are also shown in FIGS. 1(*b*) and 9(*c*) of the present application.

The loudspeaker position compensation problem is illustrated by FIG. 1(*b*) in outline and in FIG. 1(*c*) in block diagram form. Note that the signals $u_1$ and $u_2$ denote those produced in a conventional stereophonic recording. The digital filters $A_1$ and $A_2$ denote the transfer functions between the inputs to ideally placed virtual loudspeaker and the ears of the listener. Note also that since the positions of both the real sources and the virtual sources are assumed to be symmetric with respect to the listener, there are only two different filters in each 2-by-2 filter matrix.

The matrix C(z) of electro-acoustic transfer functions defines the relationship between the vector of loudspeaker input signals $[v_1(n)\ v_2(n)]$ and the vector of signals $[w_1(n)\ w_2(n)]$ reproduced at the ears of a listener. The matrix of inverse filters H(z) is designed to ensure that the sum of the time averaged squared values of the error signals $e_1(n)$ and $e_2(n)$ is minimised. These error signals quantify the difference between the signals $[w_1(n)\ w_2(n)]$ reproduced at the listener's ears and the signals $[d_1(n)\ d_2(n)]$ that are desired to be reproduced. In the present invention, these desired signals are defined as those that would be reproduced by a pair of virtual sources spaced well apart from the positions of the actual loudspeaker sources used for reproduction. The matrix of filters A(z) is used to define these desired signals relative to the input signals $[u_1(n)\ u_2(n)]$ which are those normally associated with a conventional stereophonic recording. The elements of the matrices A(z) and C(z) describe the Head Related Transfer Function (HRTF) of the listener. These HRTFs can be deduced in a number of ways as disclosed in PCT/GB95/02005. One technique which has been found particularly useful in the operation of the present invention is to make use of a pre-recorded database of HRTFs. Also as disclosed in PCT/GB95/02005, the inverse filter matrix H(z) is conveniently deduced by first calculating the matrix $H_x(z)$ of 'cross-talk cancellation' filters which, to a good approximation, ensures that a signal input to the left loudspeaker is only reproduced at the left ear of a listener and the signal input to the right loudspeaker is only reproduced at the right ear of a listener; ie to a good approximation $C(z)H(z)=z^{-\Delta}I$, where Δ is a modelling delay and I is the identity matrix. The inverse filter matrix H(z) is then calculated from $H(z)=H_x(z)A(z)$. Note that it is also possible, by calculating the cross-talk cancellation matrix $H_x(z)$, to use the present invention for the reproduction of binaurally recorded material, since in this case the two signals $[u_1(n)\ u_2(n)]$ are those recorded at the ears of a dummy head. These signals can be used as inputs to the matrix of cross-talk cancellation filters whose outputs are then fed to the loudspeakers, thereby ensuring that $u_1(n)$ and $u_2(n)$ are to a good approximation reproduced at the listener's ears. Normally, however, the signals $u_1(n)$ and $u_2(n)$ are those associated with a conventional stereophonic recording and they are used as inputs to the matrix H(z) of inverse filters designed to ensure the reproduction of signals at the listener's ears that would be reproduced by the spaced apart virtual loudspeaker sources.

Figure 2:
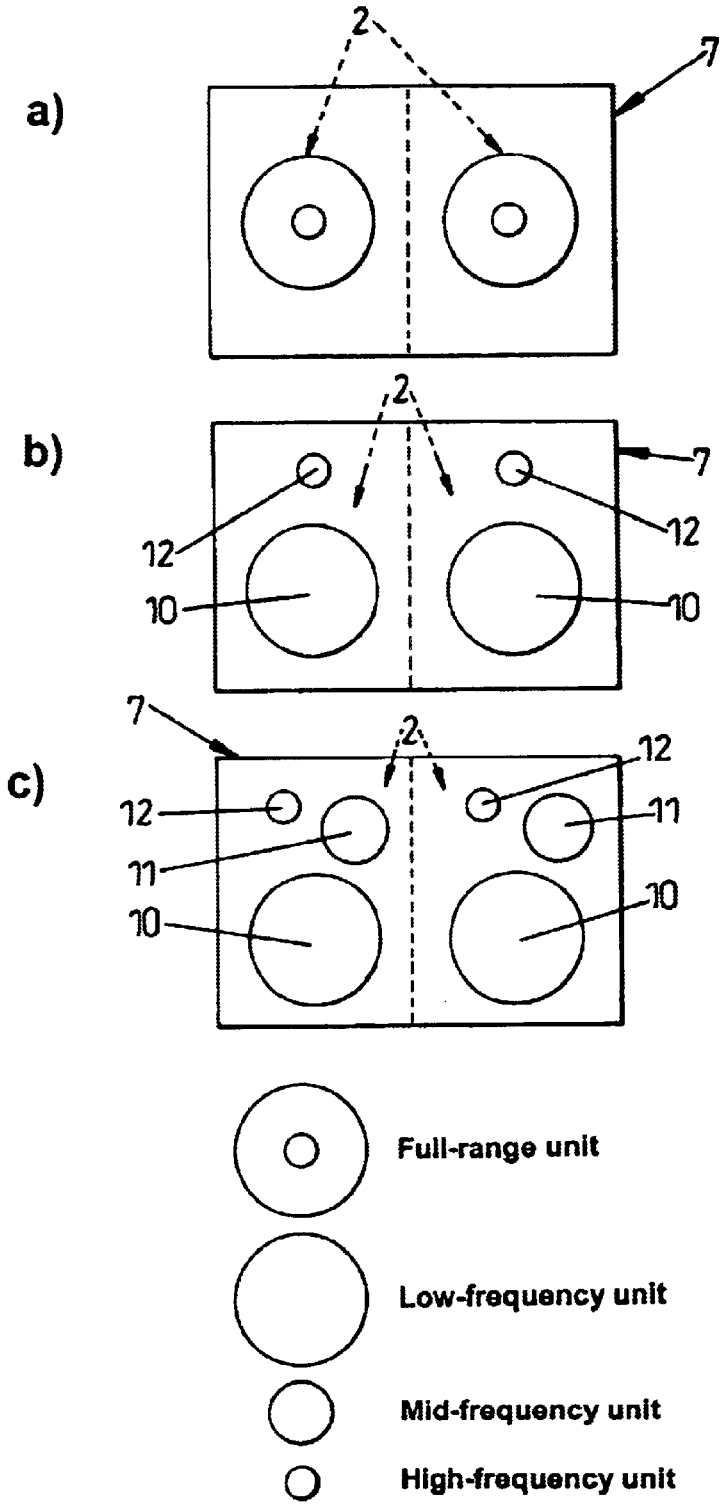

FIG. 2 shows three examples of how to configure different units of the two loudspeakers in a single cabinet. When each loudspeaker 2 consists of only one full range unit, the two units should be positioned next to each other as in FIG. 2(*a*). When each loudspeaker consists of two or more units, these units can be placed in various ways, as illustrated by FIGS. 2(*b*) and 2(*c*) where low-frequency units 10, mid-frequency units 11, and high-frequency units 12 are also employed.

Using two loudspeakers 2 positioned symmetrically in front of the listener's head, we now consider how the performance of a virtual source imaging system depends on the angle θ spanned by the two loudspeakers. The geometry of the problem is shown in FIG. 3. Since the loudspeaker-microphone (2/15) layout is symmetric, there are only two different electro-acoustic transfer functions, $C_1(z)$ and $C_2(z)$. Thus, the transfer function matrix C(z) (relating the vector of loudspeaker input signals to the vector of signals produced at the listener's ears) has the following structure:

$$C(z) = \begin{bmatrix} C_1(z) & C_2(z) \\ C_2(z) & C_1(z) \end{bmatrix}$$

Likewise, there are also only two different elements, $H_1(z)$ and $H_2(z)$, in the cross-talk cancellation matrix. Thus, the cross-talk cancellation matrix $H_x(z)$ has the following structure:

$$H_x(z) = \begin{bmatrix} H_{x_1}(z) & H_{x_2}(z) \\ H_{x_2}(z) & H_{x_1}(z) \end{bmatrix}$$

The elements of $H_x(z)$ can be calculated using the techniques described in detail in specification no. PCT/GB95/02005, preferably using the frequency domain approach described therein. Note that it is usually necessary to use regularisation to avoid the undesirable effects of ill-conditioning showing up in $H_x(z)$.

The cross-talk cancellation matrix $H_x(z)$ is easiest to calculate when C(z) contains only relatively little detail. For example, it is much more difficult to invert a matrix of transfer functions measured in a reverberant room than a matrix of transfer functions measured in an anechoic room. Furthermore, it is reasonable to assume that a set of inverse filters whose frequency responses are relatively smooth is likely to sound 'more natural', or 'less coloured', than a set of filters whose frequency responses are wildly oscillating, even if both inversions are perfect at all frequencies. For that reason, we use a set of HRTFs taken from the MIT Media Lab's database which has been made available for researchers over the Internet. Each HRTF is the result of a measurement taken at every 5° in the horizontal plane in an anechoic chamber using a sampling frequency of 44.1 kHz. We use the 'compact' version of the database. Each HRTF has been equalised for the loudspeaker response before being truncated to retain only 128 coefficients (we also scaled the HRTFs to make their values lie within the range from −1 to +1).

FIG. 4 shows the frequency responses of $H_{x1}(z)$ and $H_{x2}(Z)$ for the four different loudspeaker spans, namely a) 60°, b) 20°, c) 10°, and d) 5°. The filters used contain 1024 coefficients each, and they are calculated using the frequency domain inversion method described. No regularisation is used, but even so the undesirable wrap-around effect caused by the frequency sampling is not a serious problem, and the inversion is for all practical purposes perfect over the entire audio frequency range. Nevertheless, what is important is that the responses of $H_{x1}(z)$ and $H_{x2}(z)$ at very low frequencies increase as the angle θ spanned by the loudspeakers is reduced. This means that as the loudspeakers are moved closer together, more low-frequency output is needed to achieve the cross-talk cancellation. This causes two serious problems: one is that the low-frequency power required to be output by the system can be dangerous to the well-being of both the loudspeakers and the associated amplifier; the other is that even if the equipment can cope with the load, the sound reproduced at some locations away from the intended listening position will be of relatively high amplitude. Clearly, it is undesirable to make the loudspeakers work very hard with the result that the sound is actually being 'beamed' away from the intended listening position. Thus, there is a minimum loudspeaker span θ below which it is not possible, in practice, to reproduce sufficient low-frequency sound at the intended listening position. It is worth pointing out, though, that it is only when the virtual sources are not close to the real sources that the loudspeakers will have to work hard. When the virtual source is close to a loudspeaker, the system will automatically direct almost all of the electrical input to that loudspeaker.

Note that only the moduli of the cross-talk cancellation filters have been illustrated by FIG. 4 and the phase difference between the frequency responses at low frequencies becomes closer and closer to 180° (pi radians) as the angle θ is reduced.

It is reasonable to assume that the performance of the virtual source imaging system is determined mainly by the effectiveness of the cross-talk cancellation. Thus, if it is possible to produce a single impulse at the left ear of a listener while nothing is heard at the right ear thereof, then any signal can be reproduced at the left ear. The same argument holds for the right ear because of the symmetry. As the listener's head is moved, the signals reproduced at the left and right ear are changed. Generally speaking, head rotation, and head movement directly towards or away from the loudspeakers, do not cause a significant reduction in the effectiveness of the cross-talk cancellation. However, the effectiveness of the cross-talk cancellation is quite sensitive to head movements to the side. For example, if the listener's head is moved 18 cm to the left, the 'quiet' right ear is moved into the 'loud' zone. Thus, one should not normally expect an efficient cross-talk cancellation when the listener's head is displaced by more than 15 cm to the side.

Figure 5:
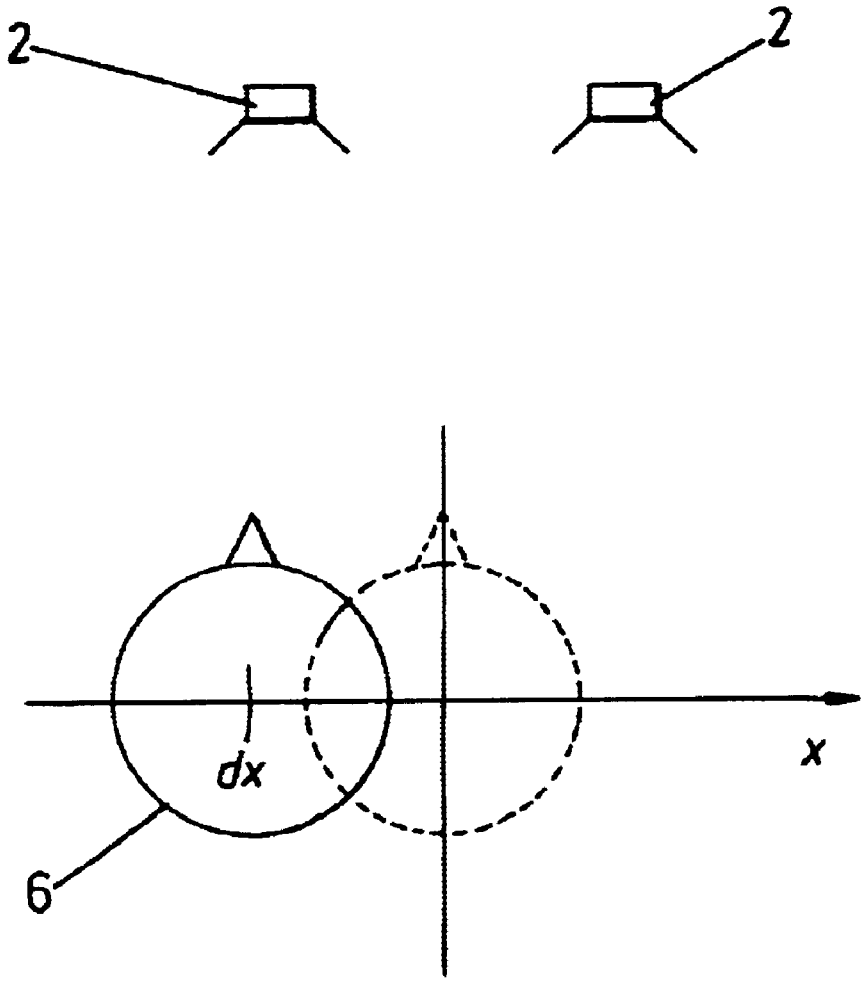
Figure 6A:
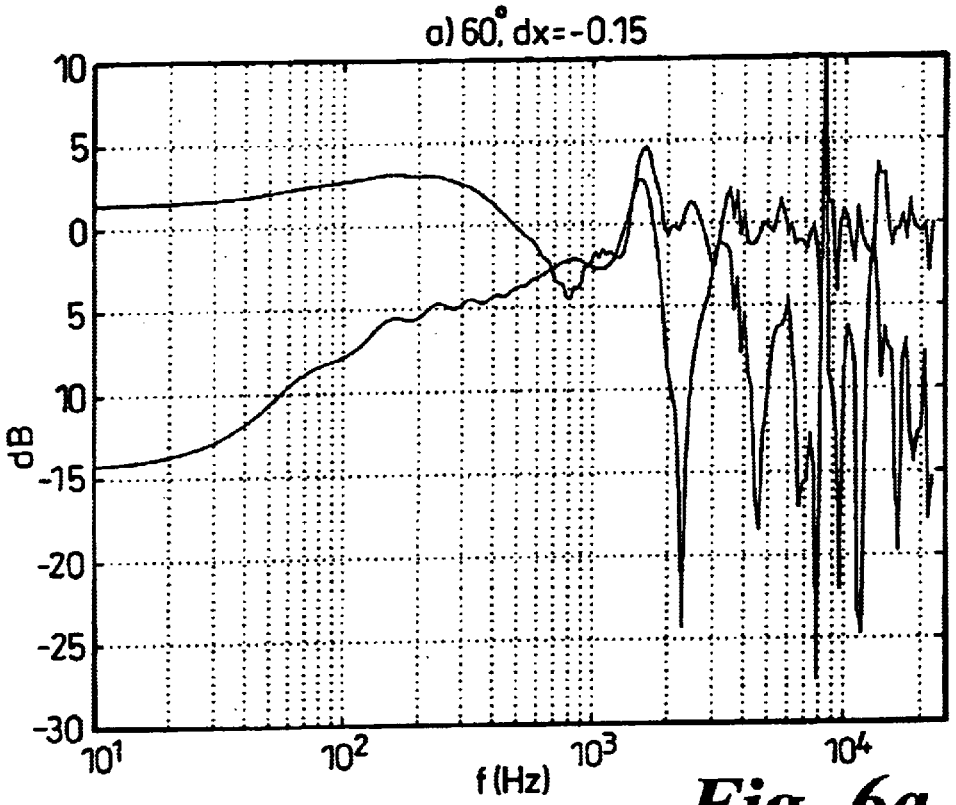
Figure 6B:
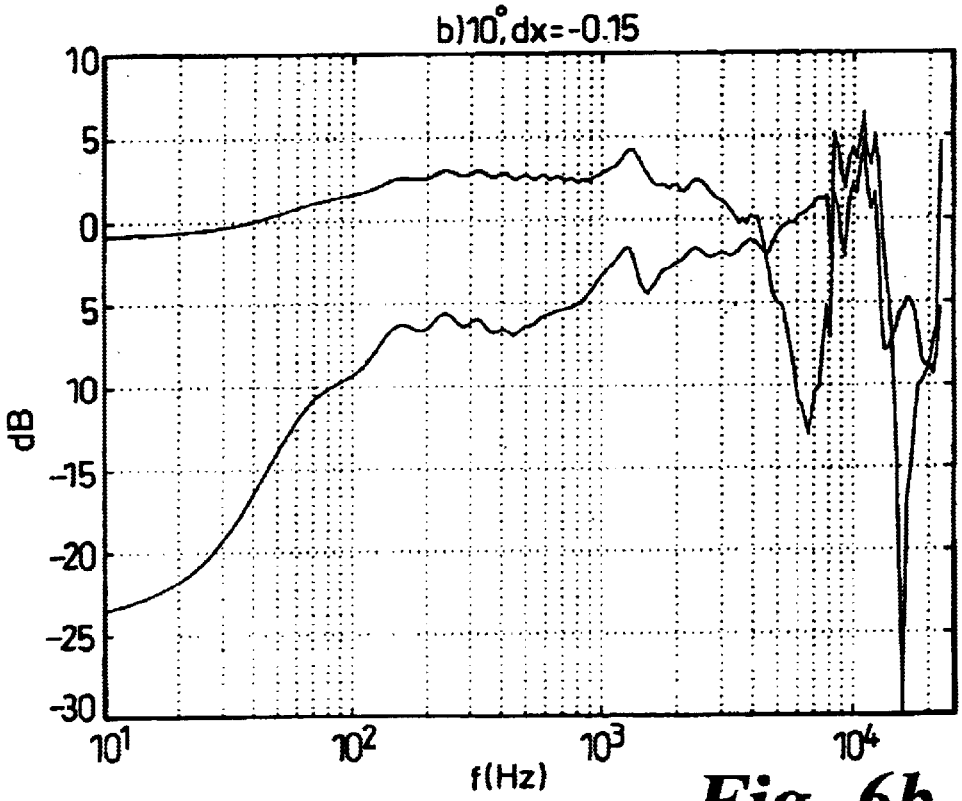
Figure 6C:
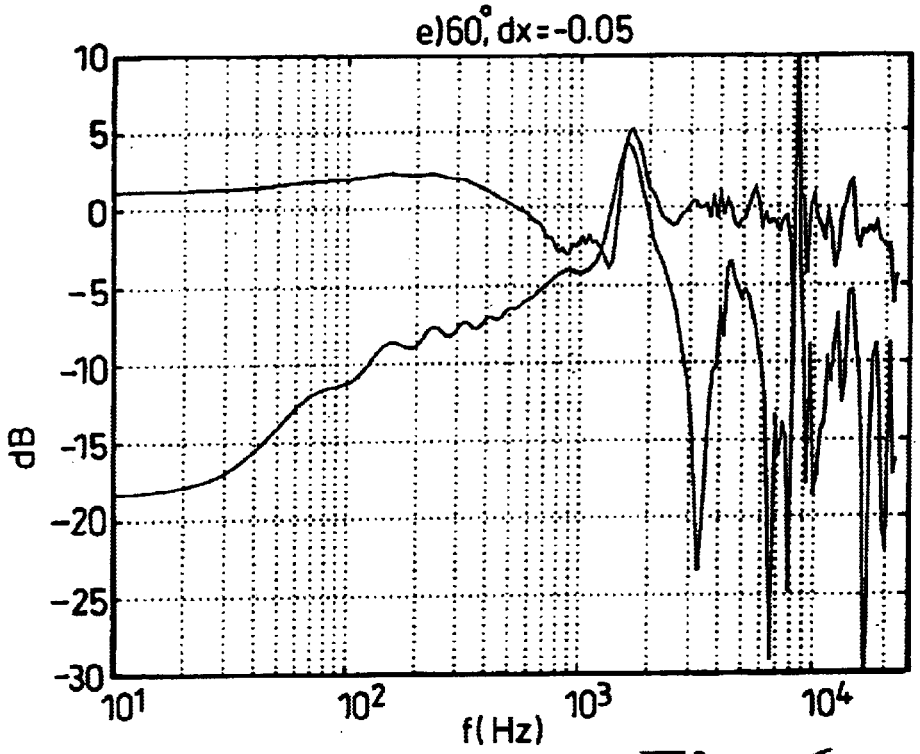
Figure 6D:
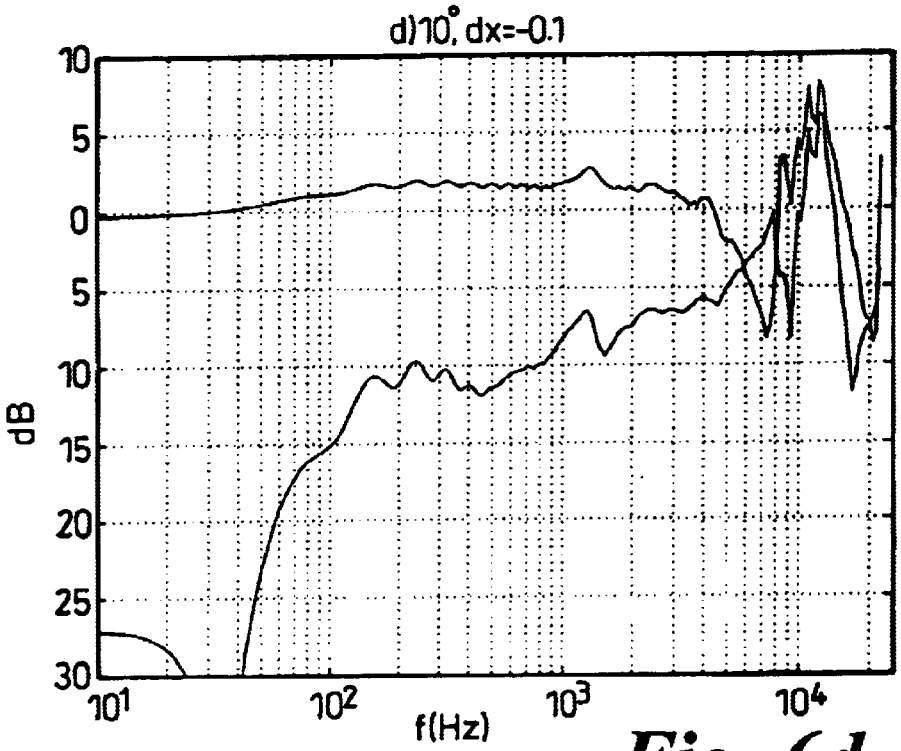
Figure 6E:
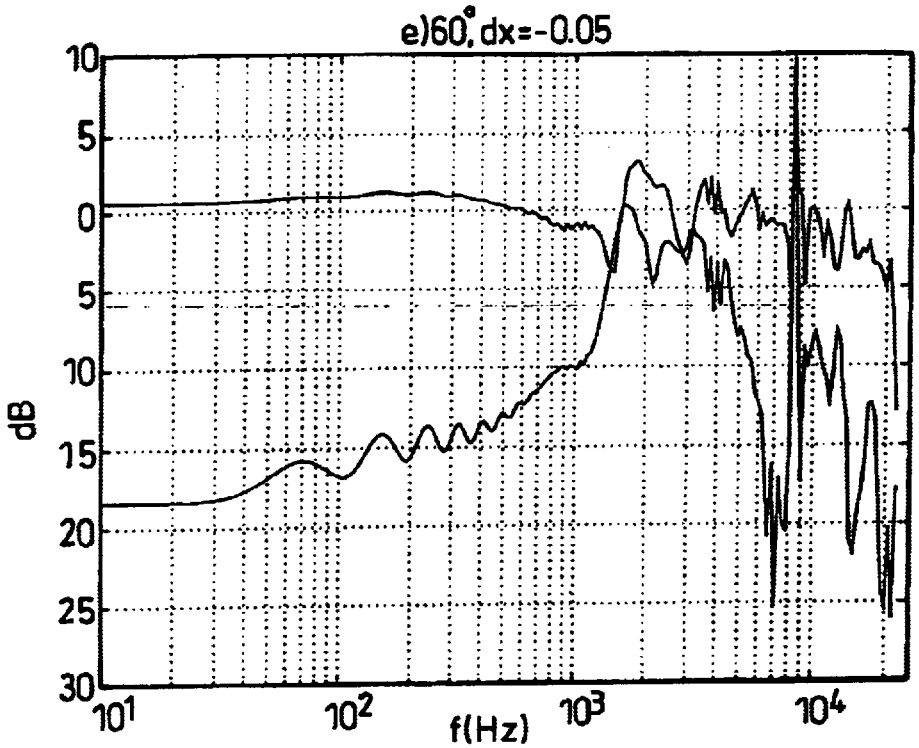
Figure 6F:
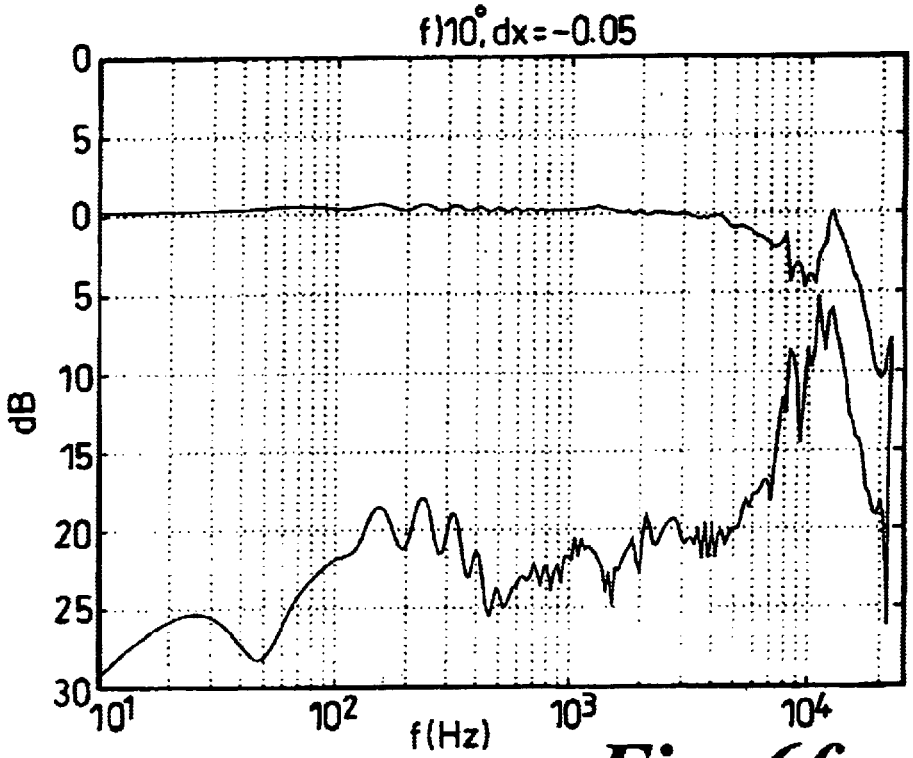
Figure 6G:
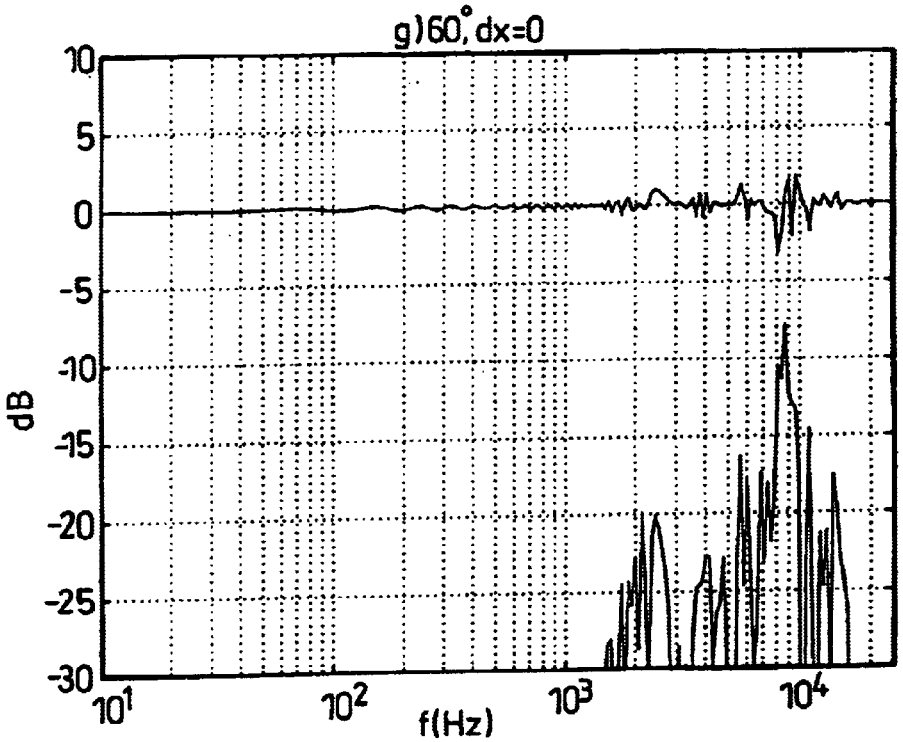
Figure 6H:
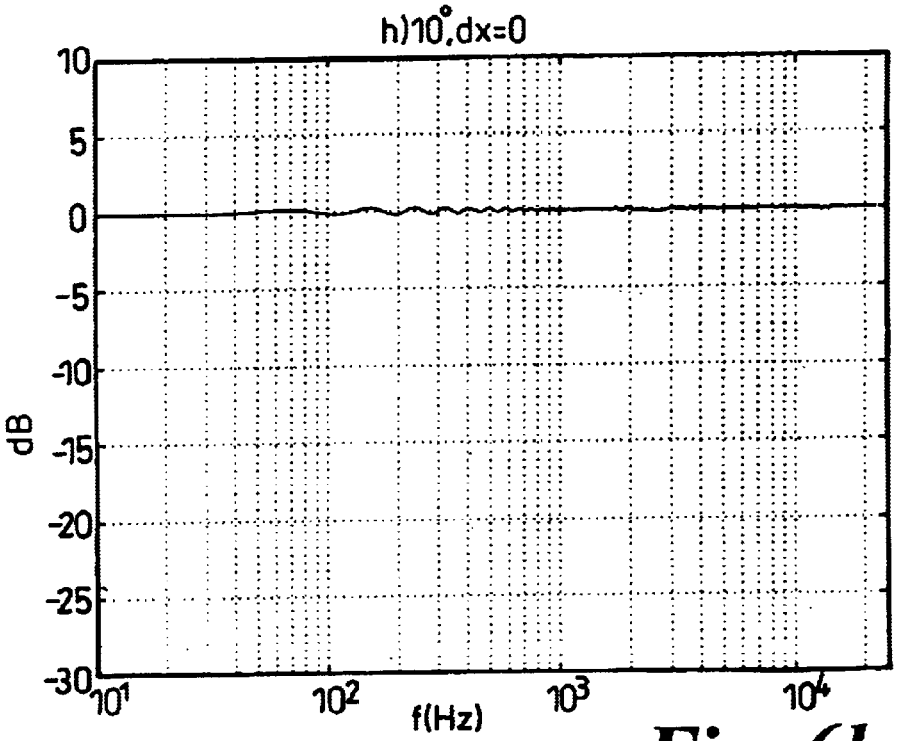
Figure 6I:
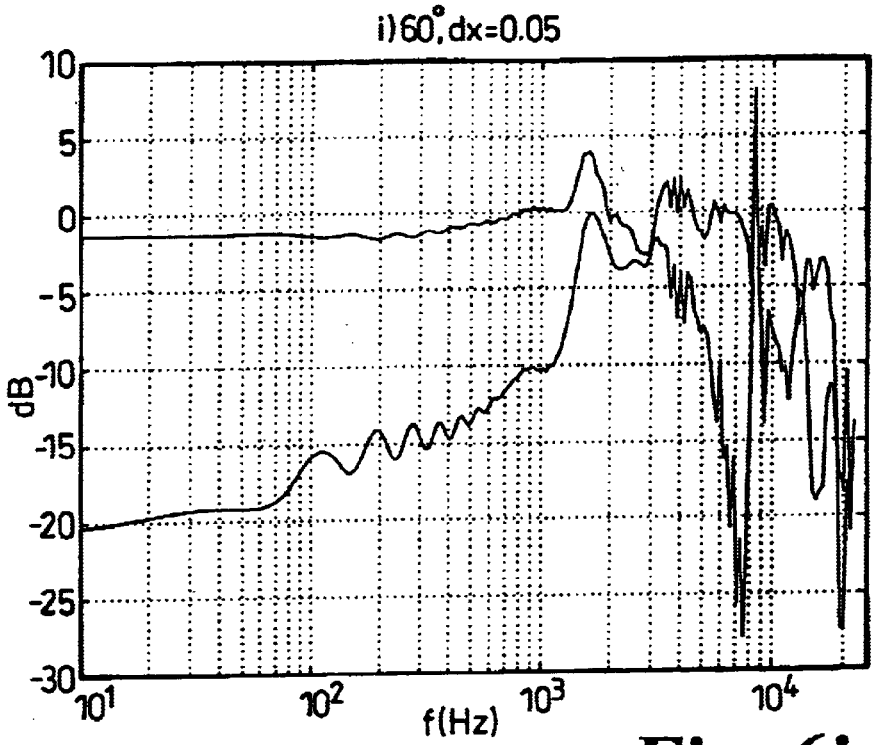
Figure 6J:
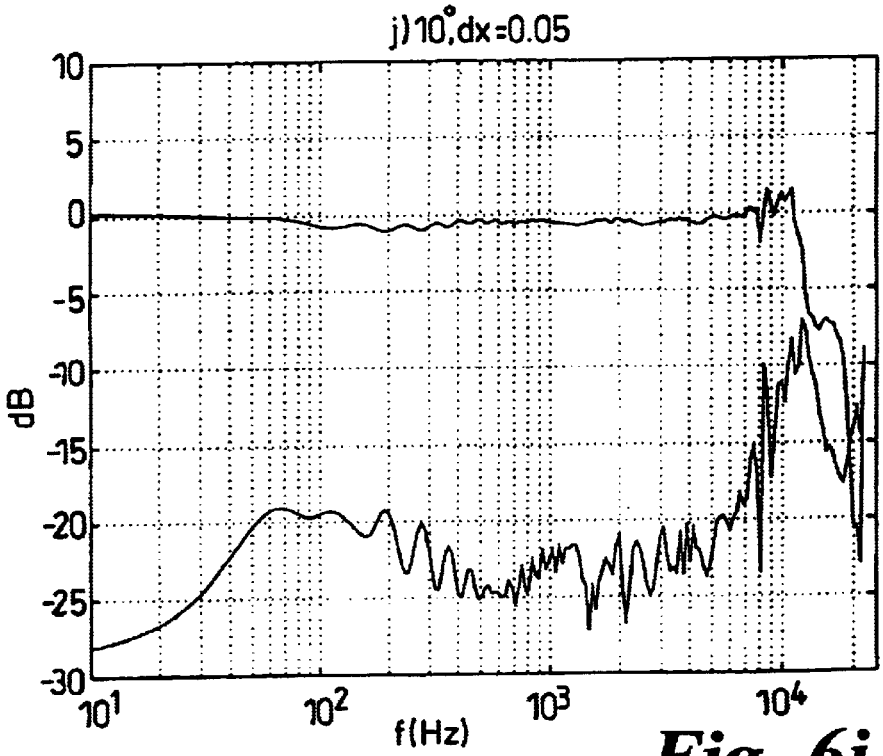
Figure 6K:
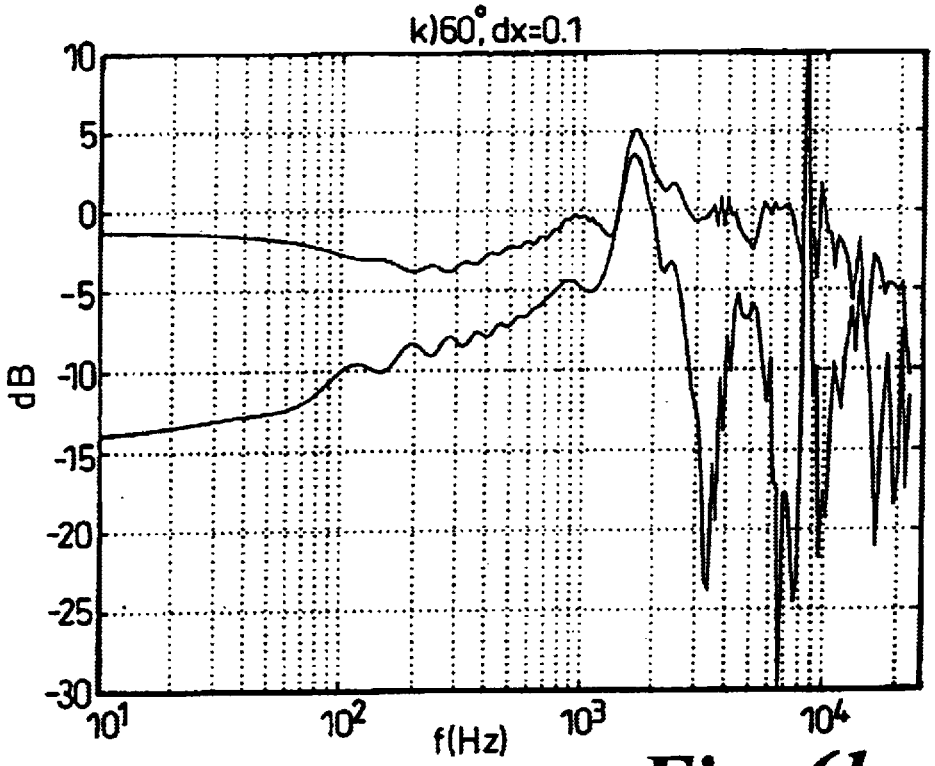
Figure 6L:
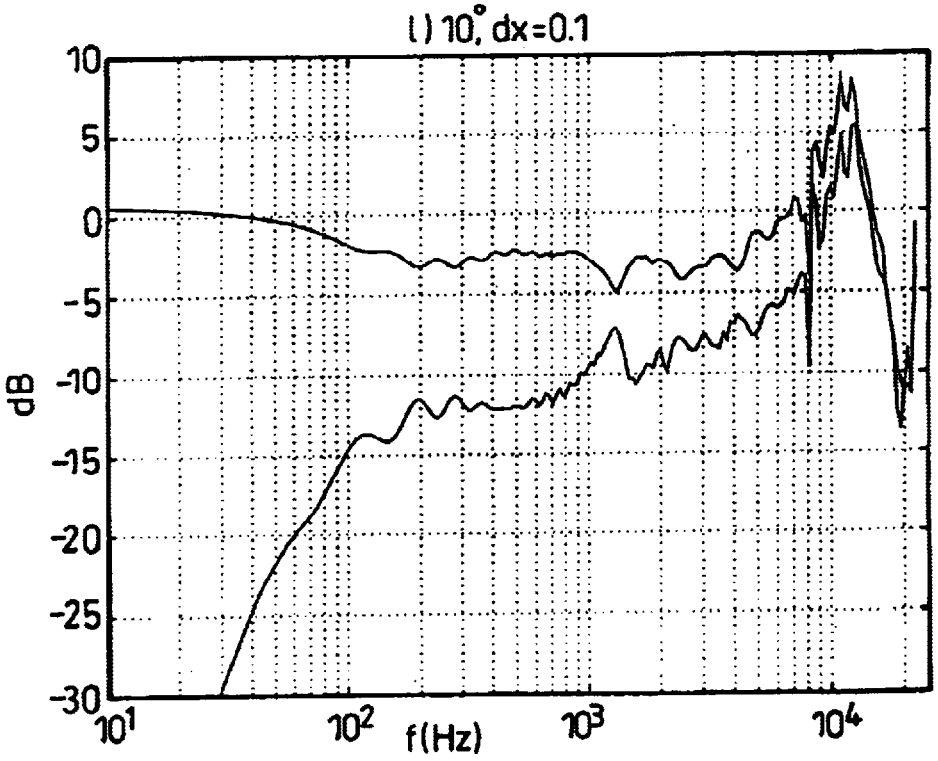
Figure 6M:
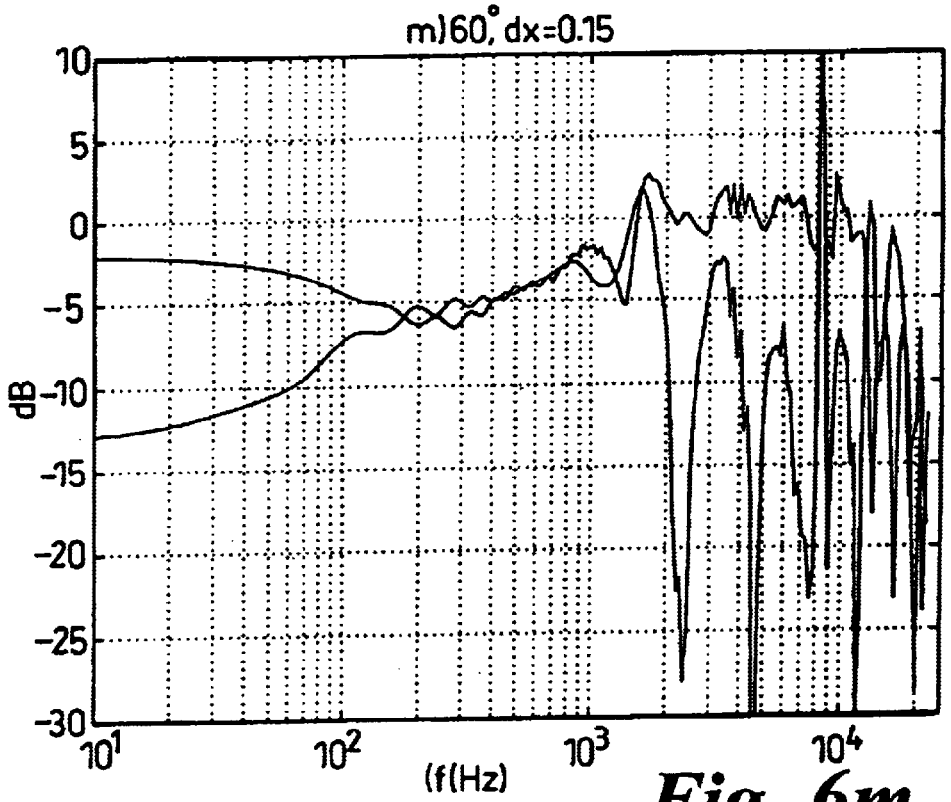
Figure 6N:
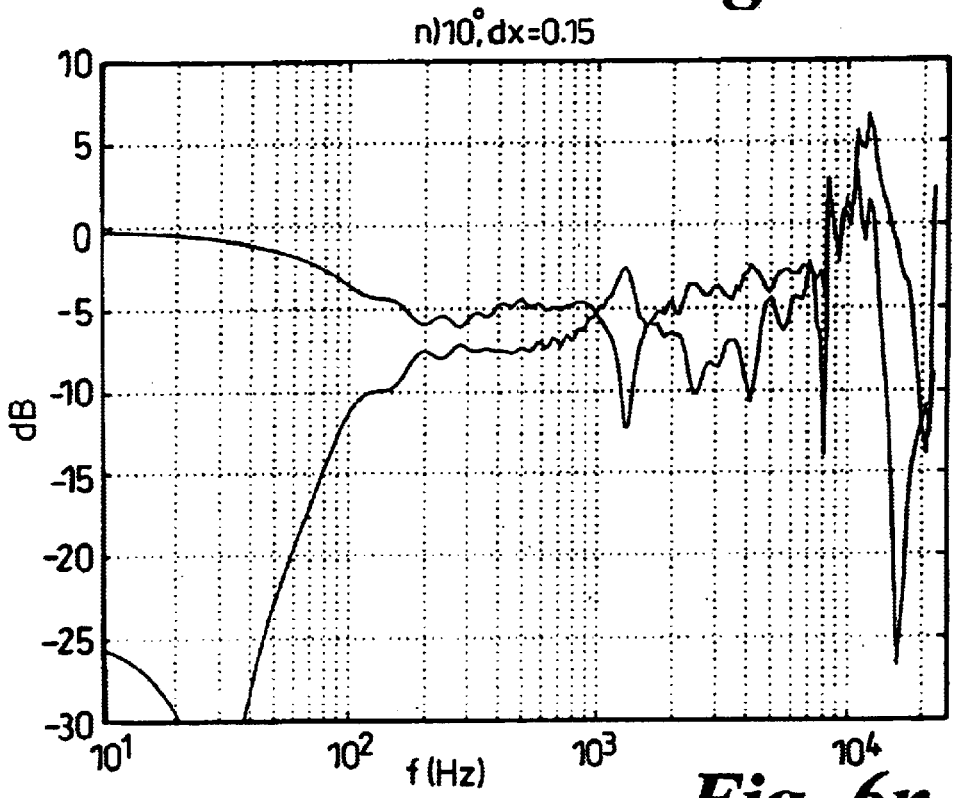

We now assess quantitatively the effectiveness of the cross-talk cancellation as the listener's head is moved by the distance dx to the side. The meaning of the parameter dx is illustrated in FIG. 5. When the desired signal is assumed to be a single impulse at the left ear, and silence at the right ear, the amplitude spectrum corresponding to the signal reproduced at the left ear is ideally 0 dB, and the amplitude spectrum corresponding to the signal reproduced at the right ear is ideally as small as possible. Thus, we can use the signals reproduced at the two ears as a measure of the effectiveness of the cross-talk cancellation as the listener's head is moved away from the intended listening position.

In order to be able to calculate the signals reproduced at the ears of a listener at an arbitrary position, it is necessary to use interpolation. As the position of the listener is changed, the angle θ between the centre of the head and the loudspeakers is changed. This is compensated for by linear interpolation between the two nearest HRTFs in the measured database. For example, if the exact angle is 91°, then the resulting HRTF is found from $$C_{91}(k)=0.8C_{90}(k)+0.2C_{95}(k),$$

where k is the k'th frequency line in the spectrum calculated by an FFT. It is even more difficult to compensate for the change in the distance $r_0$ (FIG. 1) between the loudspeaker and the centre of the listener's head 6. The problem is that the change in distance will usually not correspond to a delay (or advance) of an integer number of sampling intervals, and it is therefore necessary to shift the impulse response of the angle-compensated HRTF by a fractional number of samples. It is not a trivial task to implement a fractional shift of a digital sequence. In this particular case, the technique is accurate to within a distance of less than 1.0 mm. Thus, the fractional delay technique in effect approximates the true ear position by the nearest point on a 1.0 mm×1.0 mm spatial grid.

FIG. 6 shows the amplitude spectra of the reproduced signals for the two loudspeaker separations resulting in θ values of 60° (a,c,e,g,i,k,m) and 10° (b,d,f,h,j,l,n) for the seven different values of dx −15 cm (a,b), −10 cm (c,d), −5 cm (e,f), 0 cm (g,h), 5 cm (i,j), 10 cm (k,l), and 15 cm (m,n). It is seen that when angle θ is 60°, the cross-talk cancellation is efficient only up to about 1 kHz even when the listener's head is moved as little as 5 cm to the side. By contrast, when the angle θ is 10°, the cross-talk cancellation is efficient up to about 4 kHz even when the listener's head is moved 10 cm to the side. Thus, the closer the loudspeakers are together, the more robust is the performance of the system with respect to head movement. It should be pointed out, however, that the cross-talk cancellation case considered in this section can be considered to be a 'worst case'. For example, if a virtual source corresponds to the position of a loudspeaker, the virtual image is obviously very robust. Generally speaking, the system will always perform better in practice when trying to create a virtual image than when trying to achieve a perfect cross-talk cancellation.

It is particularly important to be able to generate convincing centre images. In the film industry, it has long been common to use a separate centre loudspeaker in addition to the left front and right front loudspeakers (plus usually also a number of surround speakers). The most prominent part of the program material is often assigned to this position. This is especially true of dialogue and other types of human voice signals such as vocals on sound tracks. The reason why 60 degrees of θ is the preferred loudspeaker span for conventional stereo reproduction is that if the sound stage is widened further, the centre images tend to be poorly defined. On the other hand, the closer the loudspeakers are together, the more clearly defined are the centre images, and the present invention therefore has the advantage that it creates excellent centre images.

The filter design procedure is based on the assumption that the loudspeakers behave like monopoles in a free field. It is clearly unrealistically optimistic to expect such a performance from a real loudspeaker. Nevertheless, virtual source imaging using the 'stereo dipole' arrangement of the present invention seems to work well in practice even when the loudspeakers are of very poor quality. It is particularly surprising that the system still works when the loudspeakers are not capable of generating any significant low-frequency output, as is the case for many of the small active loudspeakers used for multi-media applications. The single most important factor appears to be the difference between the frequency responses of the two loudspeakers. The system works well as long as the two loudspeakers have similar characteristics, that is, they are 'well matched'. However, significant differences between their responses tend to cause the virtual images to be consistently biased to one side, thus resulting in a 'side-heavy' reproduction of a well-balanced sound stage. The solution to this is to make sure that the two loudspeakers that go into the same cabinet are 'pair-matched'.

Alternatively, two loudspeakers could be made to respond in substantially the same way be including an equalising filter on the input of one of the loudspeakers.

A stereo system according to the present invention is generally very pleasant to listen to even though tests indicate that some listeners need some time to get used to it. The processing adds only insignificant colouration to the original recordings. The main advantage of the close loudspeaker arrangement is its robustness with respect to head movement which makes the 'bubble' that surrounds the listener's head comfortably big.

When ordinary stereo material, as for example pop music or film sound tracks, is played back over two virtual sources created using the present invention, tests show that the listener will often perceive the overall quality of the reproduction to be even better than when the original material is played back over two loudspeakers that span an angle θ of 60°. One reason for this is that the 10 degree loudspeaker span provides excellent centre images, and it is therefore possible to increase the angle θ spanned by the virtual sources from 60 degrees to 90 degrees. This widening of the sound stage is found to be very pleasant.

Reproduction of binaural material over the system of the present invention is so convincing that listeners frequently look away from the speakers to try to see a real source responsible for the perceived sound. Height information in dummy-head recordings can also be conveyed to the listener; the sound of a jet plane passing overhead, for example, is quite realistic.

One possible limitation of the present invention is that it cannot always create convincing virtual images directly to the side of, or behind, the listener. Convincing images can be created reliably only inside an arc spanning approximately 140 degrees in the horizontal plane (plus and minus 70 degrees relative to straight ahead) and approximately 90 degrees in the vertical plane (plus 60 and minus 30 degrees relative to the horizontal plane). Images behind the listener are often mirrored to the front. For example, if one attempts to create a virtual image directly behind the listener, it will be perceived as being directly in front of the listener instead. There is little one can do about this since the physical energy radiated by the loudspeakers will always approach the listener from the front. Of course, if rear images are required, one could place a further system according to the present invention directly behind the listener's head.

In practice, performance requirements vary greatly between applications. For example, one would expect the sound that accompanies a computer game to be a lot worse than that reproduced by a good Hi-fi system. On the other hand, even a poor hi-fi system is likely to be acceptable for a computer game. Clearly, a sound reproduction system cannot be classified as 'good' or 'bad' without considering the application for which it is intended. For this reason, we will give three examples of how to implement a cross-talk cancellation network.

The simplest conceivable cross-talk cancellation network is that suggested by Atal and Shroeder in U.S. Pat. No. 3,236,949, 'Apparent Sound Source Translator'. Even though their patent dealt with a conventional loudspeaker set-up spanning 60°, their principle is applicable to any loudspeaker span. The loudspeakers are supposed to behave like monopoles in a free field, and the z-transforms of the four transfer functions in C(z) are therefore given by $$C(z) = \begin{bmatrix} z^{-n_1}/n_1 & z^{-n_2}/n_2 \\ z^{-n_2}/n_2 & z^{-n_1}/n_1 \end{bmatrix}.$$

where $n_1$ is the number of sampling intervals it takes for the sound to travel from a loudspeaker to the 'nearest' ear, and $n_2$ is the number of sampling intervals it takes for the sound to travel from a loudspeaker to the 'opposite' ear. Both $n_1$ and $n_2$ are assumed to be integers. It is straightforward to invert C(z) directly. Since $n_1<n_2$, the exact inverse is stable and can be implemented with an IIR (infinite impulse response) filter containing a single coefficient. Consequently, it would be very easy to implement in hardware. The quality of the sound reproduced by a system using filters designed this way is very 'unnatural' and 'coloured', though, but it might be good enough for applications such as games.

Very convincing performances can be achieved with a system that uses four FIR filters, each containing only a relatively small number of coefficients. At a sampling frequency of 44.1 kHz, 32 coefficients is enough to give both accurate localisation and a natural uncoloured sound when using transfer functions taken from the compact MIT database of HRTFs. Since the duration of those transfer functions (128 coefficients) are significantly longer than the inverse filters themselves (32 coefficients), the inverse filters must be calculated by a direct matrix inversion of the problem formulated in the time domain as disclosed in European patent no. 0434691 (the technique described therein is referred to as a 'deterministic least squares method of inversion'). However, the price one has to pay for using short inverse filters is a reduced efficiency of the cross-talk cancellation at low frequencies (f<500 Hz). Nevertheless, for applications such as multi-media computers, most of the loudspeakers that are currently on the market are not capable of generating any significant output at those frequencies anyway, and so a set of short filters ought to be adequate for such purposes.

In order to be able to reproduce very accurately the desired signals at the ears of the listener at low frequencies, it is necessary to use inverse filters containing many coefficients. Ideally, each filter should contain at least 1024 coefficients (alternatively, this might be achieved by using a short IIR filter in combination with an FIR filter). Long inverse filters are most conveniently calculated by using a frequency domain method such as the one disclosed in PCT/GB95/02005. To the best of our knowledge, there is currently no digital signal processing system commercially available that can implement such a system in real time. Such a system could be used for a domestic hi-end 'hi-fi' system or home theatre, or it could be used as a 'master' system which encodes broadcasts or recordings before further transmission or storage.

Further explanation of the problem, and the manner whereby it is solved by the present invention, is as follows, with reference to FIGS. 7 to 13. These figures are concerned with the virtual source imaging problem when it is simplified by assuming that the loudspeakers are point monopole sources and that the head of the listener does not modify the incident sound waves.

Figure 7:
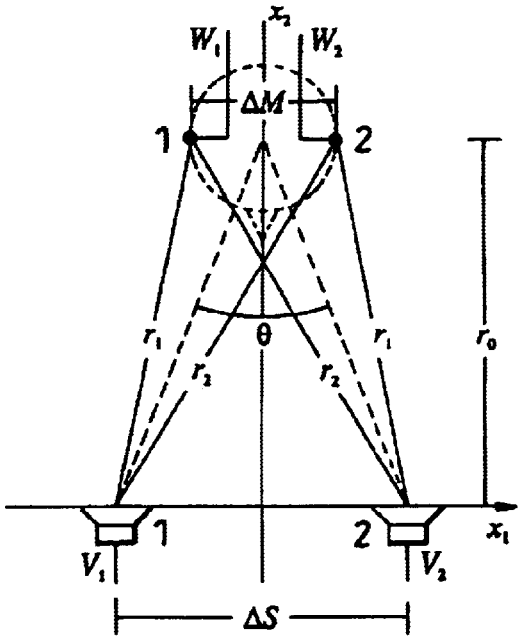
FIG. 7 illustrates the geometry of the loudspeaker-microphone arrangement. Note that θ is the angle spanned by the loudspeakers as seen from the centre of the listener's head, and that $r_0$ is the distance from this point to the centre between the loudspeakers.

The geometry of the problem is shown in FIG. 7. Two loudspeakers (sources), separated by the distance ΔS, are positioned on the $x_1$-axis symmetrically about the $x_2$-axis. We imagine that a listener is positioned $r_0$ meters away from the loudspeakers directly in front them. The ears of the listener are represented by two microphones, separated by the distance ΔM, that are also positioned symmetrically about the $x_2$-axis (note that 'right ear' refers to the left microphone, and 'left ear' refers to the right microphone). The loudspeakers span an angle of θ as seen from the position of the listener. Only two of the four distances from the loudspeakers to the microphones are different; $r_1$ is the shortest (the 'direct' path), $r_2$ is the furthest (the 'cross-talk' path). The inputs to the left and right loudspeaker are denoted by $V_1$ and $V_2$ respectively, the outputs from the left and right microphone are denoted by $W_1$ and $W_2$ respectively. It will later prove convenient to introduce the two variables $$g = \frac{r_1}{r_2},$$

which is a 'gain' that is always smaller than one, and $$\tau = \frac{r_2 - r_1}{c_0},$$

which is a positive delay corresponding to the time it takes the sound to travel the path length difference $r_2-r_1$.

When the system is operating at a single frequency, we can use complex notation to describe the inputs to the loudspeakers and the outputs from the microphones. Thus, we assume that $V_1$, $V_2$, $W_1$, and $W_2$ are complex scalars. The loudspeaker inputs and the microphone outputs are related through the two transfer functions $$C_1 = \frac{W_1}{V_1} = \frac{W_1}{V_2},$$

and $$C_2 = \frac{W_1}{V_2} = \frac{W_2}{V_1}.$$

Using these two transfer functions, the output from the microphones as a function of the inputs to the loudspeakers is conveniently expressed as a matrix-vector multiplication, $$w = Cv,$$

where $$w = \begin{bmatrix} W_1 \\ W_2 \end{bmatrix}, C = \begin{bmatrix} C_1 & C_2 \\ C_2 & C_1 \end{bmatrix}, v = \begin{bmatrix} V_1 \\ V_2 \end{bmatrix}.$$

The sound field $p_{mo}$ radiated from a monopole in a free-field is given by $$p_{mo} = j\omega\rho_0 q \frac{\exp(-jkr)}{4\pi r},$$

where ω is the angular frequency, $\rho_0$ is the density of the medium, q is the source strength, k is the wavenumber $\omega/c_0$ where $c_0$ is the speed of sound, and r is the distance from the source to the field point. If V is defined as $$V = \frac{j\omega\rho_0 q}{4\pi},$$

then the transfer function C is given by $$C = \frac{p_{mo}}{V} = \frac{\exp(-jkr)}{r}.$$

The aim of the system shown in FIG. 7 is to reproduce a pair of desired signals $D_1$ and $D_2$ at the microphones. Consequently, we require $W_1$ to be equal to $D_1$, and $W_2$ to be equal to $D_2$. The pair of desired signals can be specified with two fundamentally different objectives in mind: cross-talk cancellation or virtual source imaging. In both cases, two linear filters. $H_1$ and $H_2$ operate on a single input D, and so $$v = Dh,$$

where $$h = \begin{bmatrix} H_1 \\ H_2 \end{bmatrix}.$$

Figure 8A:
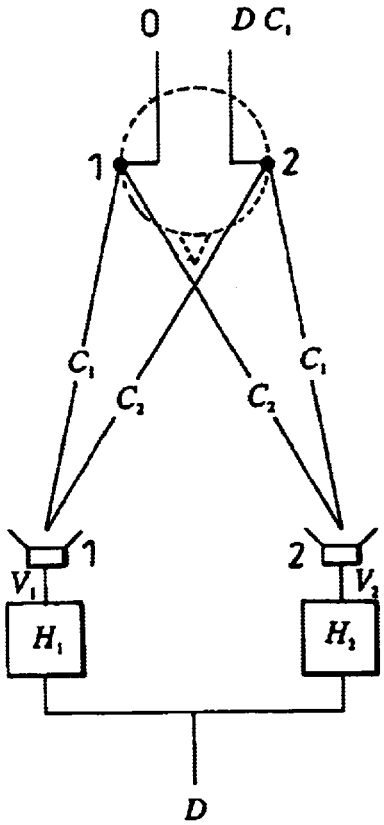
FIGS. 8*a* and 8*b* illustrate definitions of the transfer functions, signals and filters necessary for a) cross-talk cancellation and b) virtual source imaging.
Figure 8B:
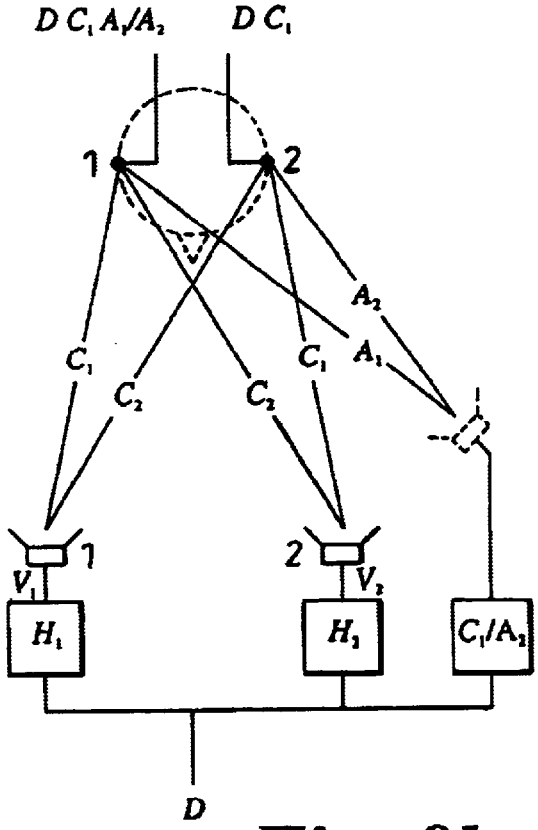

This is illustrated in FIGS. 8*a* and 8*b*. Perfect cross-talk cancellation (FIG. 8*a*) requires that a signal is reproduced perfectly at one ear of the listener while nothing is heard at the other ear. So if we want to produce a desired signal $D_2$ at the listener's left ear, then $D_1$ must be zero. Virtual source imaging (FIG. 8*b*), on the other hand, requires that the signals reproduced at the ears of the listener are identical (up to a common delay and a common scaling factor) to the signals that would have been produced at those positions by a real source.

It is advantageous to define $D_2$ to be the product D times $C_1$ rather than just D since this guarantees that the time responses corresponding to the frequency response functions $V_1$ and $V_2$ are causal (in the time domain, this causes the desired signal to be delayed and scaled, but it does not affect its 'shape'). By solving the linear equation system $$Cv = \begin{bmatrix} 0 \\ D\,C_1 \end{bmatrix},$$

for v, we find $$v = D\frac{1}{1 - g^2\exp(-j2\omega\tau)}\begin{bmatrix} -g\exp(-j\omega\tau) \\ 1 \end{bmatrix}.$$

In order to find the time response of v, we rewrite the term $1/(1-g^2\exp-j2\omega\tau))$ using the power series expansion.

$$\frac{1}{1-z} = \sum_{n=0}^{\infty} z^n = 1 + z + z^2 + \ldots,\ |z| < 1.$$

The result is $$v = D\begin{bmatrix} -g\exp(-j\omega\tau) \\ 1 \end{bmatrix}\sum_{n=0}^{\infty} g^{2n}\exp(-j2n\omega\tau).$$

Figure 9A:
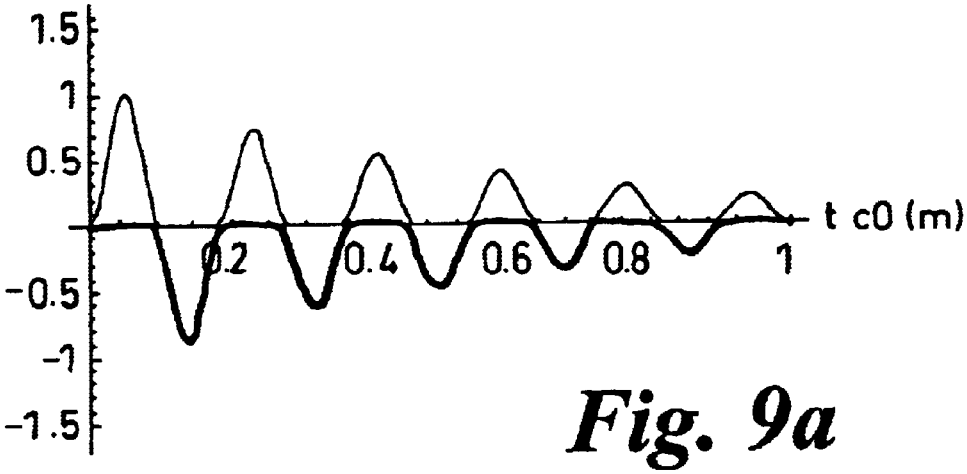
FIGS. 9*a*, 9*b* and 9*c* illustrate the time response of the two source input signals (thick line, $v_1(t)$, thin line, $V_2(t)$) required to achieve perfect cross-talk cancellation at the listener's right ear for the three loudspeaker spans θ of 60° (a), 200 (b), and 10° (c). Note how the overlap increases as θ decreases.
Figure 9B:
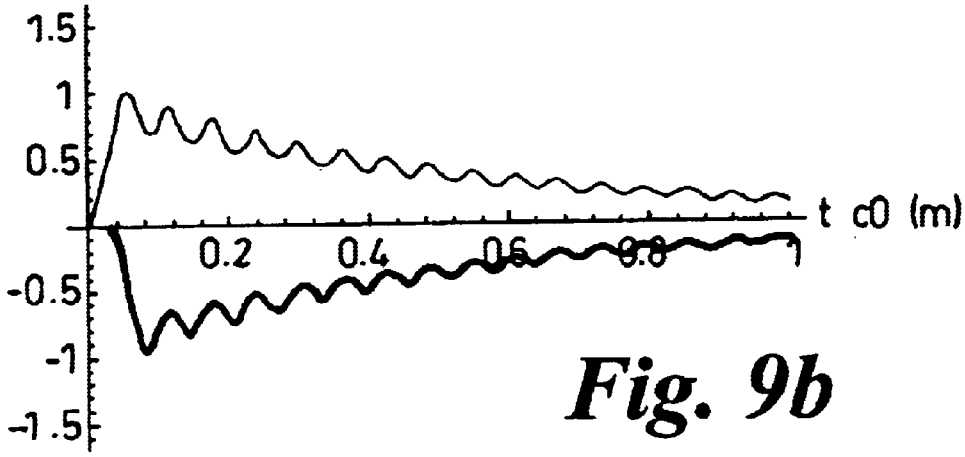
Figure 9C:
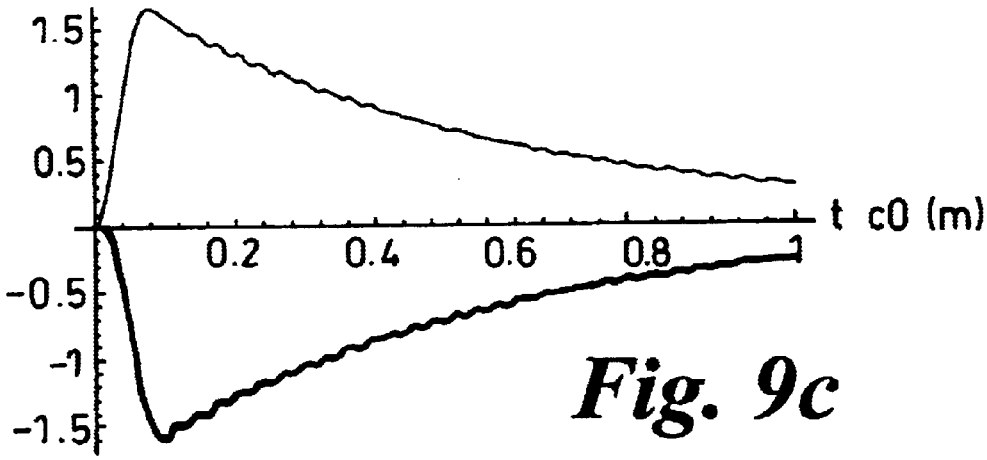

After an inverse Fourier transform of v, we can now write v as a function of time, $$v(t) = \begin{bmatrix} -g\,D(t-\tau) \\ D(t) \end{bmatrix} * \sum_{n=0}^{\infty} g^{2n}\delta(t - 2n\tau),$$

where * denotes convolution and δ is the dirac delta function. The summation represents a decaying train of delta functions. The first delta function occurs at time t=0, and adjacent delta functions are 2τ apart. Consequently, as recognised by Atal et al, v(t) is intrinsically recursive, but even so it is guaranteed to be both causal and stable as long as D(t) is causal and stable. The solution is readily interpreted physically in the case where D(t) is a pulse of very short duration (more specifically, much shorter than τ). First, the right loudspeaker sends out a pulse which is heard at the listener's left ear. At time τ after reaching the left ear, this pulse reaches the listener's right ear where it is not intended to be heard, and consequently, it must be cancelled out by a negative pulse from the left loudspeaker. This negative pulse reaches the listener's right ear at time 2τ after the arrival of the first positive pulse, and so another positive pulse from the right loudspeaker is necessary, which in turn will create yet another unwanted negative pulse at the listener's left ear, and so on. The net result is that the right loudspeaker will emit a series of positive pulses whereas the left loudspeaker will emit a series of negative pulses. In each pulse train, the individual pulses are emitted with a 'ringing' frequency $f_0$ of 1/2τ. It is intuitively obvious that if the duration of D(t) is not short compared to τ, the individual pulses can no longer be perfectly separated, but must somehow 'overlap'. This is illustrated in FIGS. 9*a*, 9*b* and 9*c*, which show the time history of the source outputs deemed necessary to achieve the desired objective when the angle θ defining the loudspeaker separation is 60°, 20° and 10° respectively. Note that for θ=10°, the source outputs are very nearly opposite.

The Source Inputs

FIGS. 9*a*, 9*b* and 9*c* show the input to the two sources for the three different loudspeaker spans 60° (FIG. 9*a*), 20° (FIG. 9*b*), and 10° (FIG. 9*c*). The distance to the listener is 0.5 m, and the microphone separation (head diameter) is 18 cm. The desired signal is a Hanning pulse (one period of a cosine) specified by $$D(t) = \begin{cases} (1 - \cos\omega_0 t)/2, & 0 \le t \le 2\pi/\omega_0 \\ 0 & \text{all other } t \end{cases}$$

where $\omega_0$ is chosen to be 2π times 3.2 kHz (the spectrum of this pulse has its first zero at 6.4 kHz, and so most of its energy is concentrated below 3 kHz). For the three loudspeaker spans 60°, 20°, and 10°, the corresponding ringing frequencies $f_0$ are 1.9 kHz, 5.5 kHz, and, 11 kHz respectively. If the listener does not sit too close to the sources, τ is well approximated by assuming that the direct path and the cross-talk path are parallel lines, $$\tau \approx \frac{\Delta M}{c_0}\sin(\theta/2).$$

If in addition we assume that the loudspeaker span is small, then sin(θ/2) can be simplified to θ/2, and so $f_0$ is well approximated by $$f_0 \approx \frac{c_0}{\Delta M}\frac{1}{\theta}.$$

For the three loudspeaker spans 60°, 20°, and 10°, this approximation gives the three values 1.8 kHz, 5.4 kHz, and 10.8 kHz of $f_0$ (rule of thumb: $f_0$=100 kHz divided by loudspeaker span in degrees) which are in good agreement with the exact values. It is seen that $f_0$ tends to infinity as θ tends to zero, and so in principle it is possible to make $f_0$ arbitrarily large. In practice, however, physical constraints inevitably imposes an upper bound on $f_0$. It can be shown that the in limiting case is as θ tends to zero, she sound field generated by the two point sources is equivalent to that of a point monopole and a point dipole, both positioned at the origin of the co-ordinate system.

It is clear from FIGS. 9*a*, 9*b* and 9*c* that as $f_0$ increases, the overlap between adjacent pulses also increases. This evidently makes $v_1(t)$ and $v_2(t)$ smoother, and it is intuitively obvious that if $f_0$ is very large, the ringing frequency is suppressed almost completely, and both $v_1(t)$ and $v_2(t)$ will be simple decaying exponentials (decaying in the sense that they both return to zero for large t). However, it is also intuitively obvious that by increasing $f_0$, the low-frequency content of v is also increased. Consequently, in order to achieve perfect cross-talk cancellation with a pair of closely spaced loudspeakers, a very large low-frequency output is necessary. This happens because the cross-talk cancellation problem is ill-conditioned at low frequencies. This undesirable property is caused by the underlying physics of the problem, and it cannot be ignored when it comes to implementing cross-talk cancellation systems in practice.

Figure 10A:
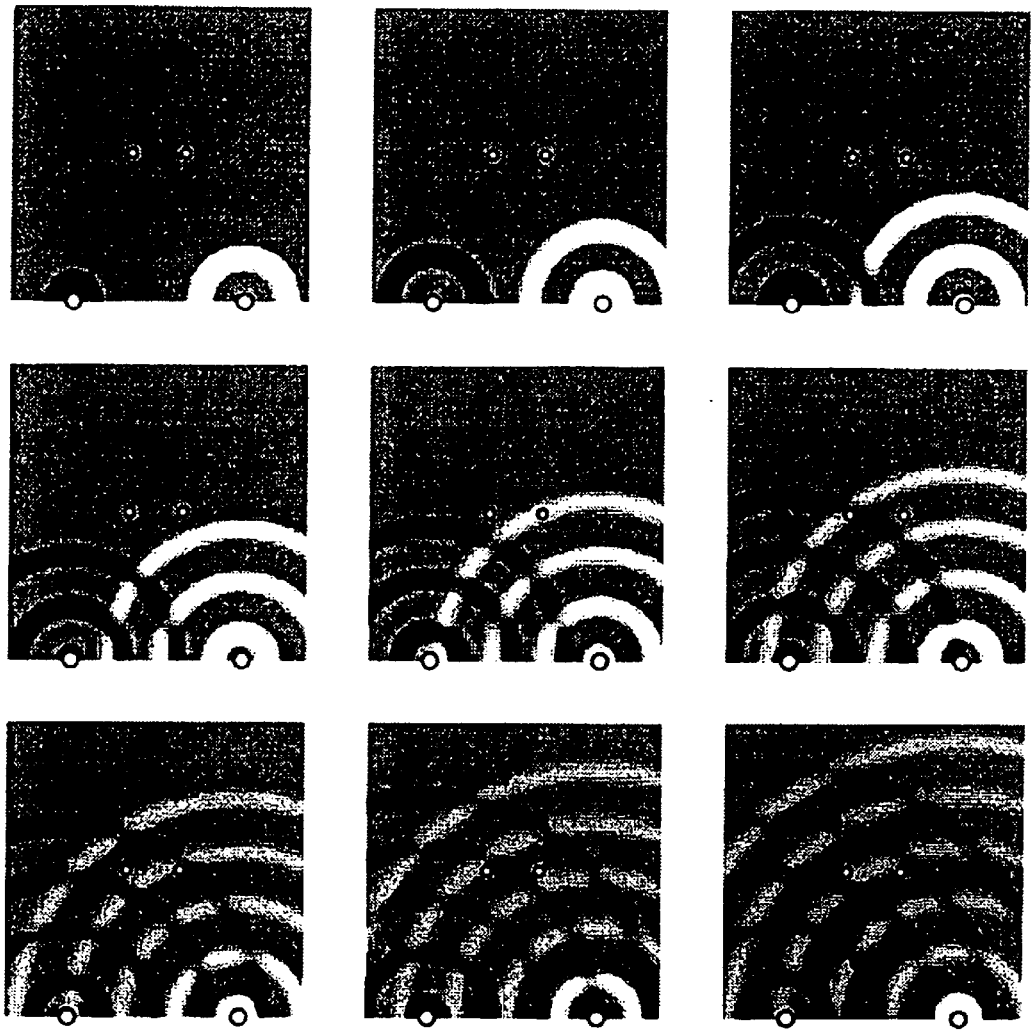
FIGS. 10*a*, 10*b*, 10*c* and 10*d* illustrate the sound field reproduced by four different source configurations adjusted to achieve perfect cross-talk cancellation at the listener's right ear at (a) θ=60°, (b) θ=20°, (c) θ=10°, and (d) for a monopole-dipole combination.
Figure 10B:
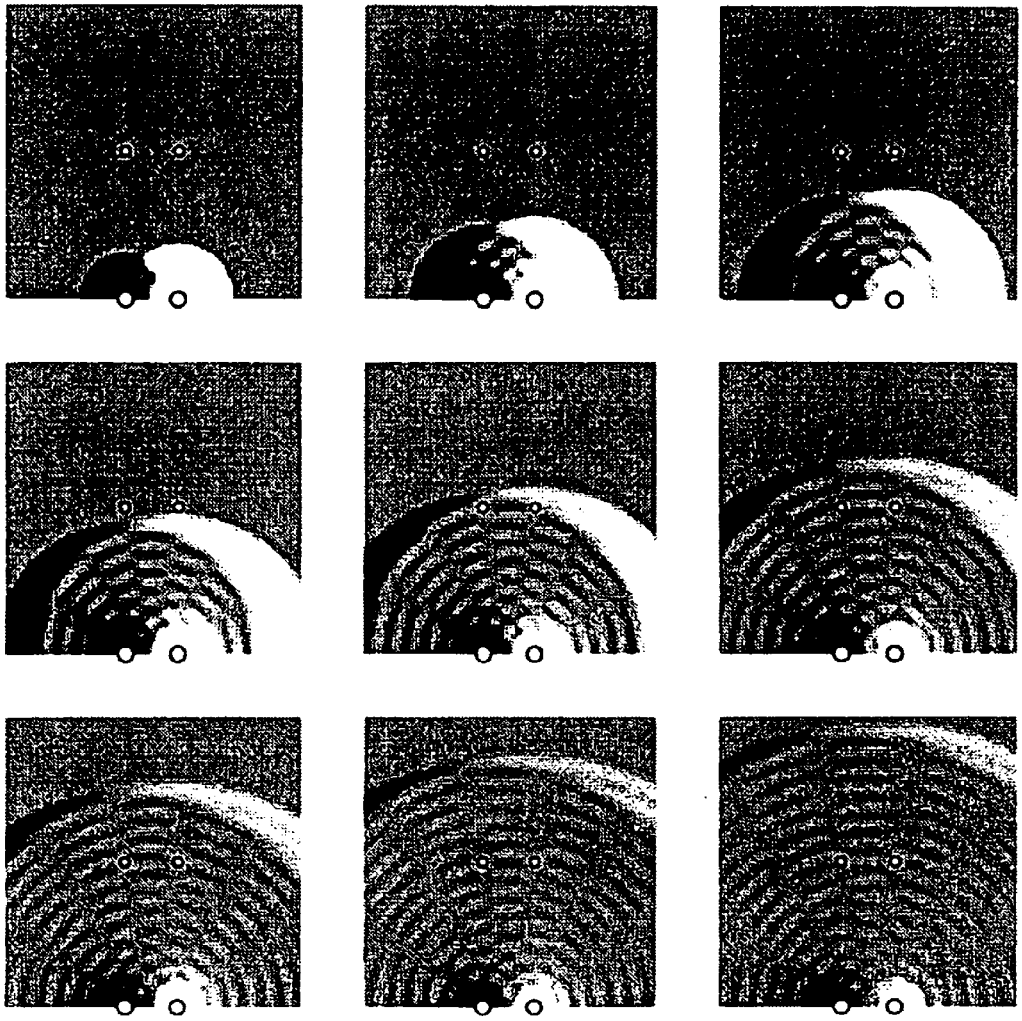
Figure 10C:
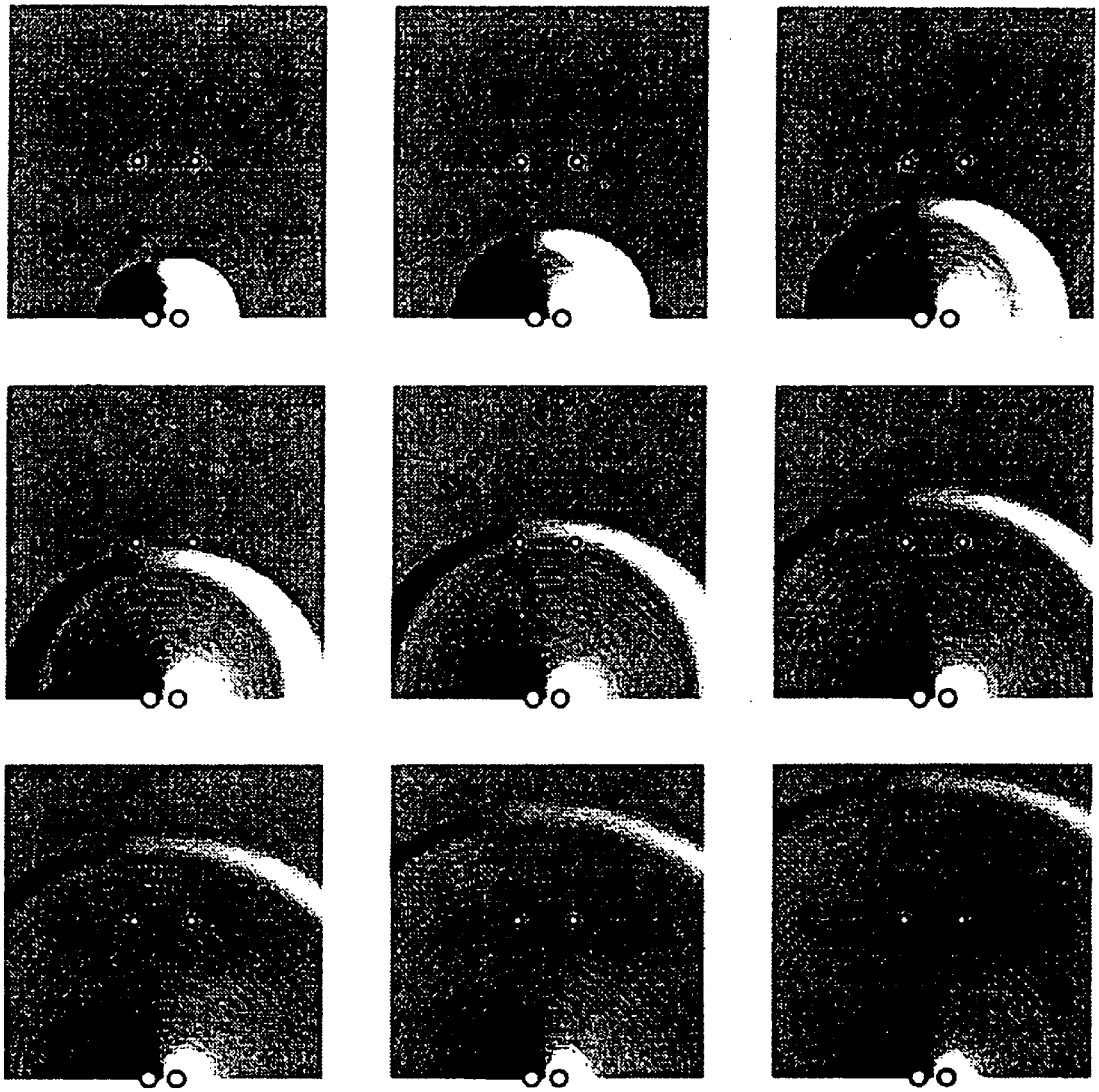
Figure 10D:
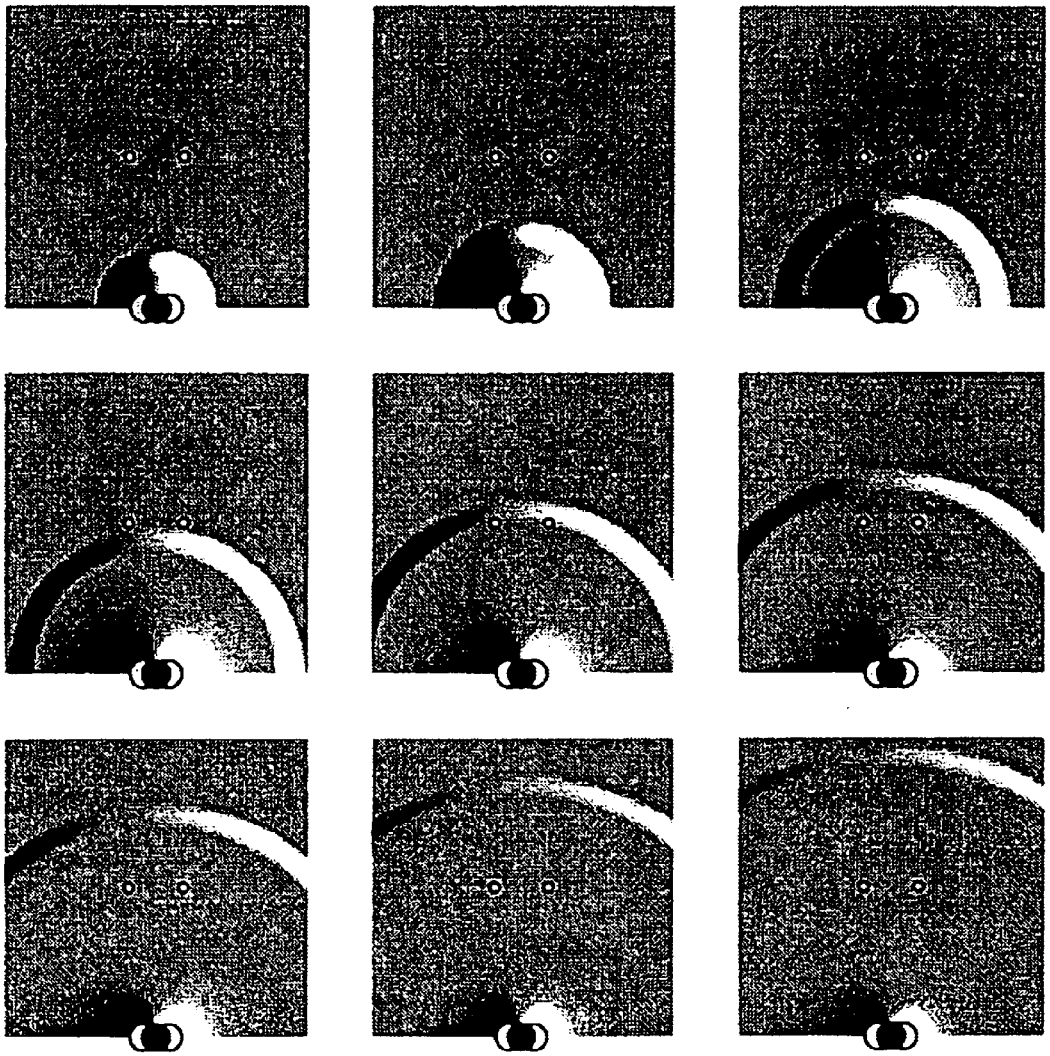

FIGS. 10*a*, 10*b*, 10*c* and 10*d* show the sound field reproduced by four different source configurations: the three loudspeaker spans 60° (FIG. 10*a*), 20° (FIG. 10*b*), 10° (FIG. 10*c*), and also the sound field generated by a superposition of a point monopole source and a point dipole source (FIG. 10*d*). The sound fields plotted in FIGS. 10*a*, 10*b*, 10*c* are those generated by the source inputs plotted in FIGS. 9*a*, 9*b* and 9*c*. Each of the four plots of FIGS. 10*a* etc contain nine 'snapshots', or frames, of the sound field. The frames are listed sequentially in a 'reading sequence' from top left to bottom right; top left is the earliest time ($t=0.2/c_0$), bottom right is the latest time ($t=1.0/c_0$). The time increment between each frame is $0.1/c_0$ which is equivalent to the time it takes the sound to travel 10 cm. The normalisation of the desired signals ensures that the right loudspeaker starts emitting sound at exactly t=0; the left loudspeaker starts emitting sound a short while ($\tau$) later. Each frame is calculated at 101×101 points over an area of 1 m×1 m ($-0.5$ m$<x_1<0.5$ m, $0<x_2<1$). The positions of the loudspeakers and the microphones are indicated by circles. Values greater than 1 are plotted as white, values smaller than −1 are plotted as black, values between −1 and 1 are shaded appropriately.

FIG. 10*a* illustrates the cross-talk cancellation principle when $\theta$ is 60°. It is easy to identify a sequence of positive pulses from the right loudspeaker, and a sequence of negative pulses from the left loudspeaker. Both pulse trains are emitted with the ringing frequency 1.9 kHz. Only the first pulse emitted from the right loudspeaker is actually 'seen' by the right microphone; consecutive pulses are cancelled out both at the left and right microphone. However, many 'copies' of the original Hanning pulse are seen at other locations in the sound field, even very close to the two microphones, and so this set-up is not very robust with respect to head movement.

When the loudspeaker span is reduced to 20° (FIG. 10*b*), the reproduced sound field becomes simpler. The desired Hanning pulse is now 'beamed' towards the right microphone, and a similar 'line of cross-talk cancellation' extends through the position of the left microphone. The ringing frequency is now present as a ripple behind the main wavefront.

When the loudspeaker span is reduced even further to 10° (FIG. 10*c*), the effect of the ringing frequency is almost completely eliminated, and so the only disturbance seen at most locations in the sound field is a single attenuated and delayed copy of the original Hanning pulse. This indicates that reducing the loudspeaker span improves the system's robustness with respect to head movement. Note, however, that very close to the two monopole sources, the large low-frequency output starts to show up as a near-field effect.

FIG. 10*d* shows the sound field reproduced by a superposition of point monopole and point-dipole sources. This source combination avoids ringing completely, and so the reproduced field is very 'clean'. In the case of the two monopoles spanning 10°, it also contains a near-field component as expected. Note the similarity between the plots in FIGS. 10*c* and 10*d*. This means that moving the loudspeakers even closer together will not make any difference to the reproduced sound field.

In conclusion, the reproduced sound field will be similar to that produced by a point monopole-dipole combination as long as the highest frequency component in the desired signal is significantly smaller than the ringing frequency $f_0$. The ringing frequency can be increased by reducing the loudspeaker span $\theta$, but if $\theta$ is too small, a very large output from the loudspeakers is necessary in order to achieve accurate cross-talk cancellation at low frequencies. In practice, a loudspeaker span of 10° is a good compromise.

Note that as $\theta$ is reduced towards zero, the solution for the sound field necessary to achieve the desired objective can be shown to be precisely that due to a combination of point monopole and point dipole sources.

Figure 11A:
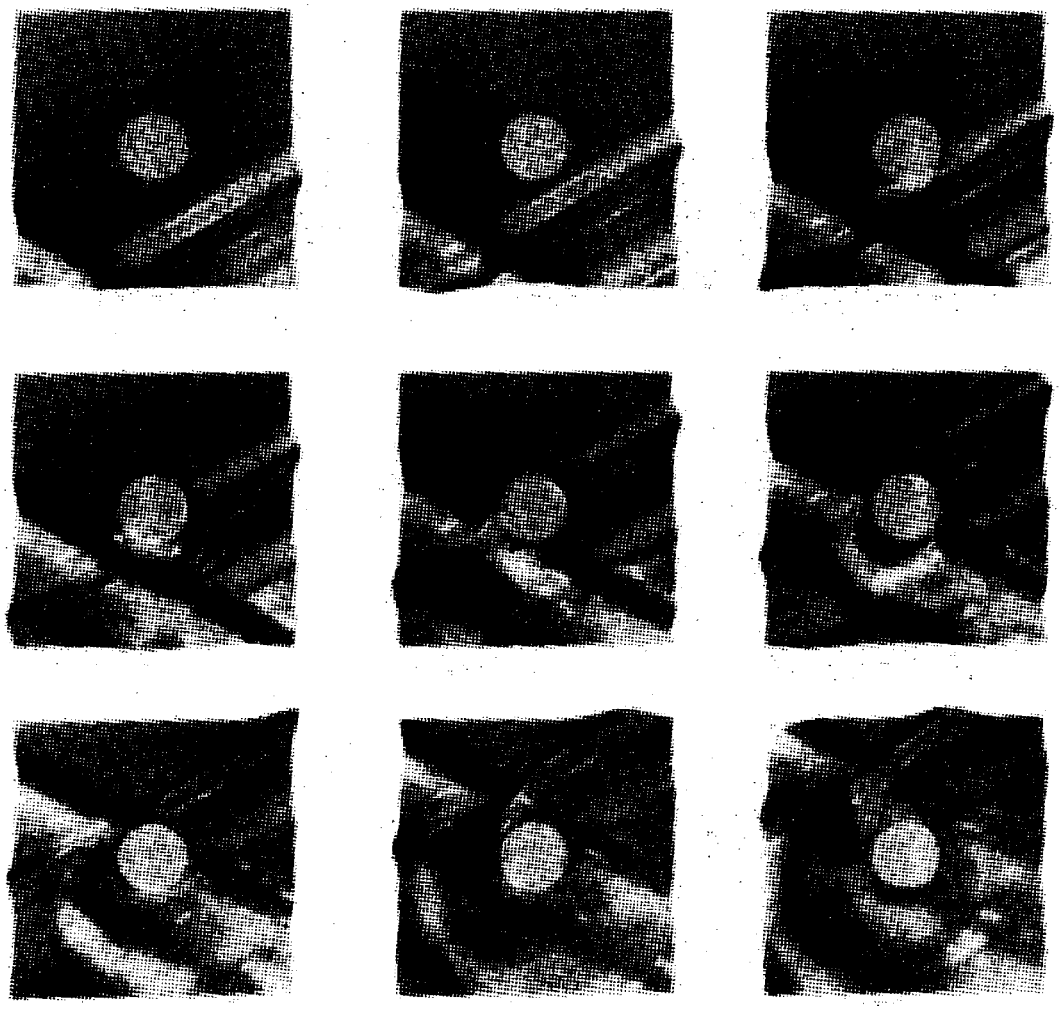
FIGS. 11*a* and 11*b* illustrate the sound fields reproduced by a cross-talk cancellation system that also compensates for the influence of the listener's head on the incident sound waves. The loudspeaker span is 60°.
Figure 11B:
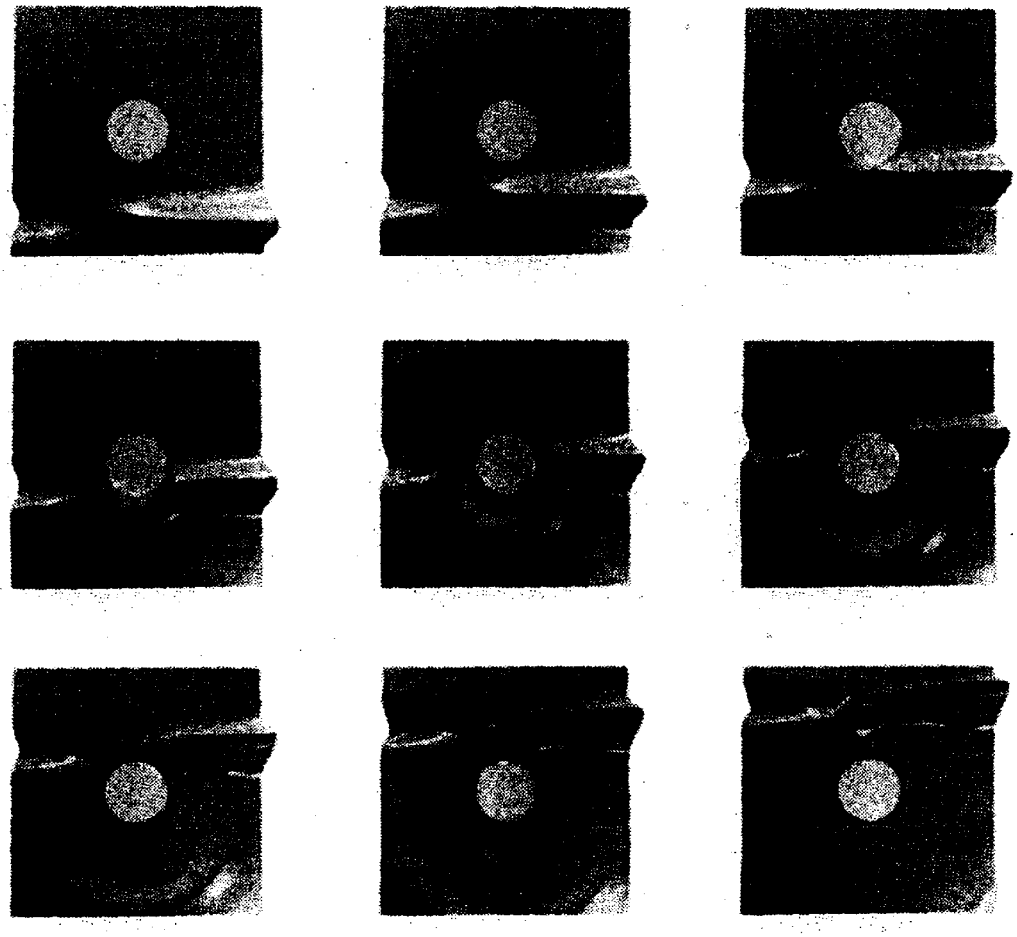

In practice, the head of the listener will modify the incident sound field, especially at high frequencies, but even so the spatial properties of the reproduced sound field at low frequencies essentially remain the same as described above. This is illustrated in FIGS. 11*a* and 11*b* which are equivalent to FIGS. 10*a* and 10*c* respectively. FIGS. 11*a* and 11*b* illustrate the sound field that is reproduced in the vicinity of a rigid sphere by a pair of loudspeakers whose inputs are adjusted to achieve perfect cross-talk cancellation at the 'listener's' right ear. The analysis used to calculate the scattered sound field assumes that the incident wavefronts are plane. This is equivalent to assuming that the two loudspeakers are very far away. The diameter of the sphere is 18 cm, and the reproduced sound field is calculated at 31×31 points over a 60 cm×60 cm square. The desired signal is the same as that used for the free-field example; it is a Hanning pulse whose main energy is concentrated below 3 kHz. FIG. 11*a* is concerned with a loudspeaker span of 60°, whereas FIG. 11*b* is concerned with a loudspeaker span of 10°. In order to calculate these results, a digital filter design procedure of the type described below was employed.

It is in principle a straightforward task to create a virtual source once it is known how to calculate a cross-talk cancellation system. The cross-talk cancellation problem for each ear, is solved and then the two solutions are added together. In practice it is far easier for the loudspeakers to create the signals due to a virtual source than to achieve perfect cross-talk cancellation at one point.

Figure 12A:
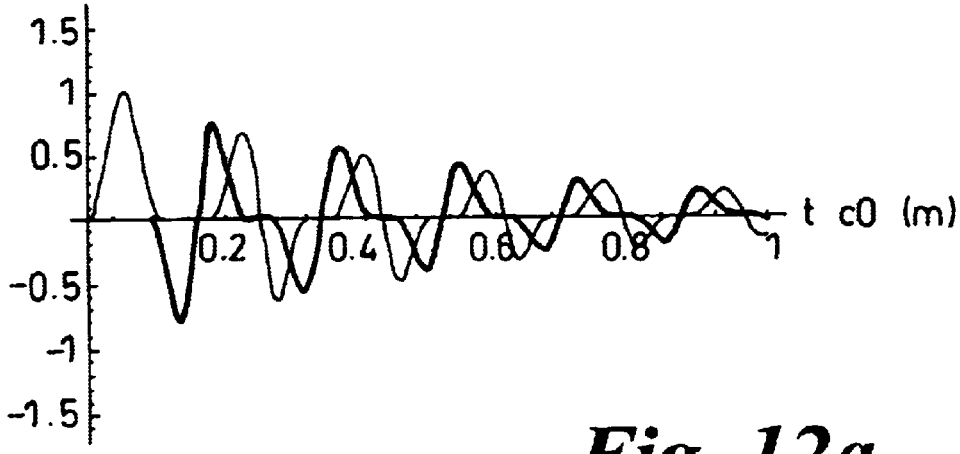
Figure 12B:
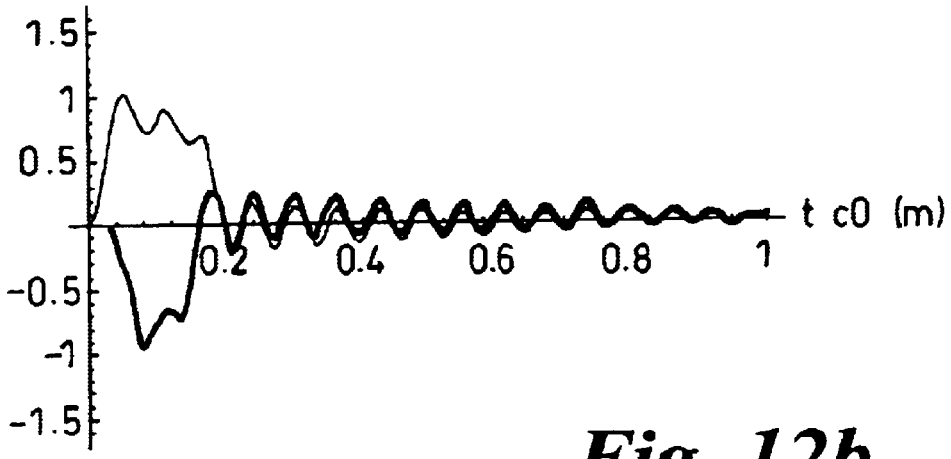
Figure 12C:
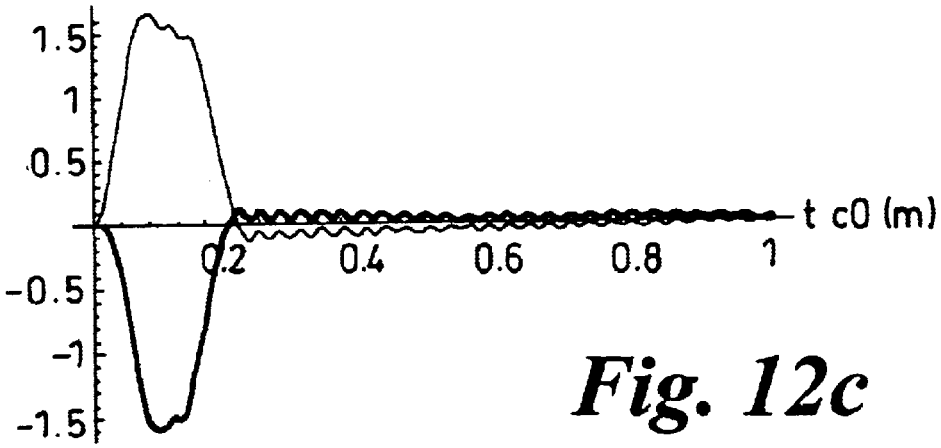

The virtual source imaging problem is illustrated in FIG. 8*a*. We imagine that a monopole source is positioned somewhere in the listening space. The transfer functions from this source to the listener's ears are of the same type as $C_1$ and $C_2$, and they are denoted by $A_1$ and $A_2$. As in the cross-talk cancellation case, it is convenient to normalise the desired signals in order to ensure causality of the source inputs. The desired signals are therefore defined as $D_1=DC_1A_1/A_2$ and $D_2=DC_1$. Note that this definition assumes that the virtual source is in the right half plane (at a position for which $x_1>0$). As in the cross-talk cancellation case, the source inputs can be calculated by solving Cv=d for v, and the time domain responses can then be determined by taking the inverse Fourier transform. The result is that each source input is now the convolution of D with the sum of two decaying trains of delta functions, one positive and one negative. This is not surprising since the sources have to reproduce two positive pulses rather than just one. Thus, the 'positive part' of $v_1(t)$ combined with the 'negative part' of $v_2(t)$ produces the pulse at the listener's left ear whereas the 'negative part' of $v_1(t)$ combined with the 'positive part' of $v_2(t)$ produces the pulse at the listener's right ear. This is illustrated in FIGS. 12*a*, 12*b* and 12*c*. Note again that when $\theta$=10°, the two source inputs are very nearly equal and opposite.

The Source Inputs

FIG. 11*a* etc show the source inputs equivalent to those plotted in FIG. 9*a* etc (three different loudspeaker spans $\theta$: 60°, 20°, and 10°), but for a virtual source imaging system rather than a cross-talk cancellation system. The virtual source is positioned at (1 m,0 m) which means that it is at an angle of 45° to the left relative to straight front as seen by the listener. When $\theta$ is 60° (FIG. 12*a*), both the positive and the negative pulse trains can be seen clearly in $v_1(t)$ and $v_2(t)$. As $\theta$ is reduced to 20° (FIG. 12*b*), the positive and negative pulse trains start to cancel out. This is even more evident when $\theta$ is 10° (FIG. 12*c*). In this case the two source inputs look roughly like square pulses of relatively short duration (this duration is given by the difference in arrival time at the microphones of a pulse emitted from the virtual source). The advantage of the cancelling of the positive and negative parts of the pulse trains is that it greatly reduces the low-frequency content of the source inputs, and this is why virtual source imaging systems in practice are much easier to implement than cross-talk cancellation systems.

The Reproduced Sound Field

FIGS. 13*a*, 13*b*, 13*c* and 13*d* show another four sets of nine 'snapshots' of the reproduced sound field which are equivalent to those shown by FIG. 10*a* etc, but for a virtual source at (1 m,0 m) (indicated in the bottom right hand corner of each frame) rather than for a cross-talk cancellation system. As in FIG. 10*a* etc, the plots show how the reproduced sound field becomes simpler as the loudspeaker span is reduced. In the limit (FIG. 13*d*), there is no ringing and only the two pulses corresponding to the desired signals are seen in the sound field.

Figure 13A:
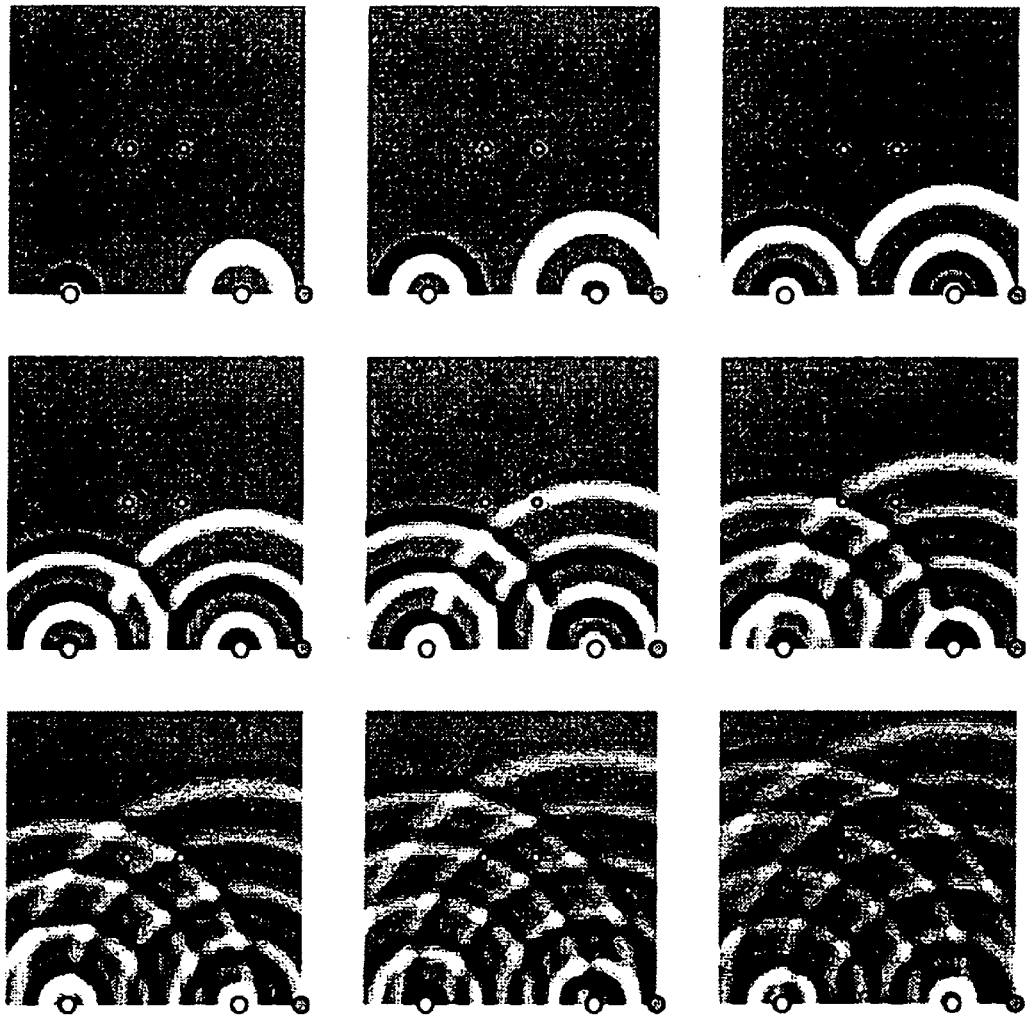
FIGS. 13*a*, 13*b*, 13*c* and 13*d* illustrate the sound fields reproduced at four different source configurations adjusted to create a virtual source at the position (1 m,0 m). (a) θ=60°, (b) θ=20°, (c) θ=10° (d) monopole-dipole combination.
Figure 13B:
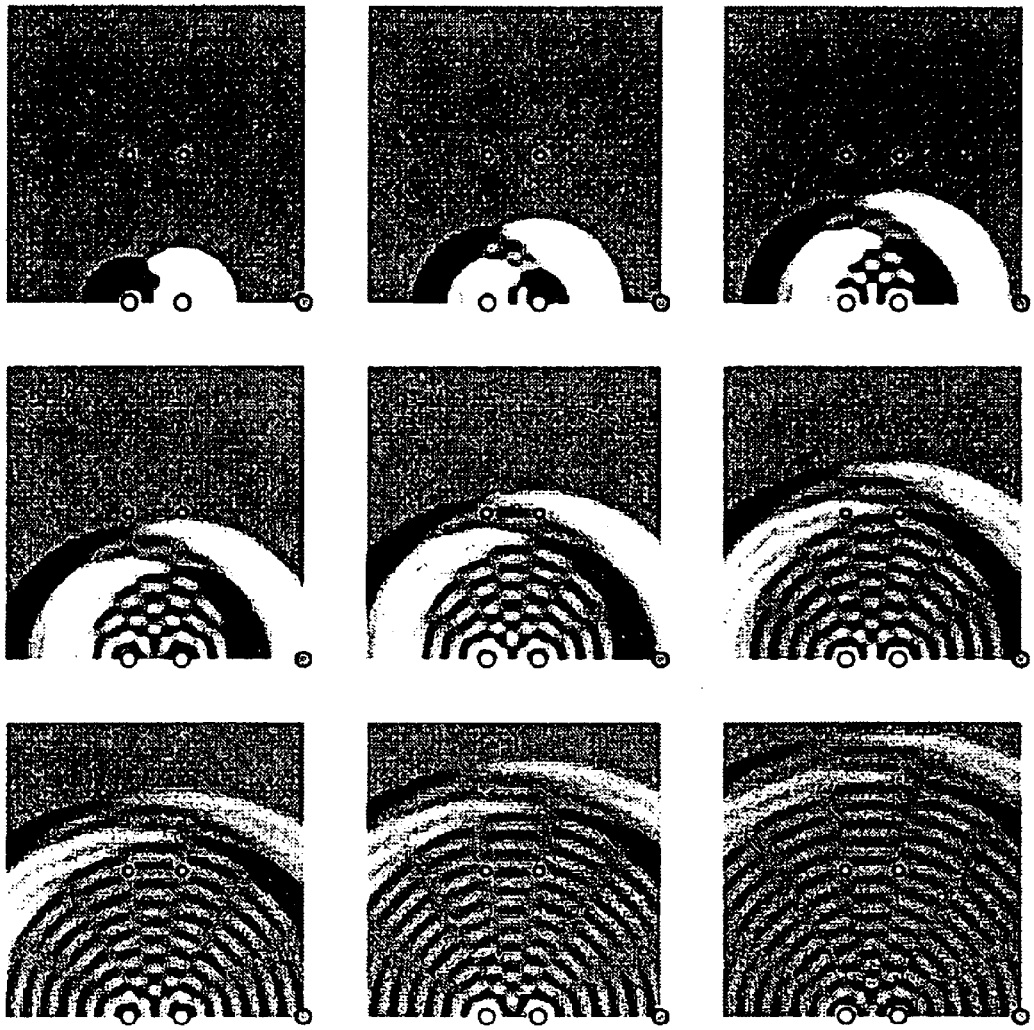
Figure 13C:
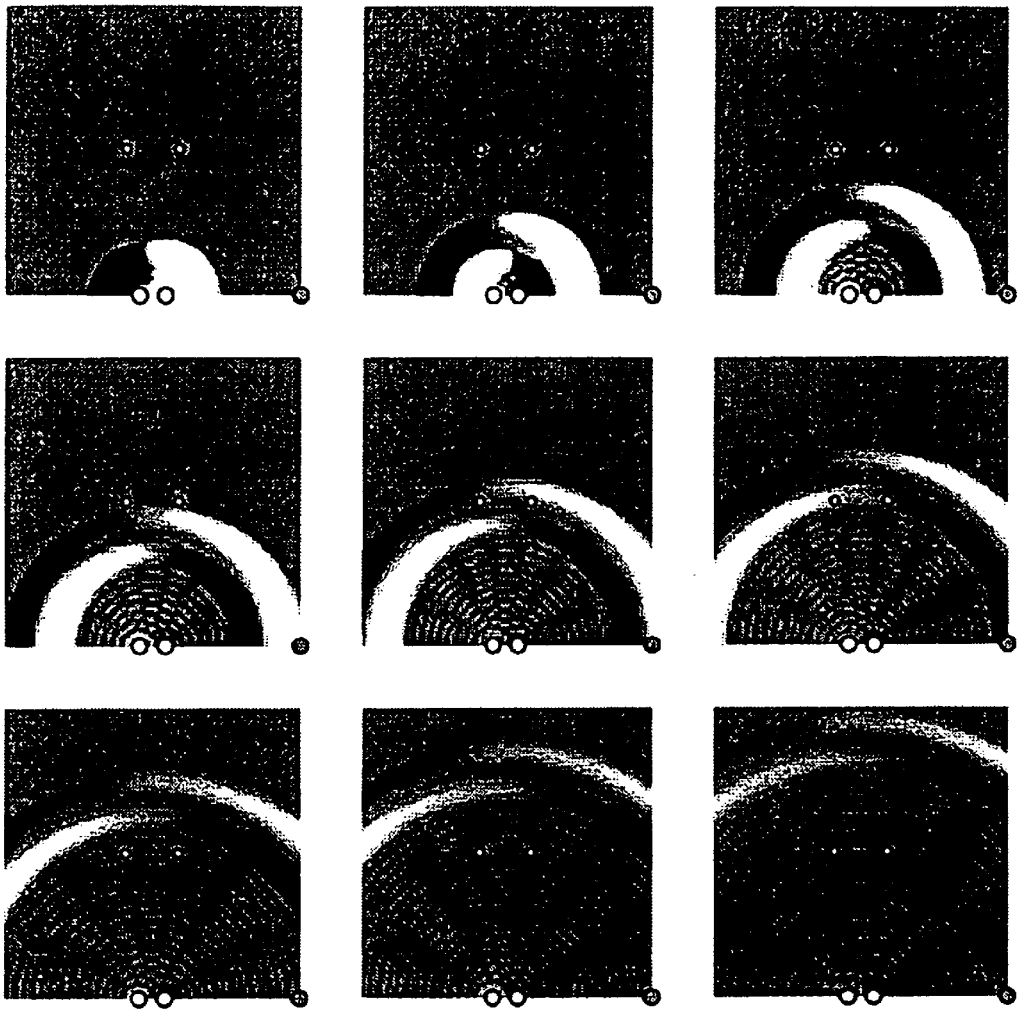
Figure 13D:
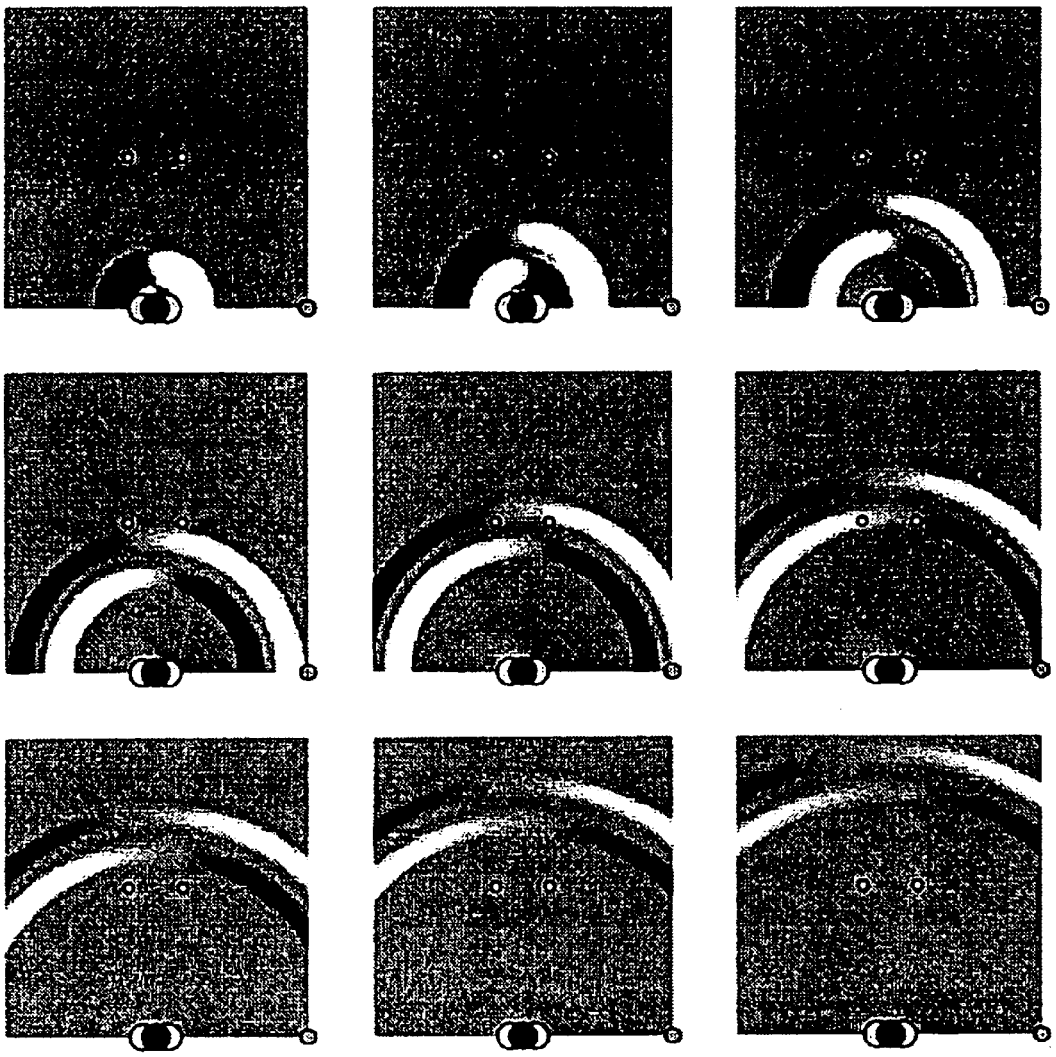
Figure 14A:
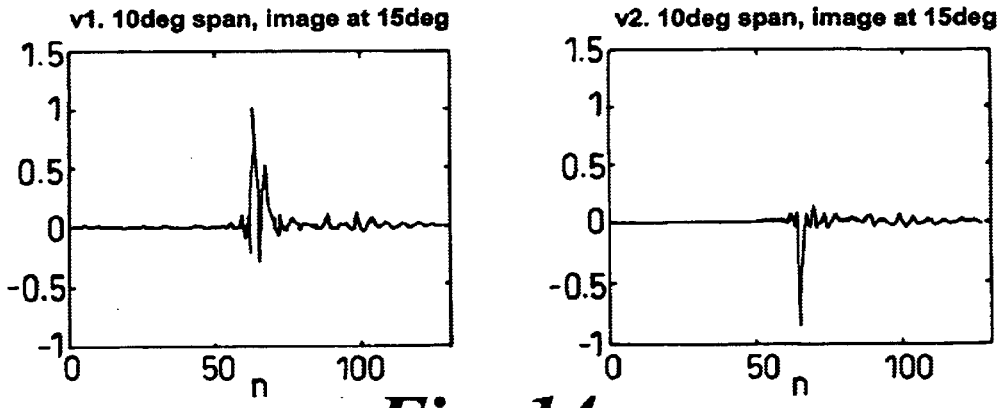
FIGS. 14*a*, 14*b*, 14*c*, 14*d*, 14*e*, and 14*f* illustrate the impulse responses $v_1(n)$ and $v_2(n)$ that are necessary in order to generate a virtual source image.
Figure 14B:
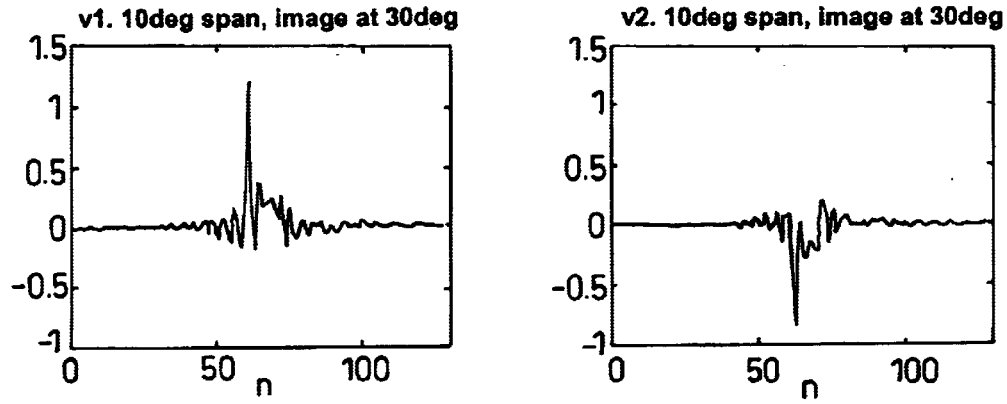
Figure 14C:
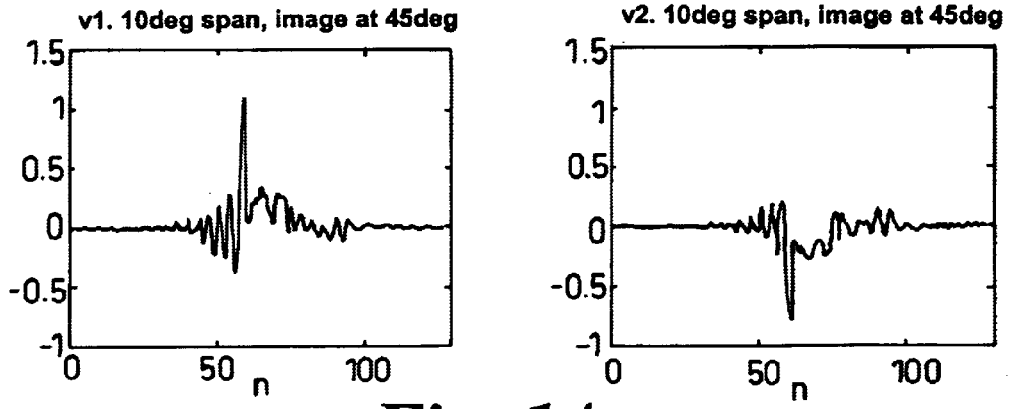
Figure 14D:
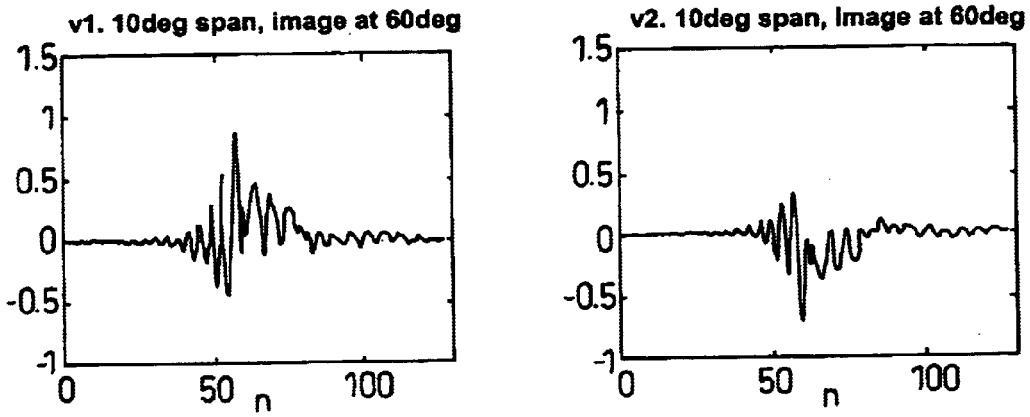
Figure 14E:
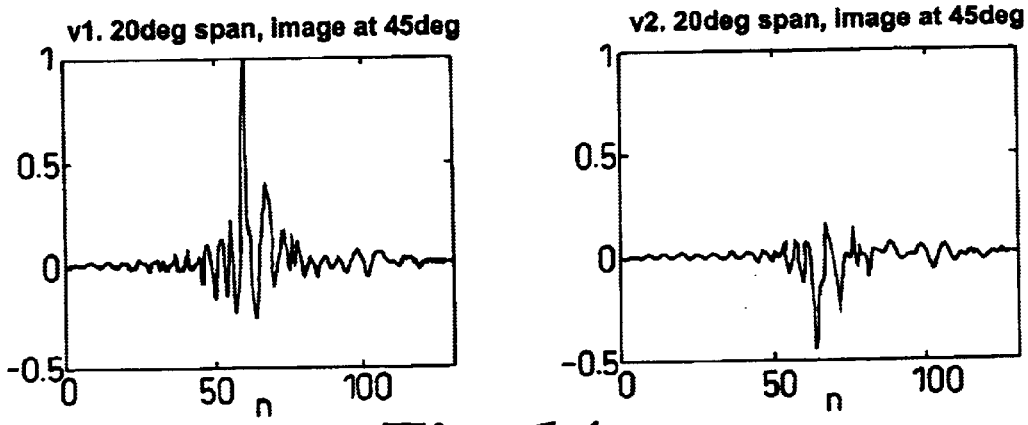
Figure 14F:
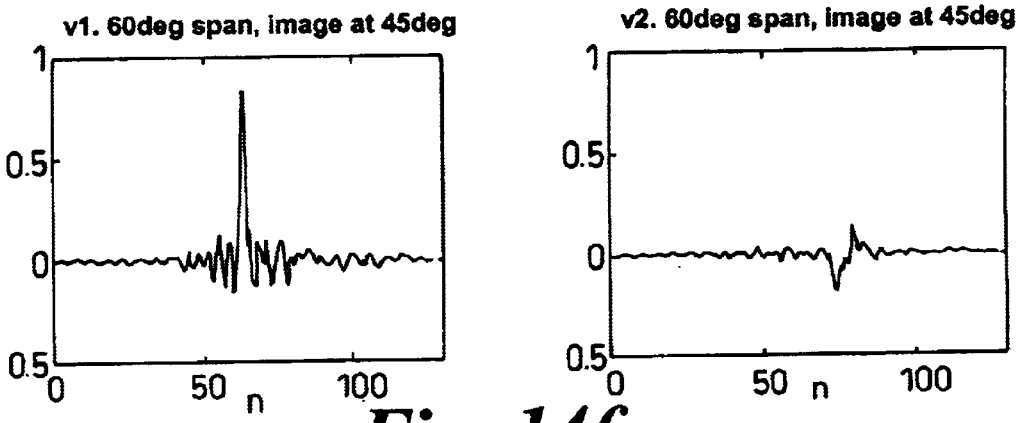
Figure 15A:
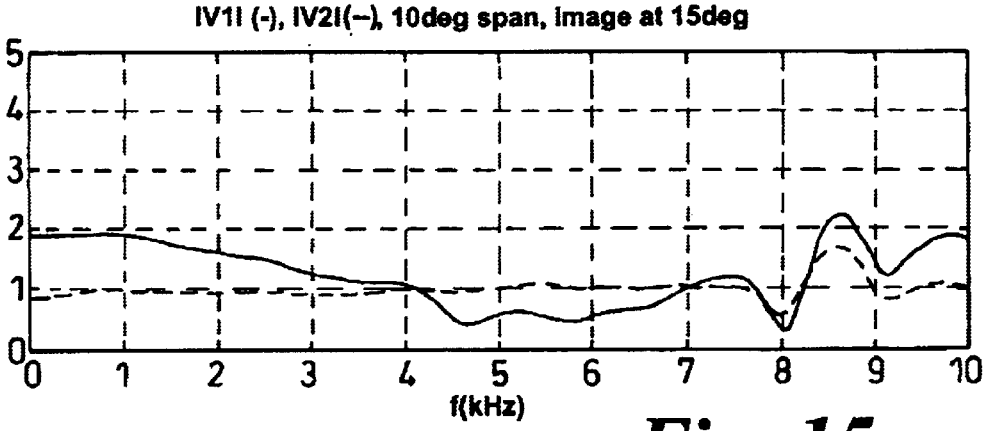
FIGS. 15*a*, 15*b*, 15*c*, 15*d*, 15*e*, and 15*f* illustrate the magnitude of the frequency responses $V_1(f)$ and $V_2(f)$ of the impulse responses shown in FIG. 14, FIGS. 16*a*, 16*b*, 16*c*, 16*d*, 16*e*, and 16*f* illustrate the difference between the magnitudes of the frequency responses $V_1(f)$ and $V_2(f)$ shown in FIG. 15, FIGS. 17*a*, 17*b*, 17*c*, 17*d*, 17*e*, and 17*f* illustrate the delay-compensated unwrapped phase response of the frequency responses $V_1(f)$ and $V_2(f)$ shown in FIG. 15, FIGS. 18*a*, 18*b*, 18*c*, 18*d*, 18*e*, and 18*f* illustrate the difference between the phase responses shown in FIG. 17, FIGS. 19*a*, 19*b*, 19*c*, 19*d*, 19*e*, and 19*f* illustrate the Hanning pulse response $v_1(n)$ and $-v_2(n)$ corresponding to the impulse response shown in FIG. 14. Note that $v_2(n)$ is effectively inverted in phase by plotting $-v_2(n)$.
Figure 15B:
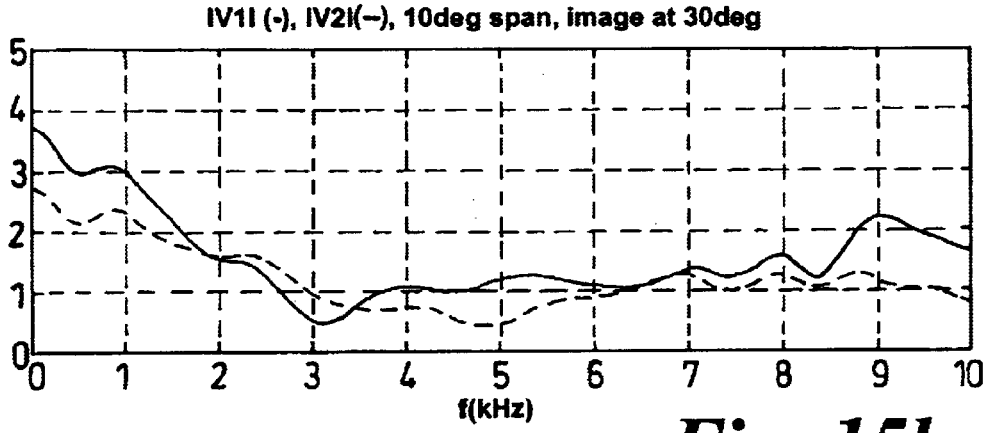
Figure 15C:
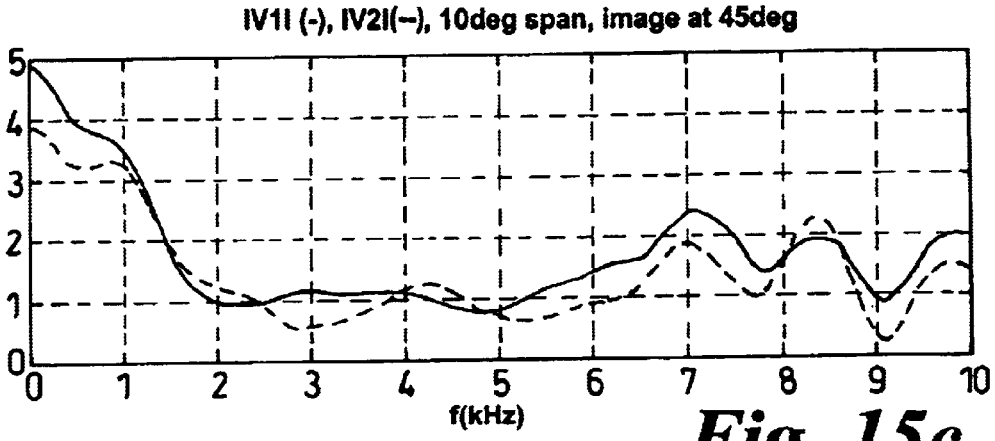
Figure 15D:
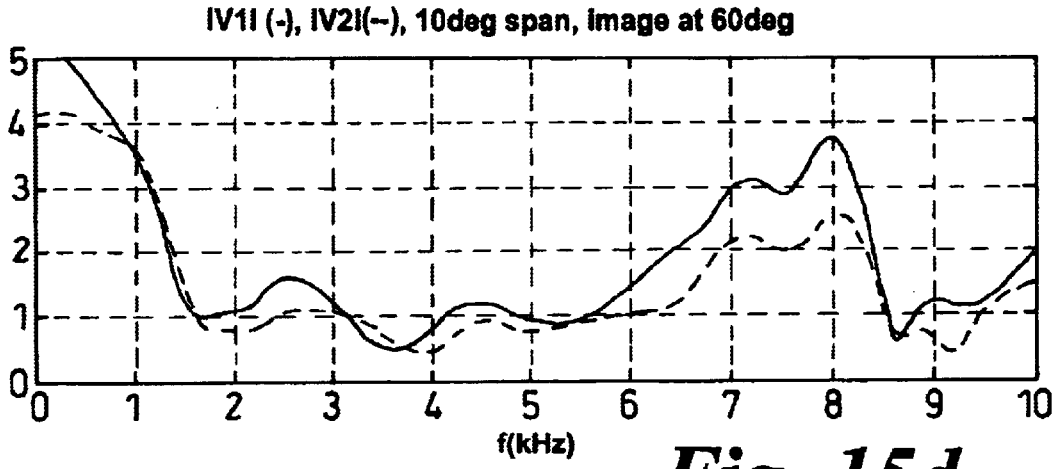
Figure 15E:
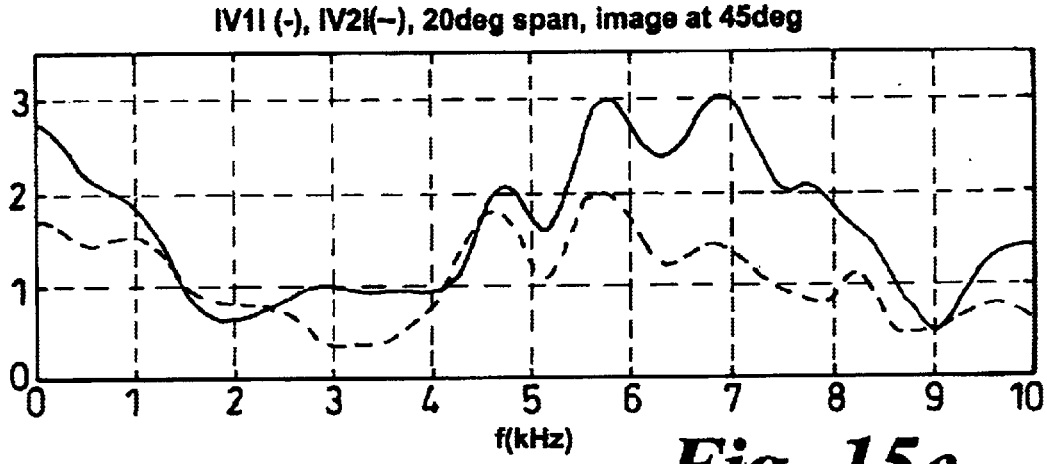
Figure 15F:
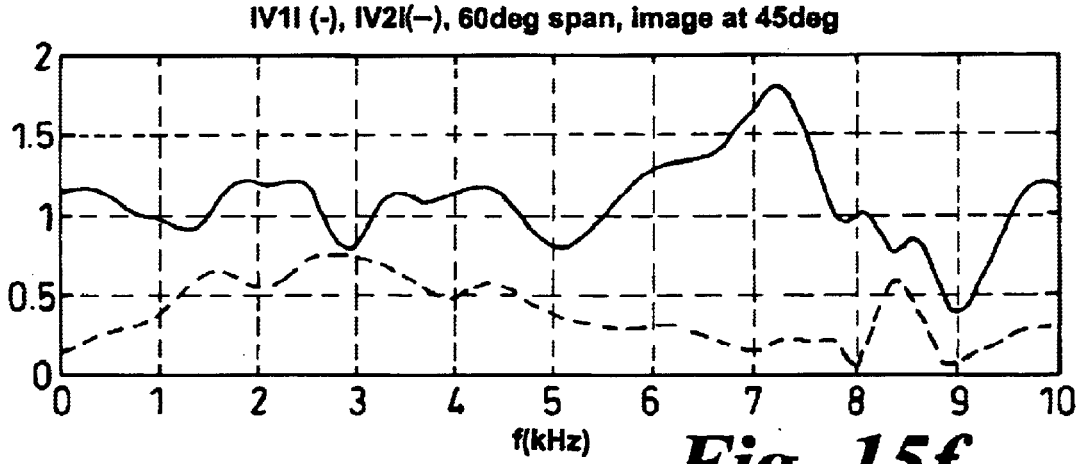
Figure 16A:
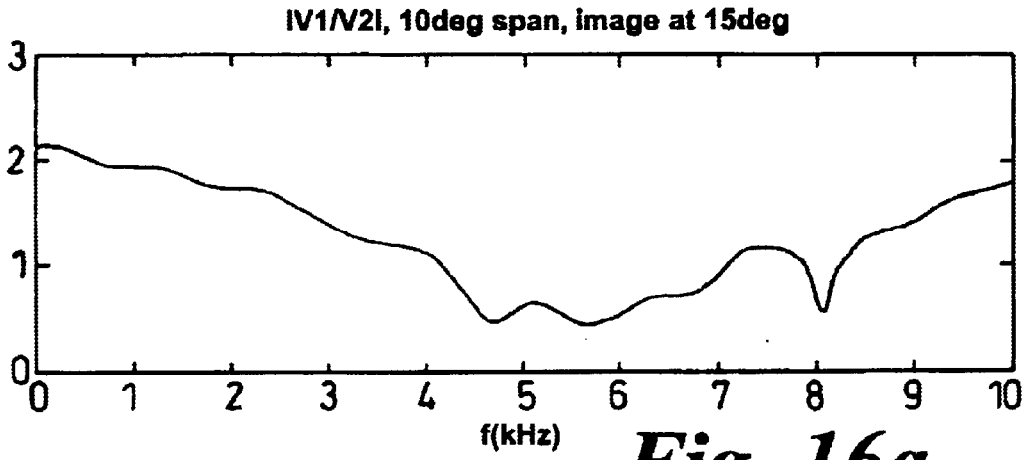
Figure 16B:
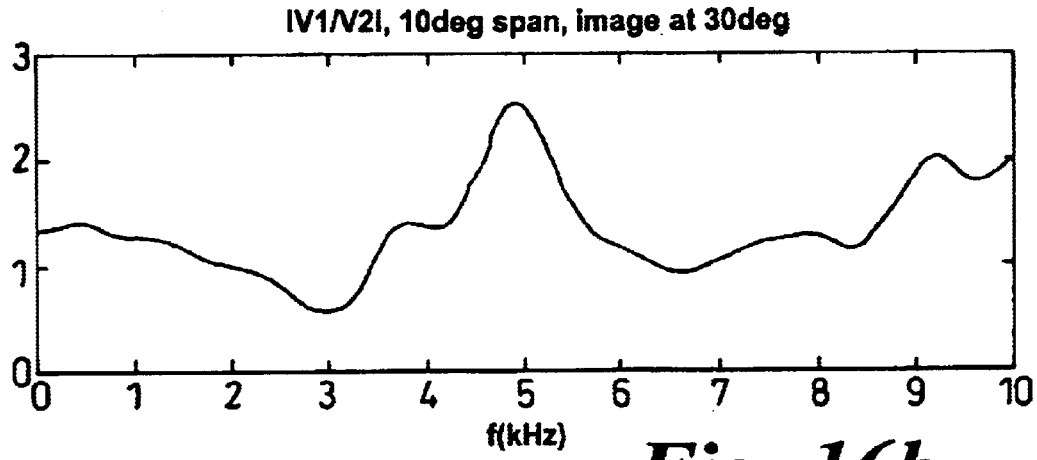
Figure 16C:
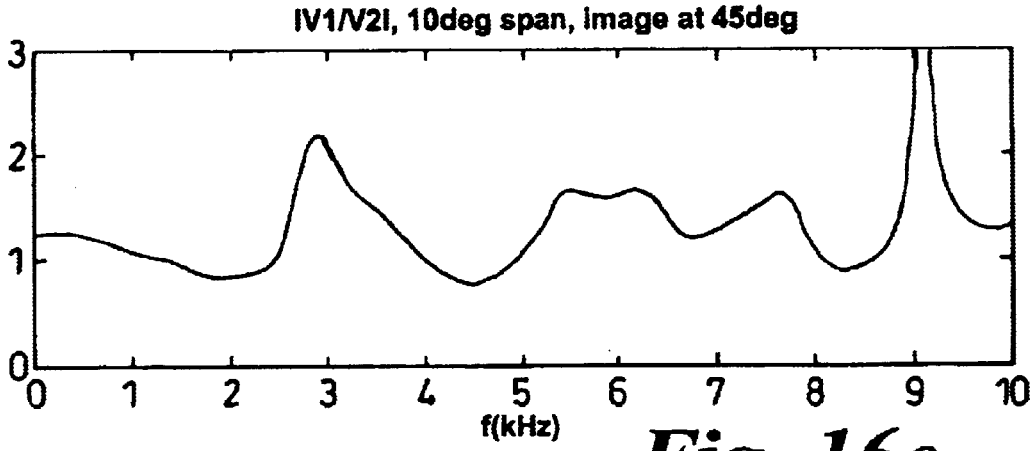
Figure 16D:
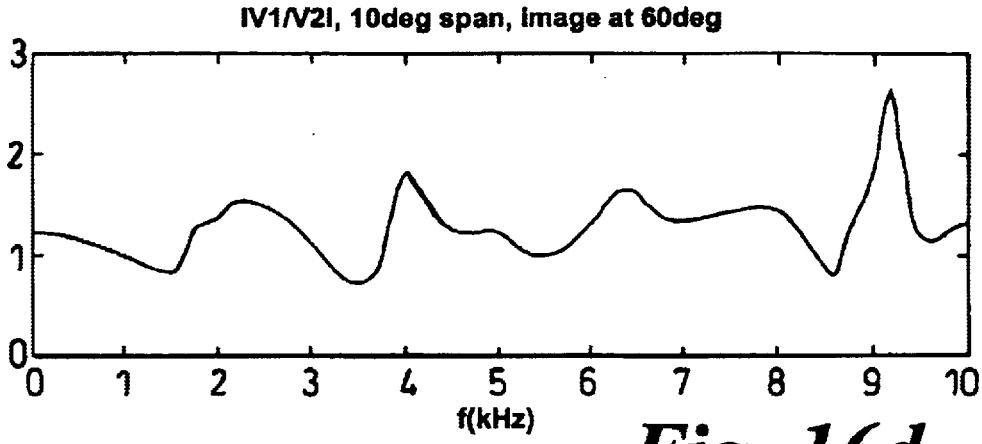
Figure 16E:
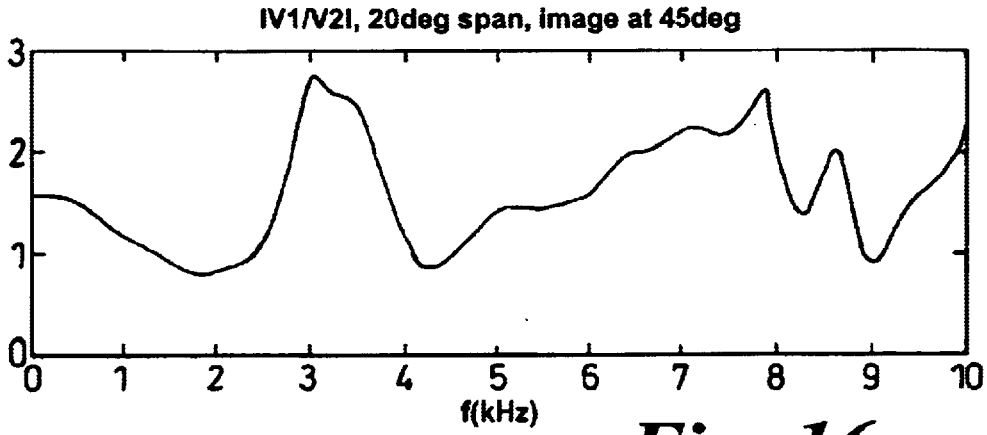
Figure 16F:
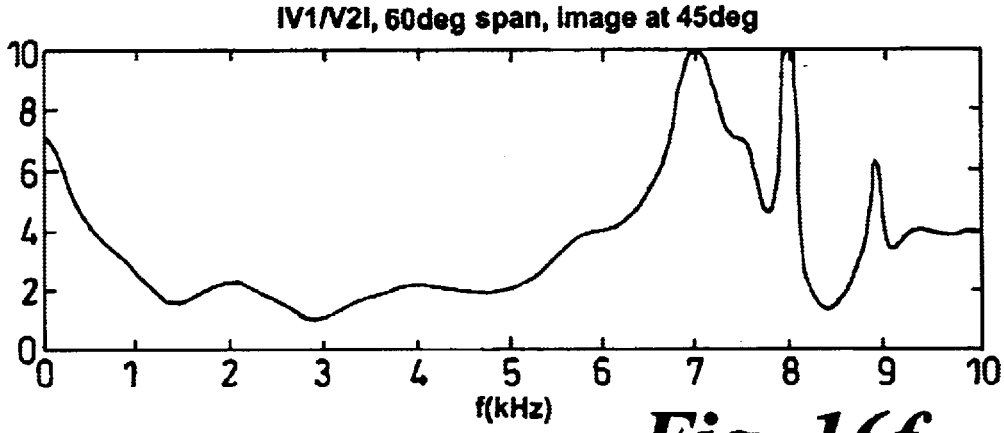
Figure 17A:
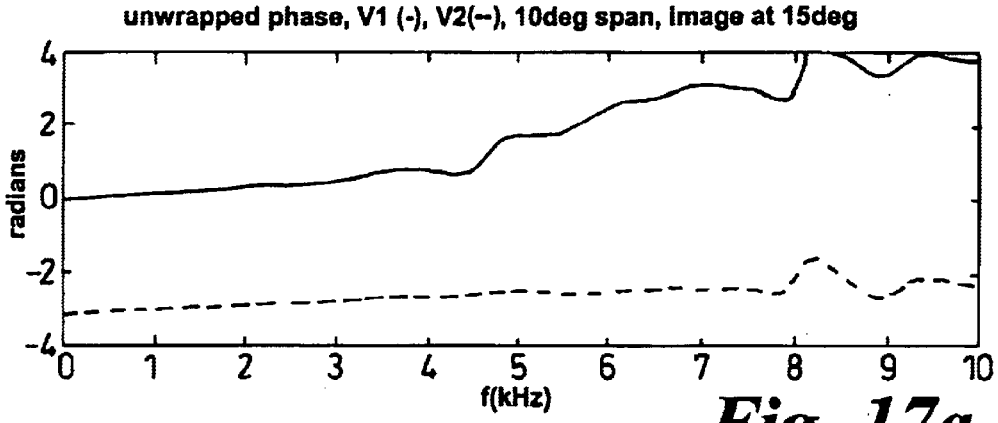
Figure 17B:
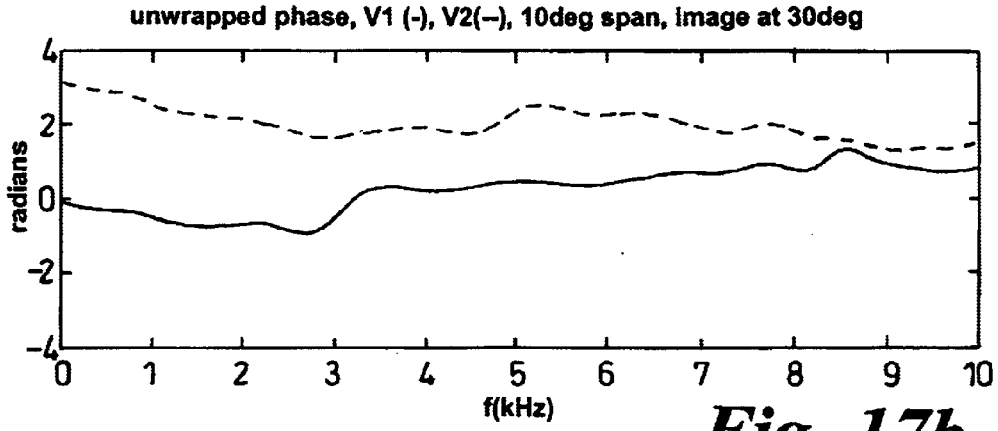
Figure 17C:
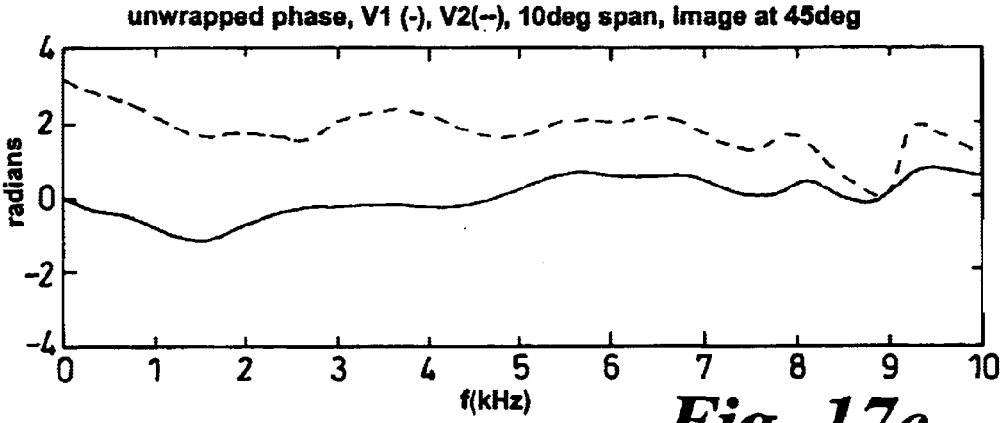
Figure 17D:
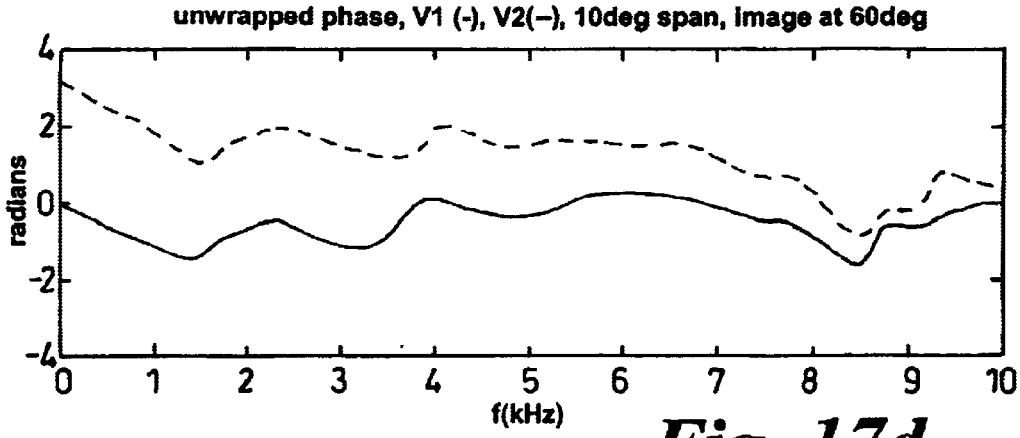
Figure 17E:
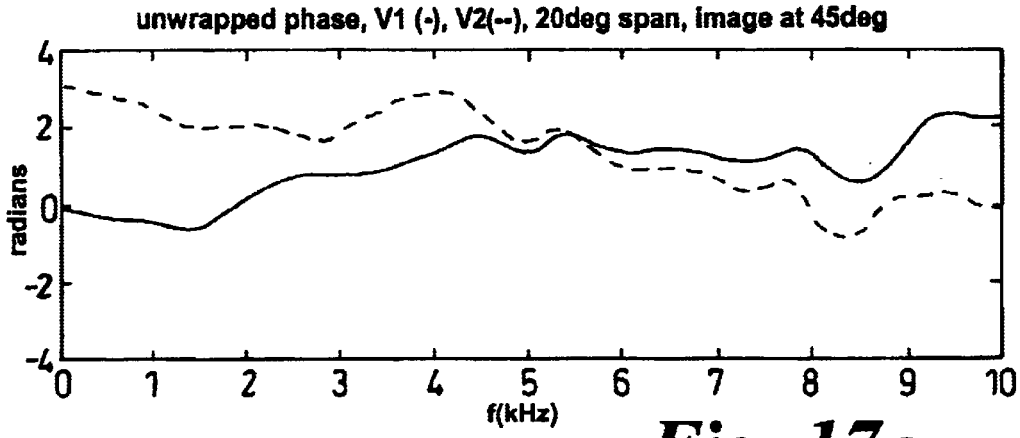
Figure 17F:
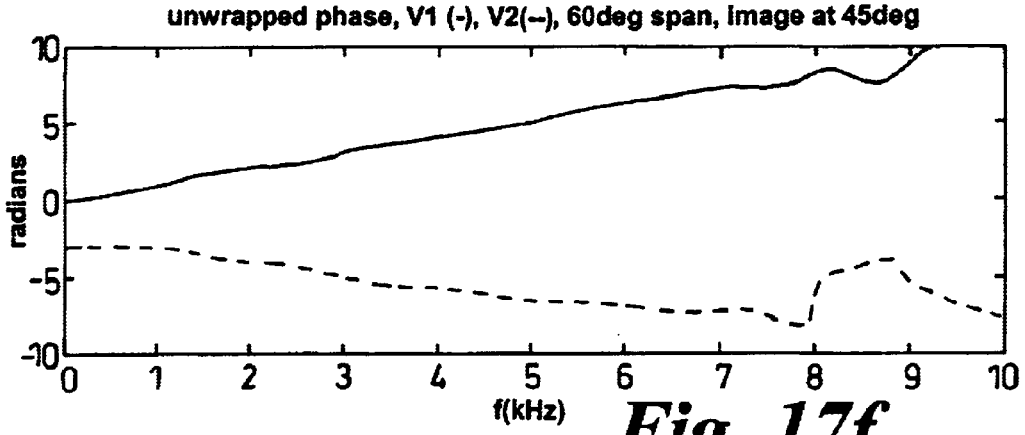
Figure 18A:
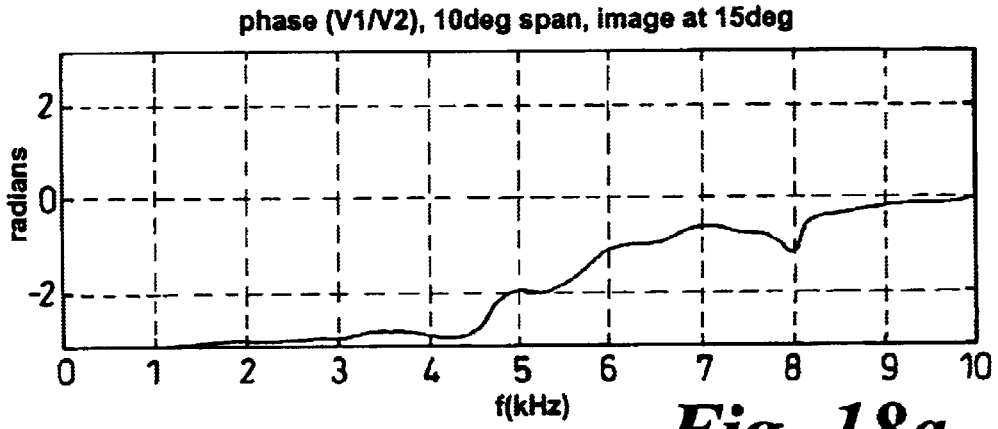
Figure 18B:
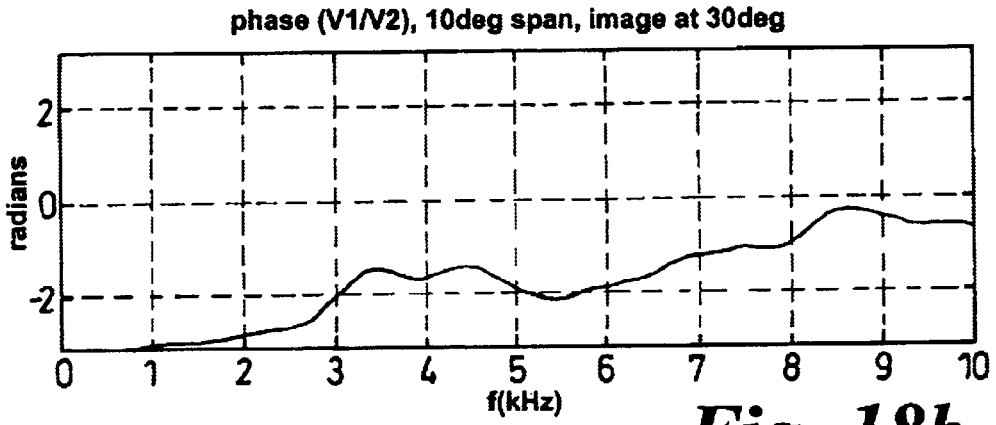
Figure 18C:
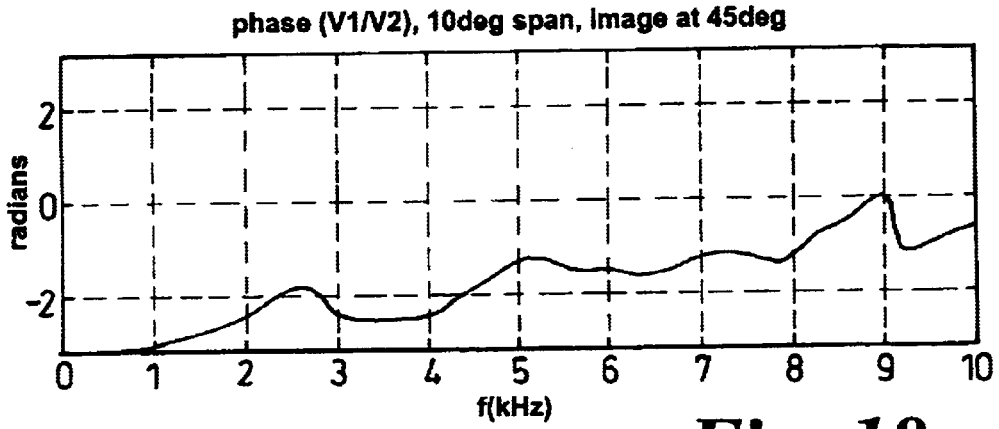
Figure 18D:
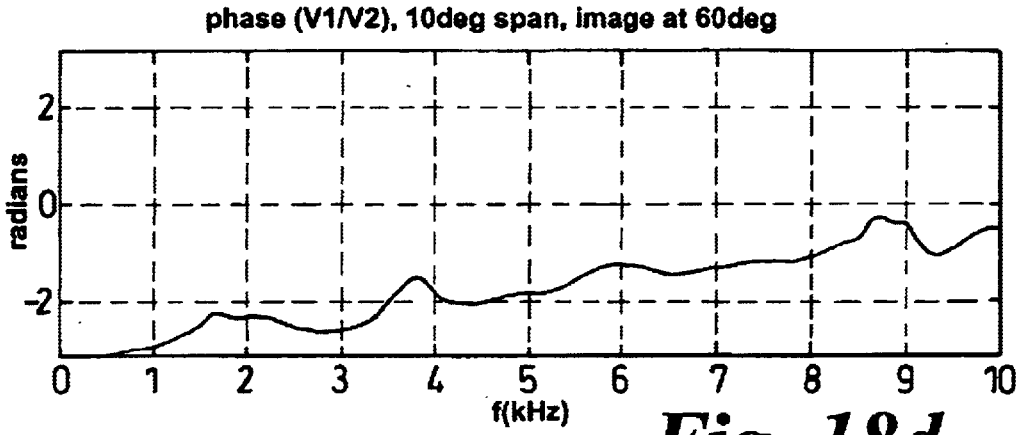
Figure 18E:
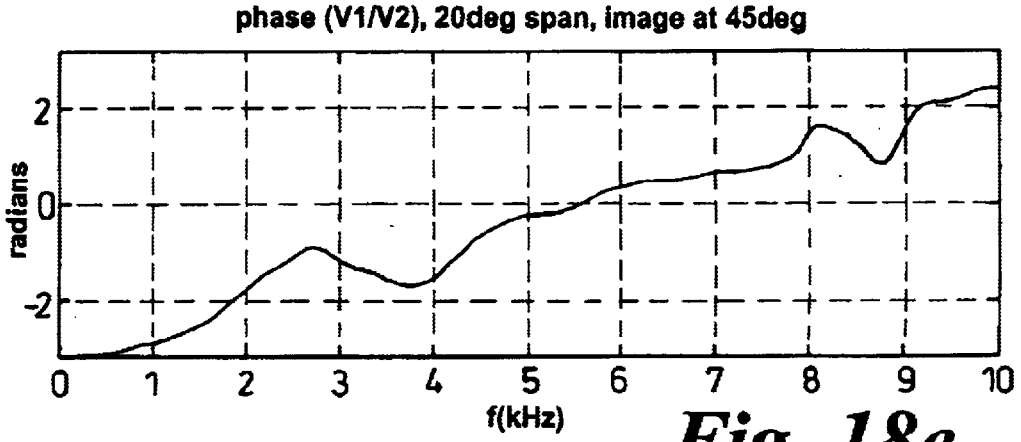
Figure 18F:
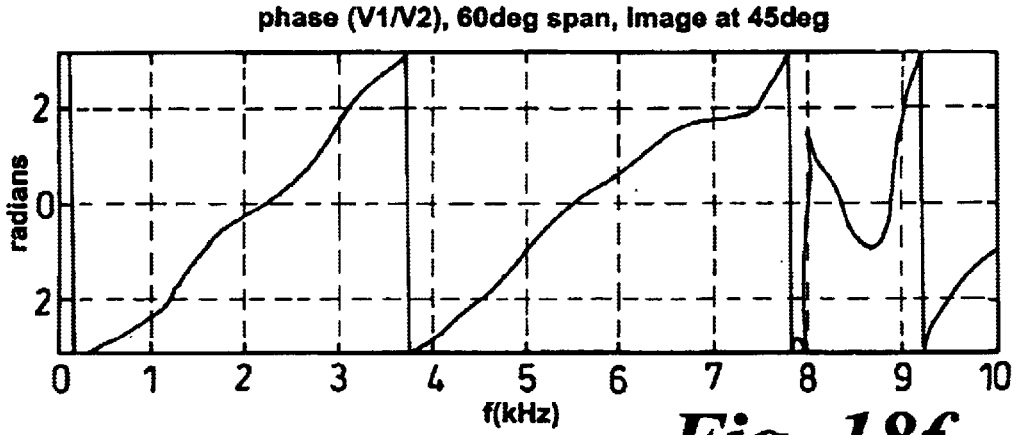
Figure 19A:
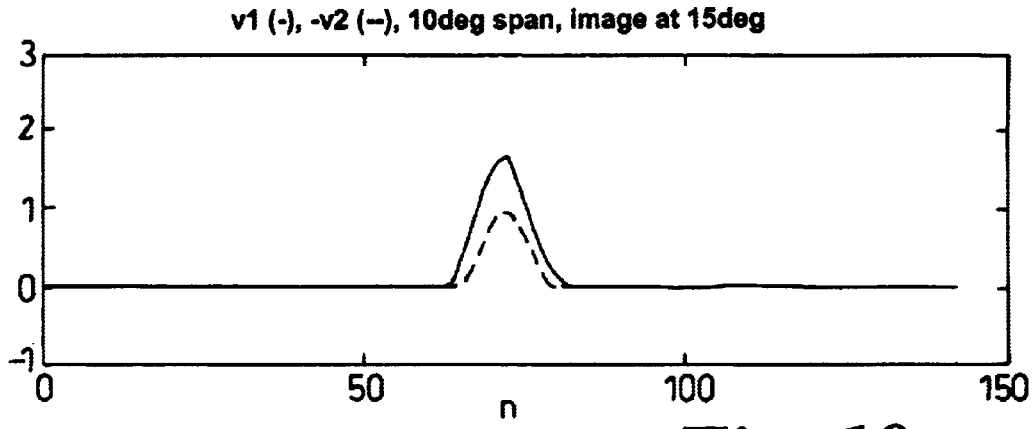
Figure 19B:
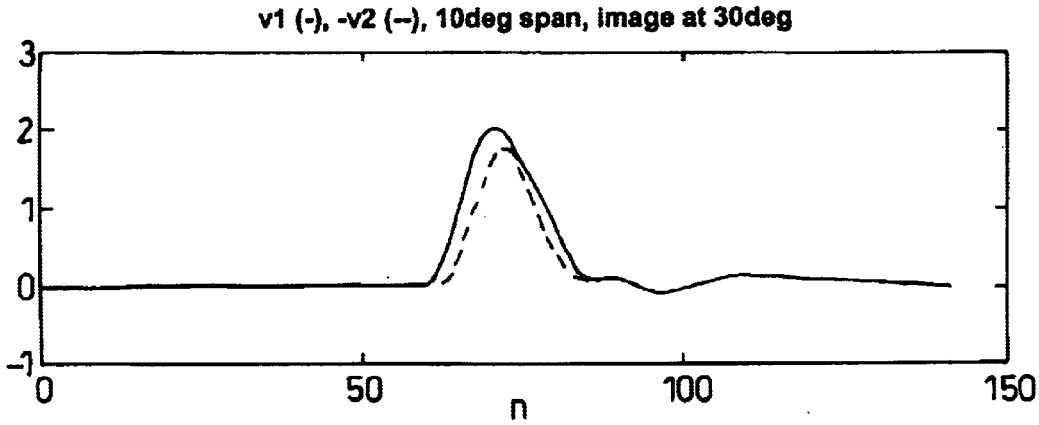
Figure 19C:
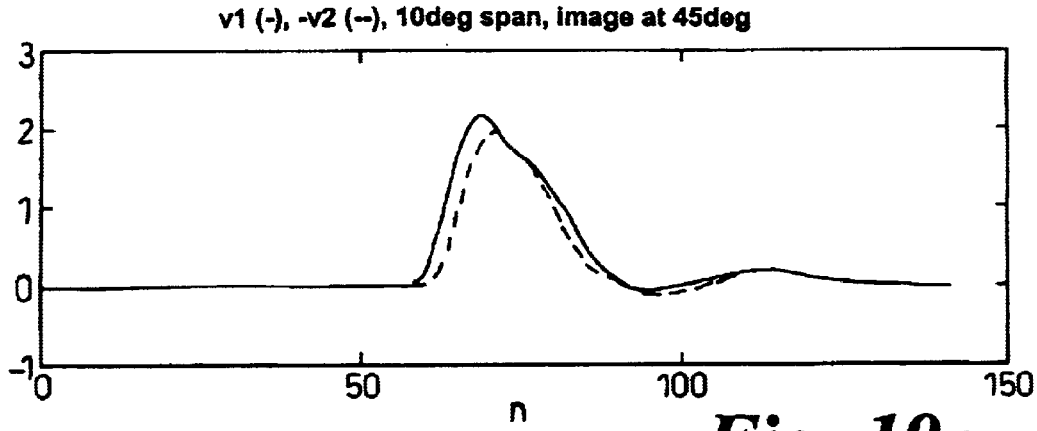
Figure 19D:
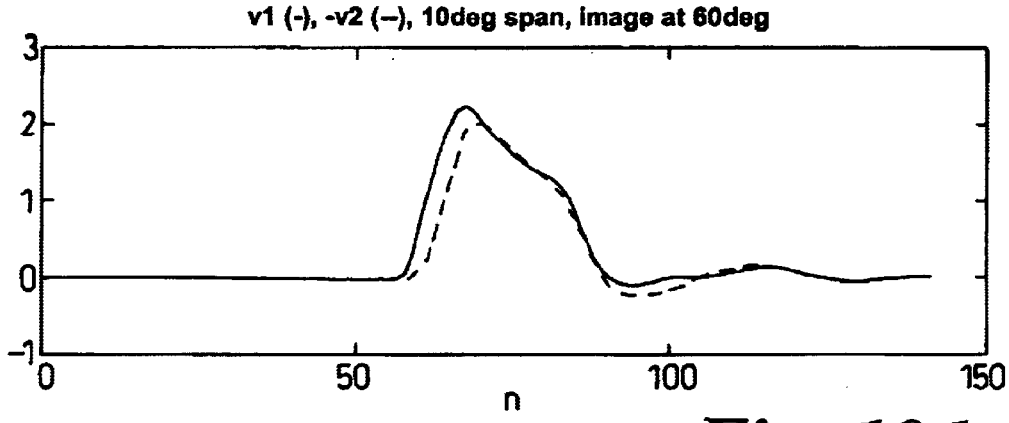
Figure 19E:
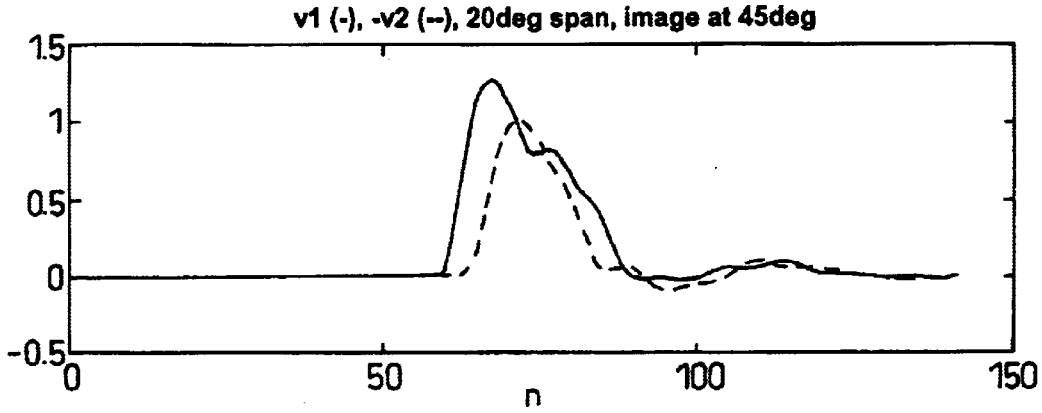
Figure 19F:
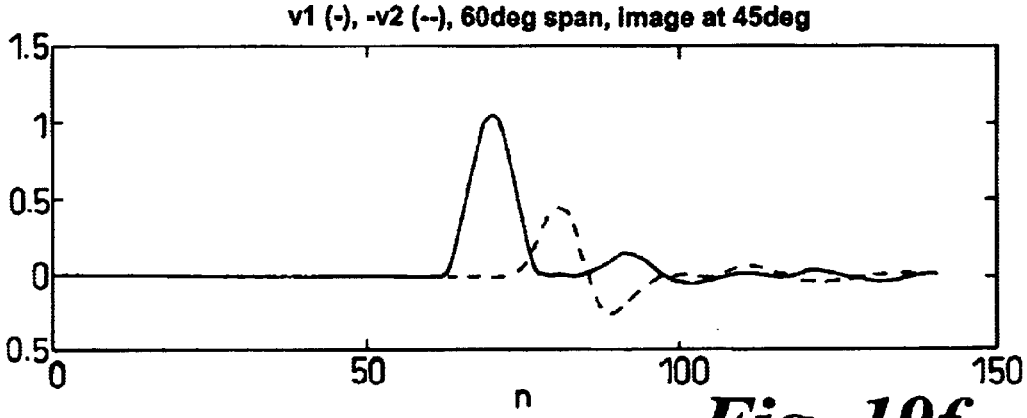
Figure 20A:
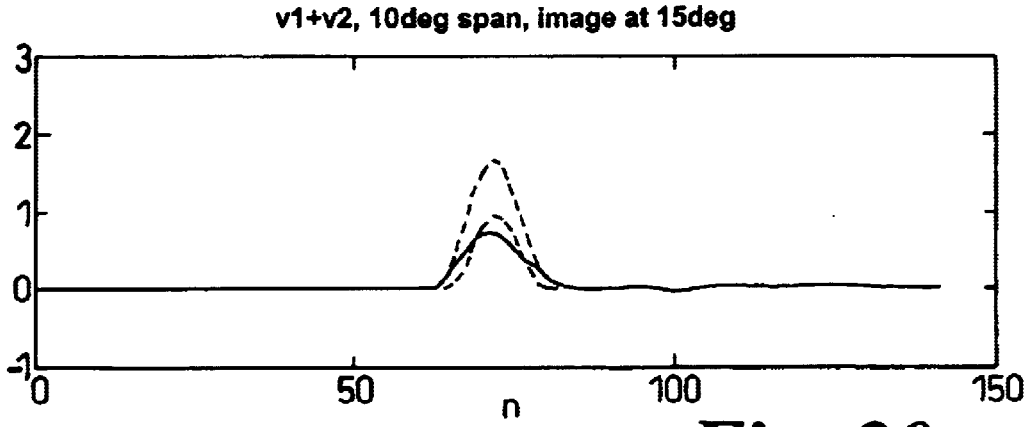
FIGS. 20*a*, 20*b*, 20*c*, 20*d*, 20*e*, and 20*f* illustrate the sum of the Hanning pulse responses $v_1(n)$ and $v_2(n)$ as plotted in FIG. 19, FIGS. 21*a*, 21*b*, 21*c*, and 21*d* illustrate the magnitude response and the unwrapped phase response of the diagonal element $H_1(f)$ of H(f) and the off-diagonal element $H_2(f)$ of H(f) employed to implement a cross-talk cancellation system.
Figure 20B:
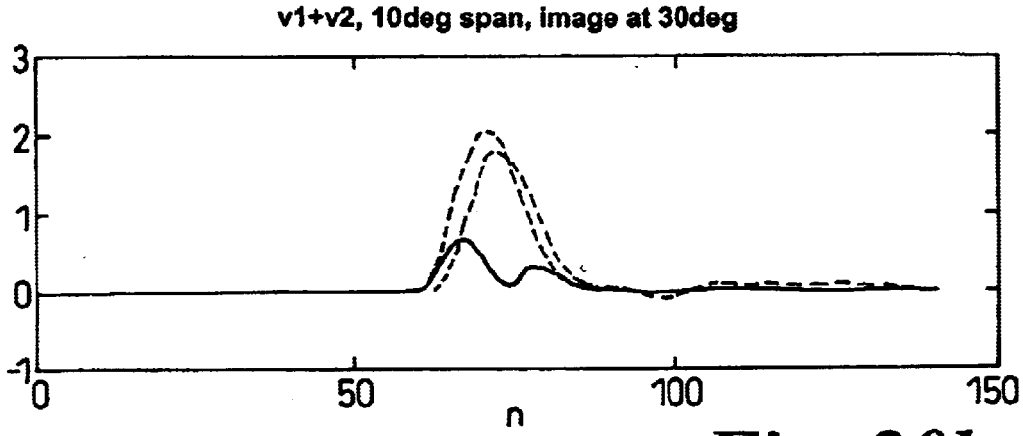
Figure 20C:
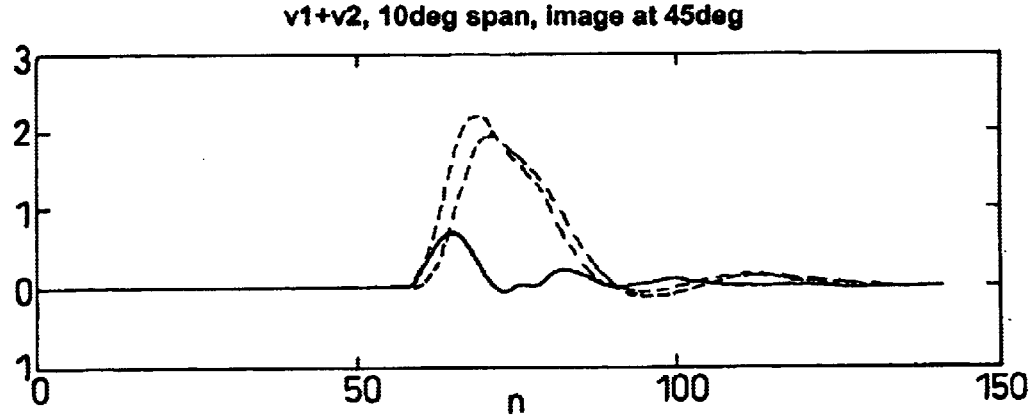
Figure 20D:
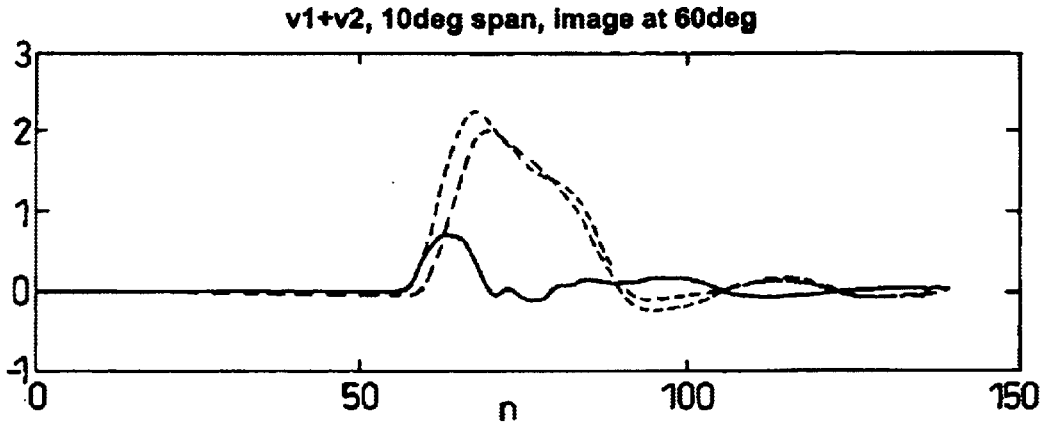
Figure 20E:
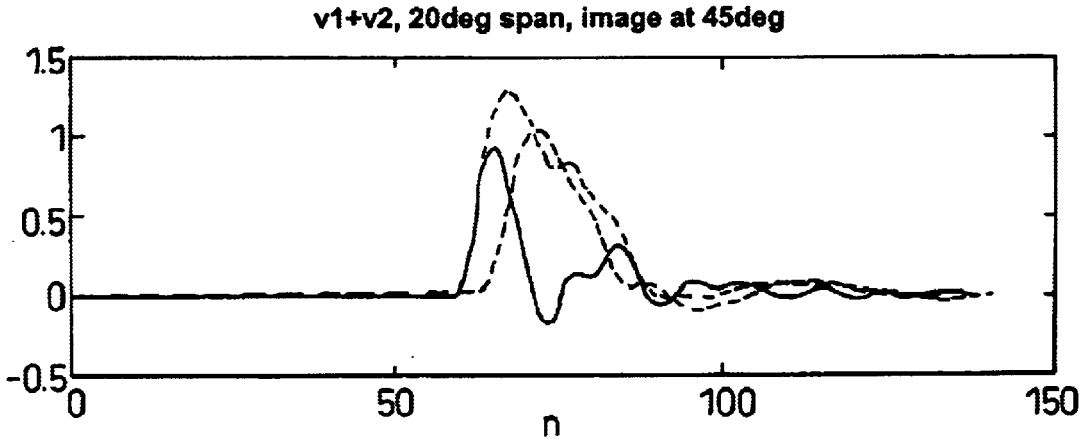
Figure 20F:
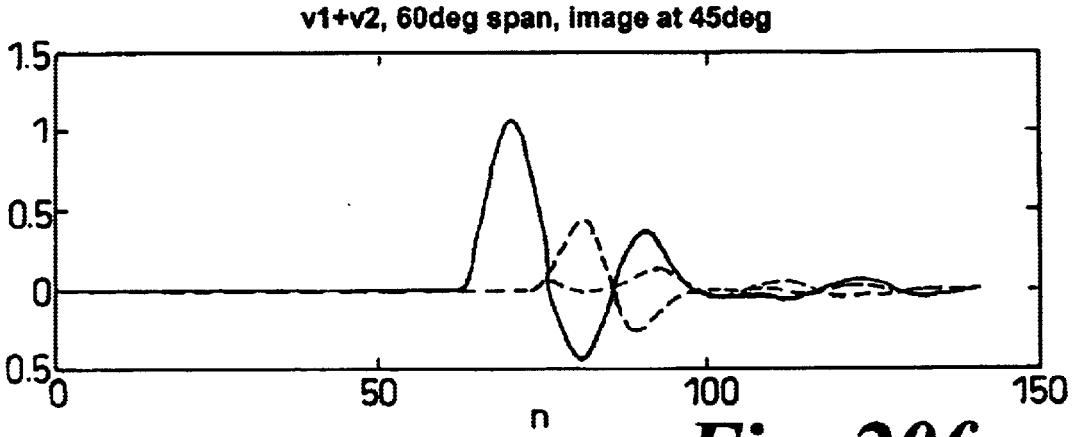
Figure 21A:
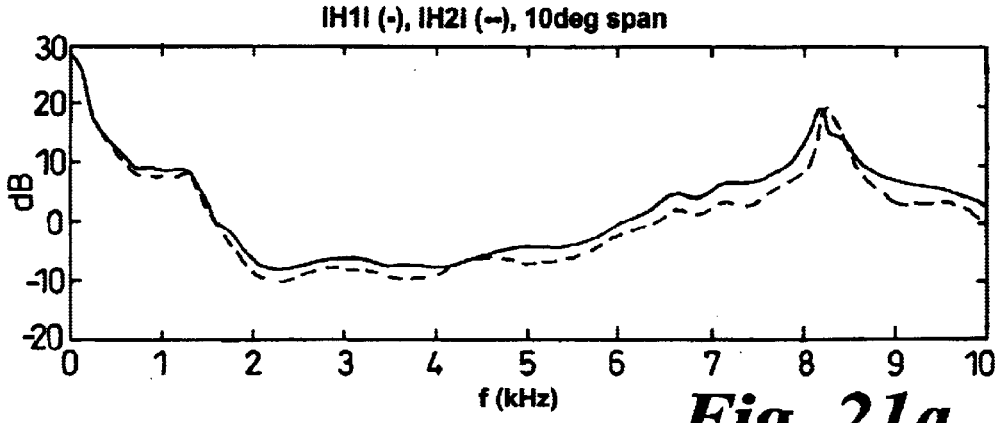
Figure 21B:
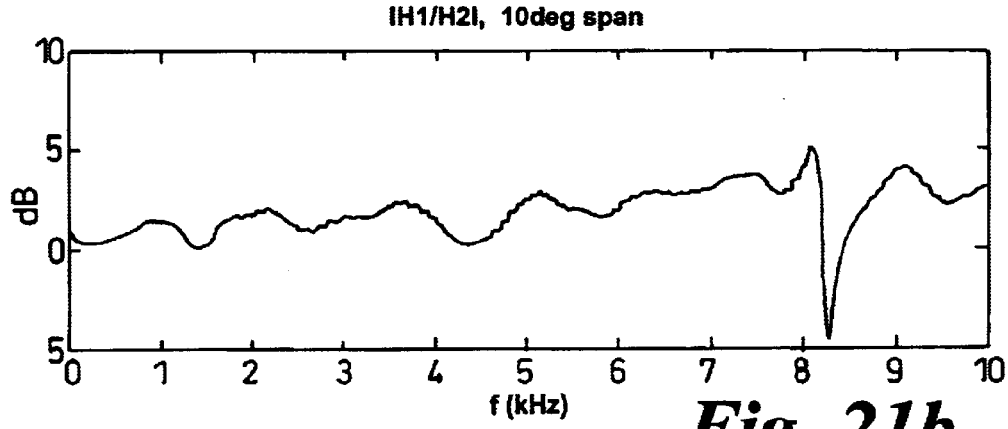
Figure 21C:
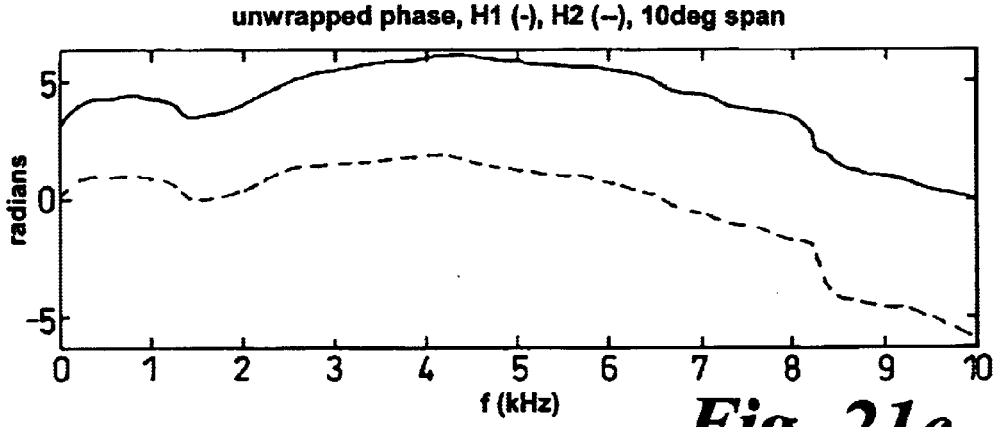
Figure 21D:
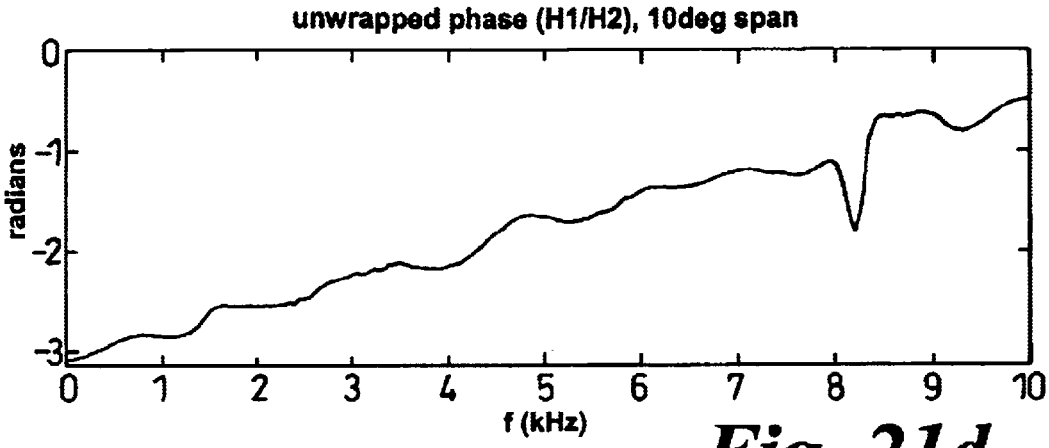

The results shown in FIG. 13*a* etc are again obtained by using Hanning pulses which have a frequency content mainly below 3 kHz. It is clear from these simulations that the difference between the true arrival time of the pulses at the ears correctly simulates the time difference that would be produced by the virtual source. The localisation mechanism of binaural hearing is well known to be highly dependent on the difference in arrival time between the pulses produced at the two ears by a source in a given direction, this being the dominant cue for the localisation of low frequency sources. It is evident that the use of two closely spaced loudspeakers is an extremely effective way of ensuring that the difference between these arrival times are well reproduced. At high frequencies, however, the localisation mechanism is known to be more dependent on the difference in intensity between the two ears (although envelope shifts in high frequency signals can be detected). It is thus important to consider the shadowing, or diffraction, of the human head when implementing virtual source imaging systems in practice.

The free-field transfer functions given by Equation (8) are useful for an analysis of the basic physics of sound reproduction, but they are of course only approximations to the exact transfer functions from the loudspeaker to the eardrums of the listener. These transfer functions are usually referred to as HRTFs (head-related transfer functions). There are many ways one can go about modelling, or measuring, a realistic HRTF. A rigid sphere is useful for this purpose as it allows the sound field in the vicinity of the head to be calculated numerically. However, it does not account for the influence of the listener's ears and torso on the incident sound waves. Instead, one can use measurements made on a dummy-head or a human subject. These measurements might, or might not, include the response of the room and the loudspeaker. Another important aspect to consider when trying to obtain a realistic HRTF is the distance from the source to the listener. Beyond a distance of, say, 1 m, the HRTF for a given direction will not change substantially if the source is moved further away from the listener (not considering scaling and delaying). Thus, one would only need a single HRTF beyond a certain 'far-field' threshold. However, when the distance from the loudspeakers to the listener is short (as is the case when sitting in front of a computer), it seems reasonable to assume that it would be better to use 'distance-matched' HRTFs than 'far-field' HRTFs.

It is important to realise that no matter how the HRTFs are obtained, the multi-channel plant will in practice always contain so-called non-minimum phase components. It is well known that non-minimum phase components cannot be compensated for exactly. A naive attempt to do this results in filters whose impulse responses are either non-causal or unstable. One way to try and solve this problem was to design a set of minimum-phase filters whose magnitude responses are the same as those of the desired signals (see Cooper U.S. Pat. No. 5,333,200). However, these minimum-phase filters cannot match the phase response of the desired signals, and consequently the time responses of the reproduced signals will inevitably be different from the desired signals. This means that the shape of the desired waveform, such as a Hanning pulse for example, will be 'distorted' by the minimum-phase filters.

Instead of using the minimum-phase approach, the present invention employs a multi-channel filter design procedure that combines the principles of least squares approximation and regularisation (PCT/GB95/02005), calculating those causal and stable digital filters that ensure the minimisation of the squared error, defined in the frequency domain or in the time domain, between the desired ear signals and the reproduced ear signals. This filter design approach ensures that the signals reproduced at the listener's ears closely replicate the waveforms of the desired signals. At low frequencies the phase (arrival time) differences, which are so important for the localisation mechanism, are correctly reproduced within a relatively large region surrounding the listener's head. At high frequencies the differences in intensity required to be reproduced at the listener's ears are also correctly reproduced. As mentioned above, when one designs the filters, it is particularly important to include the HRTF of the listener, since this HRTF is especially important for determining the intensity differences between the ears at high frequencies.

Regularisation is used to overcome the problem of ill-conditioning. Ill-conditioning is used to describe the problem that occurs when very large outputs from the loudspeakers are necessary in order to reproduce the desired signals (as is the case when trying to achieve perfect cross-talk cancellation at low frequencies using two closely spaced loudspeakers). Regularisation works by ensuring that certain pre-determined frequencies are not boosted by an excessive amount. A modelling delay means may be used in order to allow the filters to compensate for non-minimum phase components of the multi-channel plant (PCT/GB95/02005). The modelling delay causes the output from the filters to be delayed by a small amount, typically a few milliseconds.

The objective of the filter design procedure is to determine a matrix of realisable digital filters that can be used to implement either a cross-talk cancellation system or a virtual source imaging system. The filter design procedure can be implemented either in the time domain, the frequency domain, or as a hybrid time/frequency domain method. Given an appropriate choice of the modelling delay and the regularisation, all implementations can be made to return the same optimal filters.

Time Domain Filter Design

Time domain filter design methods are particularly useful when the number of coefficients in the optimal filers is relatively small. The optimal filters can be found either by using an iterative method or by a direct method. The iterative method is very efficient in terms of memory usage, and it is also suitable for real-time implementation in hardware, but it converges relatively slowly. The direct method enables one to find the optimal filters by solving a linear equation system in the least squares sense. This equation system is of the form $$\left[\begin{array}{c|c} C_1 & C_2 \\ \hline C_2 & C_1 \end{array}\right]\left[\begin{array}{c} v_1 \\ \hline v_2 \end{array}\right] = \left[\begin{array}{c} d_1 \\ \hline d_2 \end{array}\right],$$

or Cv=d where C, v, and d are of the form $$C = \left[\begin{array}{c|c} C_1 & C_2 \\ \hline C_2 & C_1 \end{array}\right],\ v = \left[\begin{array}{c} v_1 \\ \hline v_2 \end{array}\right],\ \text{and}\ d = \left[\begin{array}{c} d_1 \\ \hline d_2 \end{array}\right].$$

Here $$C_1 = \begin{bmatrix} c_1(0) & & \\ \vdots & \ddots & \\ c_1(N_c-1) & \ddots & c_1(0) \\ & \ddots & \vdots \\ & & c_1(N_c-1) \end{bmatrix}, C_2 = \begin{bmatrix} c_2(0) & & \\ \vdots & \ddots & \\ c_2(N_c-1) & \ddots & c_2(0) \\ & \ddots & \vdots \\ & & c_2(N_c-1) \end{bmatrix},$$

where $c_1(n)$ and $c_2(n)$ are the impulse responses, each containing $N_c$ coefficients, of the electro-acoustic transfer functions from the loudspeakers to the ears of the listener. The vectors $v_1$ and $V_2$ represent the inputs to the loudspeakers, consequently $v_1=[v_1(0) \ldots v_1(N_v-1)]^T$ and $v_2=[v_2(0) \ldots v_2(N_v-1)]^T$ where $N_v$ is the number of coefficients in each of the two impulse responses. Likewise, the vectors $d_1$ and $d_2$ represent the signals that must be reproduced at the ears of the listener, consequently $d_1=[d_1(0) \ldots d_1(N_c+N_v-2)]^T$ and $d_1=[d_1(0) \ldots d_1(N_c+N_v-2)]^T$. The modelling delay is included by delaying each of the two impulse responses that make up the right hand side d by the same amount m samples. The optimal filters v are then given by $$v=[C^TC+\beta I]^{-1}.C^Td,$$

where $\beta$ is a regularisation parameter.

Since a long FIR filter is necessary in order to achieve efficient cross-talk cancellation at low frequencies, this method is more suitable for designing filters for virtual source imaging. However, if a single-point IIR filter is included in order to boost the low frequencies, it becomes practical to use the time domain methods also to design cross-talk cancellation systems. An IIR filter can also be used to modify the desired signals, and this can be used to prevent the optimal filters from boosting certain frequencies excessively.

Frequency Domain Filter Design

As an alternative to the time domain methods, there is a frequency domain method referred to as 'fast deconvolution' (disclosed in PCT/GB95/02005). It is extremely fast and very easy to implement, but it works well only when the number of coefficients in the optimal filters is large. The implementation of the method is straightforward in practice. The basic idea is to calculate the frequency responses of $V_1$ and $V_2$ by solving the equation CV=D at a large number of discrete frequencies. Here C is a composite matrix containing the frequency response of the electro-acoustic transfer functions, $$C = \begin{bmatrix} C_1 & C_2 \\ C_2 & C_1 \end{bmatrix},$$

and V and D are composite vectors of the form $V=[V_1\ V_2]^T$ and $D=[D_1\ D_2]^T$, containing the frequency responses of the loudspeaker inputs and the desired signals respectively. FFTs are used to get in and out of the frequency domain, and a "cyclic shift" of the inverse FFTs of $V_1$ and $V_2$ is used to implement a modelling delay. When an FFT is used to sample the frequency responses of $V_1$ and $V_2$ at $N_v$ points, their values at those frequencies is given by $$V(k)=[C^H(k)C(k)+\beta I]^{-1}C^H(k)D(k).$$

where $\beta$ is a regularisation parameter, H denotes the Hermitian operator which transposes and conjugates its argument, and k corresponds to the k'th frequency line; that is, the frequency corresponding to the complex number $\exp(j2\pi k/N_v)$.

In order to calculate the impulse responses of the optimal filters $v_1(n)$ and $v_2(n)$ for a given value of $\beta$, the following steps are necessary.

1. Calculate C(k) and D(k) by taking $N_v$-point FFTs of the impulse responses $c_1(n)$, $c_2(n)$, $d_1(n)$, and $d_2(n)$.
2. For each of the $N_v$ values of k, calculate V(k) from the equation shown immediately above
3. Calculate v(n) by taking the $N_v$-point inverse FFTs of the elements of V(k).
4. Implement the modelling delay by a cyclic shift of m of each element of v(n). For example, if the inverse FFT of $V_1(k)$ is {3,2,1,0,0,0,0,1}, then after a cyclic shift of three to the right $v_1(n)$ is {0,0,1,3,2,1,0,0}.

The exact value of m is not critical; a value of $N_v/2$ is likely to work well in all but a few cases. It is necessary to set the regularisation parameter $\beta$ to an appropriate value, but the exact value of $\beta$ is usually not critical, and can be determined by a few trial-and-error experiments.

A related filter design technique uses the singular value decomposition method (SVD). SVD is well known to be useful in the solution of ill-conditioned inversion problems, and it can be applied at each frequency in turn.

Since the fast deconvolution algorithm applies the regularisation at each frequency, it is straightforward to specify the regularisation parameter as a function of frequency.

Hybrid Time/Frequency Domain Filter Design

Since the fast deconvolution algorithm makes it practical to calculate the frequency response of the optimal filters at an arbitrarily large number of discrete frequencies, it is also possible to specify the frequency response of the optimal filters as a continuous function of frequency. A time domain method could then be used to approximate that frequency response. This has the advantage that a frequency-dependent leak could be incorporated into a matrix of short optimal filters.

Characteristics of the Filters

In order to create a convincing virtual image when the loudspeakers are close together, the two loudspeaker inputs must be very carefully matched. As shown in FIG. 12, the two inputs are almost equal and opposite; it is mainly the very small time difference between them that guarantees that the arrival times of the sound at the ears of the listener are correct. In the following it is demonstrated that this is still the case for a range of virtual source image positions, even when the listener's head is modelled using realistic HRTFs.

FIGS. 14–20 compare the two inputs $v_1$ and $v_2$ to the loudspeakers for six different combinations of loudspeaker spans $\theta$ and virtual source positions. Those combinations are as follows. For a loudspeaker span of 10 degrees a) image at 15 degrees, b) 30 degrees, c) 45 degrees, and d) 60 degrees. For the image at 45 degrees e) a loudspeaker span of 20 degrees and f) a span of 60 degrees. This information is also indicated on the individual plots. The image position is measured anti-clockwise relative to straight front which means that all the images are to the front left of the listener, and that they all fall outside the angle spanned by the loudspeakers. The image at 15 degrees is the one closest to the front, the image at 60 degrees is the one furthest to the left. All the results shown in FIGS. 14–20 are calculated using head-related transfer functions taken from the database measured on a KEMAR dummy-head by the media lab at MIT. All time domain sequences are plotted for a sampling frequency of 44.1 kHz, and all frequency responses are plotted using a linear x-axis covering the frequency range from 0 Hz to 10 kHz.

FIG. 14 shows the impulse responses of $v_1(n)$ and $v_2(n)$. Each impulse response contains 128 coefficients, and they are calculated using a direct time domain method. Since the bandwidth is very high, the high frequencies make it difficult to see the structure of the responses, but even so it is still possible to appreciate that $v_1(n)$ is mainly positive whereas $v_2(n)$ is mainly negative.

FIG. 15 shows the magnitude, on a linear scale, of the frequency responses $V_1(f)$ and $V_2(f)$ of the impulse responses shown in FIG. 14. It is seen that the two magnitude responses are qualitatively similar for the 10 degree loudspeaker span, and also for the 20 degree loudspeaker span. A relatively large output is required from both loudspeakers at low frequencies, but the responses decrease smoothly with frequency up to a frequency of approximately 2 kHz. Between 2 kHz and 4 kHz the responses are quite smooth and relatively flat. For the 60 degree loudspeaker span, loudspeaker number one dominates over the entire frequency range.

FIG. 16 shows the ratio, on a linear scale, between the magnitudes of the frequency responses shown in FIG. 15. It is seen that for the 10 degree loudspeaker span, the two magnitudes differ by less than a factor of two at almost all frequencies below 10 kHz. The ratio between the two responses is particularly smooth at frequencies below 2 kHz even though the two loudspeaker inputs are boosted moderately at low frequencies.

FIG. 17 shows the unwrapped phase response of the frequency responses shown in FIG. 15. The phase contribution corresponding to a common delay has been removed from each of the six pairs (the six delays are, in sampling intervals, a) 31, b) 29, c) 28, d) 27, e) 29, and f) 33). The purpose of this is to make the resulting responses as flat as possible, otherwise each phase response will have a large negative slope that makes it impossible to see any detail in the plots. It is seen that the two phase responses are almost flat for the 10 degree loudspeaker span whereas the phase responses corresponding to the loudspeaker spans of 20 degrees and 60 degrees (plot f, note range of y-axis) have distinctly different slopes.

FIG. 18 shows the difference between the phase responses shown in FIG. 17. It is seen that for the 10 degree loudspeaker span the difference is within −pi and 0. This means that at no frequencies below 10 kHz with a loudspeaker span θ of 10 degrees are the two loudspeaker inputs in phase. At frequencies below 8 kHz, the phase difference between the two loudspeaker inputs is substantial and its absolute value is always greater than pi/4 (equivalent to 45 degrees). At frequencies below 100 Hz, the two loudspeaker inputs are very close to being exactly out of phase. At frequencies below 2 kHz the phase difference is between −pi radians and −pi+1 radians (equivalent to −180 degrees and −120 degrees), and at frequencies below 4 kHz the phase difference is between −pi and −pi+pi/2 (equivalent to −180 degrees and −90 degrees). This is not the case for the loudspeaker spans of 20 degrees and 60 degrees. This confirms that in order to create virtual source images outside the angle spanned by the loudspeakers, the inputs to the stereo dipole must be almost, but not quite, out of phase over a substantial frequency range. As mentioned above, if the frequency responses of the two loudspeakers are substantially the same, then the phase difference between the vibrations of the loudspeakers will be substantially the same as the phase difference between the inputs to the loudspeakers.

Note also that the two loudspeakers vibrate substantially in phase with each other when the same input signal is applied to each loudspeaker.

The free-field analysis suggests that the lowest frequency at which the two loudspeaker inputs are in phase is the "ringing" frequency. As shown above for the three loudspeaker spans 60 degrees, 20 degrees, and 10 degrees, the ringing frequencies 1.8 kHz, and 10.8 kHz respesctively, and this is in good agreement with the frequencies at which the first zero-crossing in FIG. 18 occur. Note that the two loudspeaker inputs are always exactly out of phase at frequency 0 Hz. Note also that an exact match of the phase responses is still important at high frequencies even though the human localisation mechanism is not sensitive to time differences at high frequencies. This is because it is the interference of the second emitted from each of the two loudspeakers that guarantees that the amplitudes that are reproduced at the ears of the listener are correct. For some application, it might be desirable to force the two loudspeaker inputs to be in phase within a limited frequency range. For, example, this could be implemented in order to avoid the moderate boost of low frequencies (a similar technique was used to force very low frequencies to be in phase when cutting masters for vinyl records), or in order to prevent a colouration of the reproduced sound at very high frequencies where the "sweet spot" is bound to be very small anyway. When the phase response is not correctly matched within a certain frequency range, the illusion of the virtual source image will break down for signals whose main energy is concentrated within that frequency range, such as a third octave band noise signal. However, for signals of transient character the illusion might still work as long as the phase response is correctly matched over a substantial frequency range.

It will be appreciated that the difference in phase responses noted here will also result in similar differences in vibrations of the loudspeakers. Thus, for example, the loudspeaker vibrations will be close to 180° out of phase at low frequencies (eg less than 2 kHz when a loudspeaker span of about 10° is used).

FIG. 19 shows $v_1(n)$ and $-v_2(n)$ in the case when the desired waveform is a Hanning pulse whose bandwidth is approximately 3 kHz (the same as that used for the free-field analysis, see FIGS. 12 and 13). $v_2(n)$ is inverted in order to show how similar it is to $v_1(n)$. It is the small difference between the two pulses that ensures that the arrival times of the sound at the listener's ear are correct. Note how well the results shown in FIG. 19 agree with the results shown in FIG. 12 (FIG. 19*c* corresponds to FIG. 12*c*, 19*e* to 12*b*, and 19*f* to 12*a*).

FIG. 20 shows the difference between the impulse responses plotted in FIG. 19. Since $v_2(n)$ is inverted in FIG. 19, this difference is the sum of $v_1(n)$ and $v_2(n)$. It is seen that for the 10 degree loudspeaker span it is the tiny time difference between the onset of the two pulses that contributes most to the sum signal.

In order to implement a cross-talk cancellation system using two closely spaced loudspeakers, it is important that the filters used are closely matched, both in phase and in amplitude. Since the direct path becomes more and more similar to the cross-talk path as the loudspeakers are moved closer and closer together, there is more cross-talk to cancel out when the loudspeakers are close together than when they are relatively far apart.

The importance of specifying the cross-talk cancellation filters very accurately is now demonstrated by considering the properties of a set of filters calculated using a frequency domain method. The filters each contain 1024 coefficients, and the head-related transfer functions are taken from the MIT database. The diagonal element of H is denoted $h_1$, and the off-diagonal element is denoted $h_2$.

FIG. 21 shows the magnitude and phase response of the two filters $H_1(f)$ and $H_2(f)$. FIG. 21*a* shows their magnitude responses, and 21*b* shows the difference between the two. FIG. 21*c* shows their unwrapped phase responses (after removing a common delay corresponding to 224 samples), and FIG. 21*d* shows the difference between the two. It is seen that the dynamic range of $H_1(f)$ and $H_2(f)$ is approximately 35 dB, but even so the difference between the two is quite small (within 5 dB at frequencies below 8 kHz). As with virtual source imaging using the 10 degree loudspeaker span, the two filters are not in phase at any frequency below 10 kHz, and for frequencies below 8 kHz the absolute value of the phase difference is always greater than than pi/4 radians (equivalent to 45 degrees).

Figure 22A:
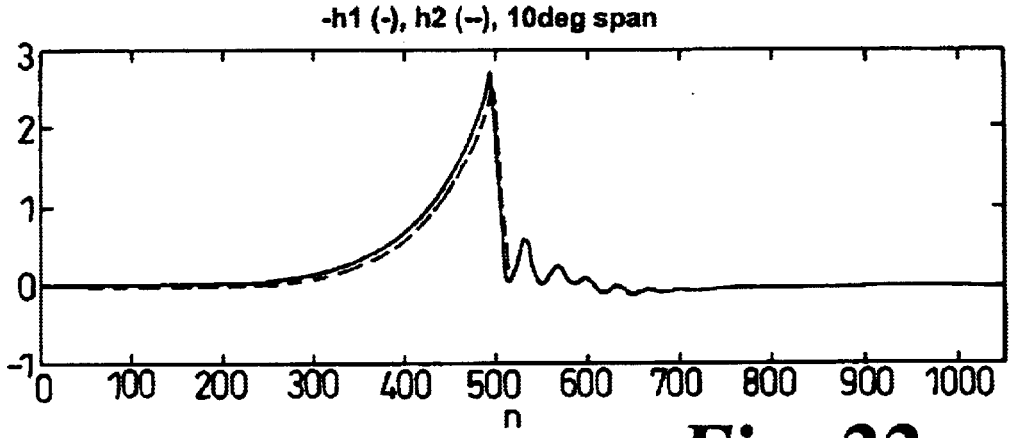
FIGS. 22*a* and 22*b* illustrate the Hanning pulse responses $h_1(n)$ and $-h_2(n)$ (a), and their sum (b), of the two filters whose frequency responses are shown in FIG. 21, FIGS. 23*a* and 23*b* compare the desired signals $d_1(n)$ and $d_2(n)$ to the signals $w_1(n)$ and $w_2(n)$ that are reproduced at the ears of a listener whose head is displaced by 5 cm directly to the left, (the desired waveform is a Hanning pulse), and FIGS. 24*a* and 24*b* compare the desired signals $d_1(n)$ and $d_2(n)$ to the signals $w_1(n)$ and $w_2(n)$ for a displacement of 5 cm directly to the right. The desired waveform is a Hanning pulse.
Figure 22B:
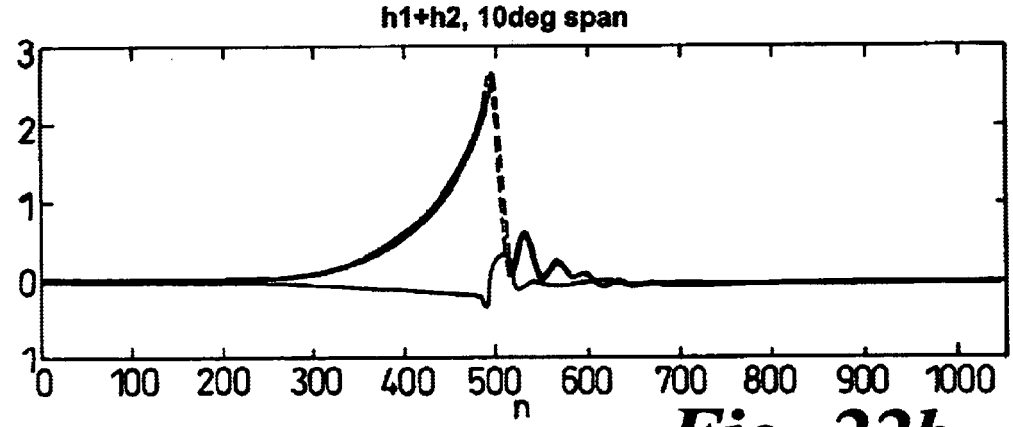

FIG. 22 shows the Hanning pulse response of the two filters (a) and their sum (b). It is clear that the two impulse responses are extremely close to being exactly equal and opposite. Thus, if $H_1(f)$ and $H_2(f)$ are not implemented exactly according to their specifications, the performance of the system in practice is likely to suffer severely.

Figure 23A:
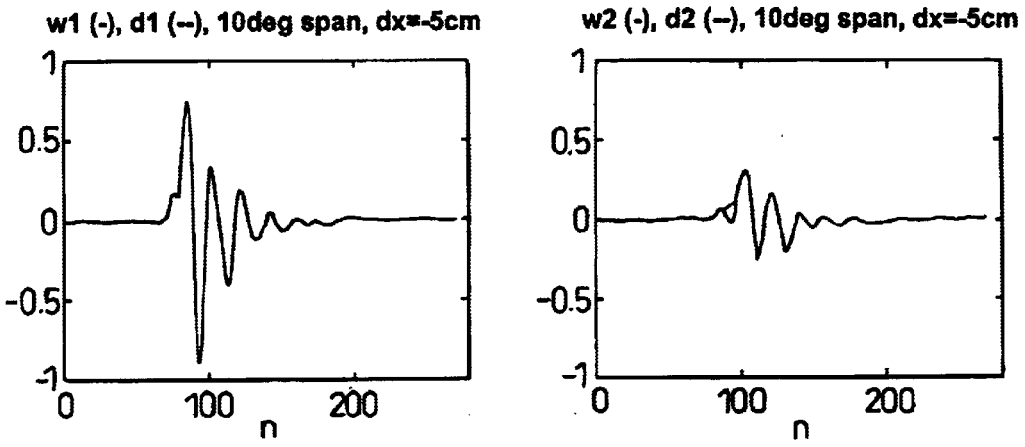
Figure 23B:
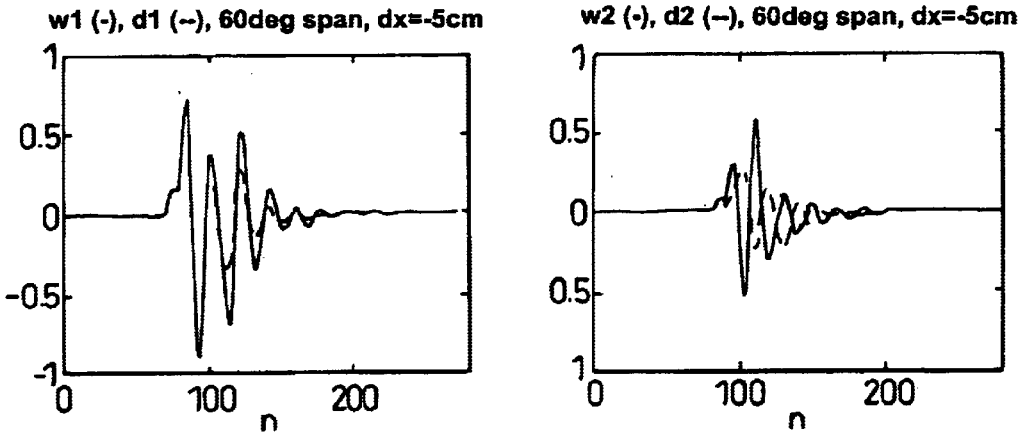
Figure 24A:
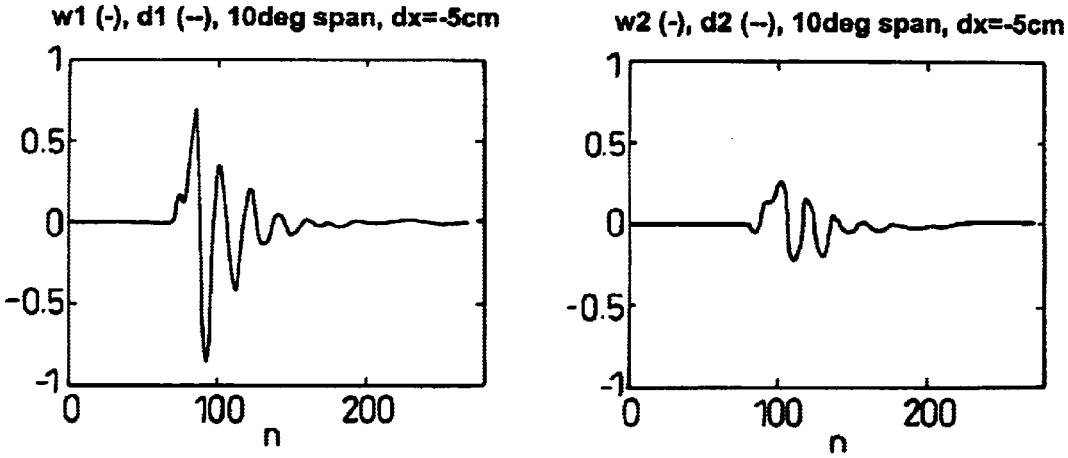
Figure 24B:
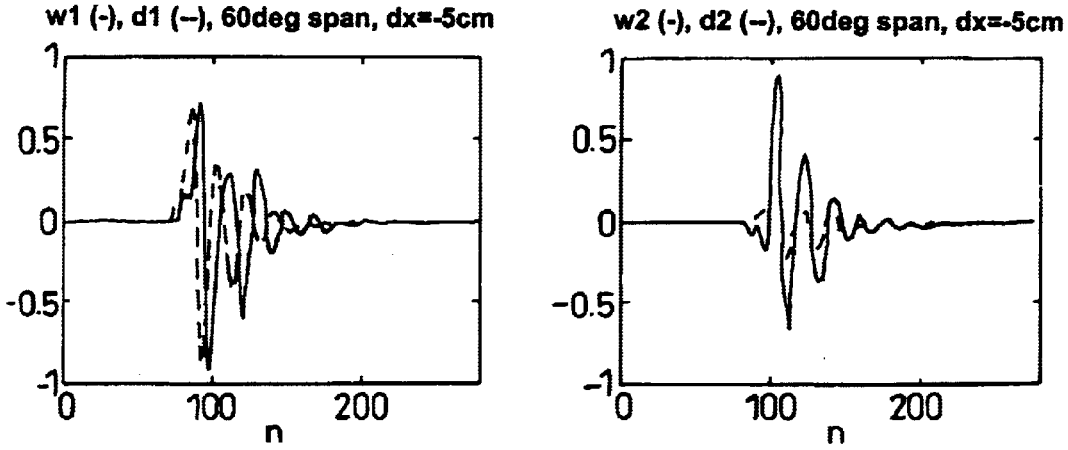

As it is important that the two inputs to the stereo dipole are accurately matched, it is remarkable how robust the stereo dipole is with respect to head movement. This is illustrated in FIGS. 23 and 24. The signals reproduced at the left ear ($w_1(n)$, solid line, left column) and right ear ($w_2(n)$, solid line, right column) are compared to the desired signals $d_1(n)$ and $d_2(n)$ (dotted lines) when the listener's head is displaced 5 cm to the left (FIG. 23) and 5 cm to the right (FIG. 24). The desired waveform is a Hanning pulse whose main energy is concentrated below 3 kHz, and the virtual source image is at 45 degrees relative to straight front. The head-related transfer functions are taken from the MIT database, and the loudspeaker inputs are therefore identical to the ones plotted in FIG. 19*c* (note that $v_2(n)$ is inverted in that figure).

FIG. 23 shows the signals reproduced at the ears of the listener when the head is displaced by 5 cm directly to the left (towards the virtual source, see FIG. 5). It is seen that the performance of the 10 degree loudspeaker span is not noticably affected whereas the signals reproduced at the ears of the listener by a loudspeaker arrangement spanning 60 degrees are not quite the same as the desired signals.

FIG. 24 shows the signals reproduced at the ears of the listener when the head is displaced by 5 cm directly to the right (away from the virtual source). This causes a serious degradation of the performance of a loudspeaker arrangement spanning 60 degrees even though the virtual source is quite close to the left loudspeaker. The image produced by the 10 degree loudspeaker span, however, is still not noticably affected by the displacement of the head.

The stereo dipole can also be used to transmit five channel recordings. Thus appropriately designed filters may be used to place virtual loudspeaker positions both in front of, and behind, the listener. Such virtual loudspeakers would be equivalent to those normally used to transmit the five channels of the recording.

When it is important to be able to create convincing virtual images behind the listener, a second stereo dipole can be placed directly behind the listener. A second rear dipole could be used, for example, to implement two rear surround speakers. It is also conceivable that two closely spaced loudspeakers placed one on top of the other could greatly improve the perceived quality of virtual images outside the horizontal plane. A combination of multiple stereo dipoles could be used to achieve full 3D-surround sound.

When several stereo dipoles are used to cater for several listeners, the cross-talk between stereo dipoles can be compensated for using digital filter design techniques of the type described above. Such systems may be used, for example, by in-car entertainment systems and by tele-conferencing systems.

A sound recording for subsequent play through a closely-spaced pair of loudspeakers may be manufactured by recording the output signals from the filters of a system according to the present invention. With reference to FIG. 1(*a*) for example, output signals $v_1$ and $v_2$ would be recorded and the recording subsequently played through a closely-spaced pair of loudspeakers incorporated, for example, in a personal player.

As used herein, the term 'stereo dipole' is used to describe the present invention, 'monopole' is used to describe an idealised acoustic source of fluctuating volume velocity at a point in space, and 'dipole' is used to describe an idealised acoustic source of fluctuating force applied to the medium at a point in space.

Use of digital filters by the present invention is preferred as it results in highly accurate replication of audio signals, although it should be possible for one skilled in the art to implement analogue filters which approximate the characteristics of the digital filters disclosed herein.

Thus, although not disclosed herein, the use of analogue filters instead of digital filters is considered possible, but such a substitution is expected to result in inferior replication.

More than two loudspeakers may be used, as may a single sound channel input, (as in FIGS. 8(*a*) and 8(*b*)).

Although not disclosed herein, it is also possible to use transducer means in substitution for conventional moving coil loudspeakers. For example, piezo-electric or piezo-ceramic actuators could be used in embodiments of the invention when particularly small transducers are required for compactness.

Where desirable, and where possible, any of the features or arrangements disclosed herein may be added to, or substituted for, other features or arrangements.

What is claimed is:

1. A sound reproduction system comprising loudspeaker means, and loudspeaker drive means for driving the loudspeaker means in response to signals from at least one sound channel, the loudspeaker means comprising a closely-spaced pair of loudspeakers, the loudspeaker drive means comprising filter means, the filter means comprising at least one pair of filters, an output of one filter of the pair of filters being applied to one loudspeaker of said pair of loudspeakers, an output of the other filter of the pair of filters being applied to the other loudspeaker of said pair of loudspeakers, the filter means having characteristics which are so chosen as to produce virtual images of sources of sound associated with the at least one sound channel at virtual source positions which subtend an angle at a predetermined listener position that is substantially greater than an angle subtended by the loudspeakers, characterised in that the loudspeakers define with the listener position an included angle of between 6° and 20° inclusive, and that the outputs of the pair of filters result in a phase difference between vibrations of the two loudspeakers where the phase difference varies with frequency from low frequencies where the vibrations are substantially out of phase to high frequencies where the vibrations are in phase, the lowest frequency at which the vibrations are in phase being determined approximately by a ringing frequency, $f_0$ defined by $$f_0=1/2\,\tau$$

where $$\tau = \tau = \frac{r_2 - r_1}{c_o},$$

and where $r_2$ and $r_1$ are the path lengths from one loudspeaker centre to the respective ear positions of a listener at the listener position, and $c_0$ is the speed of sound, said ringing frequency $f_0$ being at least 5.4 kHz.

2. A sound reproduction system as claimed in claim 1 wherein the included angle is between 8° and 12°, inclusive.

3. A sound reproduction system as claimed in claim 2 wherein the included angle is about 10°.

4. A sound reproduction system as claimed in claim 3, in which the filter means is so arranged that the reproduction in the region of the listener's ears of desired signals associated with a virtual source is efficient up to about 4 kHz even when the listener's head is moved 10 cm to the side from the predetermined listener position.

5. A sound reproduction system as claimed in claim 1 wherein the out of phase frequency range comprises the range 100 Hz to 4 kHz.

6. A sound reproduction system as claimed in claim 6 wherein the two loudspeakers vibrate substantially in phase with each other when a same input signal is applied to each loudspeaker.

7. A sound reproduction system as claimed in claim 6 wherein the input signals to the two loudspeakers are never in phase over a frequency range of 100 Hz to 4 kHz.

8. A sound reproduction system as claimed in claim 1 wherein the filter means are designed by employment of least mean squares approximation.

9. A sound reproduction system as claimed in claim 8 whereby substantial minimisation of the squared error between desired ear signals and reproduced ear signals occurs, so that signals reproduced at the listener's ears substantially replicate the waveforms of desired signals.

10. A sound reproduction system as claimed in claim 1 in which the filter means is provided with head related transfer function (HRTF) means.

11. A sound reproduction system as claimed in claim 10 wherein the head related transfer functions are represented by use of a matrix of filters.

12. A sound reproduction system as claimed in claim 1 which is provided with regularisation means operable to limit boosting of predetermined signal frequencies.

13. A sound reproduction system as claimed in claim 1 which is provided with modelling delay means.

14. A sound reproduction system as claimed claim 1 wherein the spacing between the centres of the loudspeakers are spaced by no more than about 45 cm.

15. A sound reproduction system as claimed in claim 1 wherein an optimal position for listening is at a head position between 0.2 meters and 4.0 meters from said loudspeakers.

16. A sound reproduction system as claimed in claim 15 wherein said head position is between 0.2 meters and 1.0 meters from said loudspeakers.

17. A sound reproduction system as claimed in claim 15 wherein said head position is about 2.0 meters from said loudspeakers.

18. A sound reproduction system as claimed in claim 1 wherein the loudspeaker centres are disposed substantially parallel to each other.

19. A sound reproduction system as claimed in claim 1 wherein axes of the loudspeaker centres are inclined to each other, in a convergent manner.

20. A sound reproduction system as claimed in claim 1 wherein the loudspeakers are housed within a single cabinet.

21. A sound reproduction system as claimed in claim 1 wherein the filter means comprise two pairs of filters, each of which operates on one channel of a two channel stereophonic recording.

22. A sound reproduction system as claimed in claim 1 wherein the loudspeaker drive means is responsive to channels of a conventional sound recording.

* * * * *